US007086841B2

(12) United States Patent
Cornwell

(10) Patent No.: US 7,086,841 B2
(45) Date of Patent: Aug. 8, 2006

(54) AIR COMPRESSOR WITH INLET CONTROL MECHANISM AND AUTOMATIC INLET CONTROL MECHANISM

(75) Inventor: James P. Cornwell, Erie, PA (US)

(73) Assignee: R. Conrader Company, Erie, PA (US)

( * ) Notice: Subject to any disclaimer, the term of this patent is extended or adjusted under 35 U.S.C. 154(b) by 0 days.

(21) Appl. No.: 10/827,647

(22) Filed: Apr. 19, 2004

(65) Prior Publication Data

US 2004/0213679 A1 Oct. 28, 2004

Related U.S. Application Data

(60) Provisional application No. 60/464,466, filed on Apr. 22, 2003.

(51) Int. Cl.
*F04B 49/03* (2006.01)
*F16K 31/36* (2006.01)

(52) U.S. Cl. ..... 417/290; 417/295; 417/298; 417/441; 137/492.5

(58) Field of Classification Search ..... 417/290, 417/295, 298, 440, 441
See application file for complete search history.

(56) References Cited

U.S. PATENT DOCUMENTS 3,195,805 A * 7/1965 Cholvin et al. ..... 137/500
3,834,837 A 9/1974 Weldon et al. ..... 417/298
4,089,623 A * 5/1978 Hofmann, Jr. ..... 417/295
5,388,967 A * 2/1995 Firnhaber et al. ..... 417/295
5,411,375 A 5/1995 Bauer ..... 417/295
5,456,582 A * 10/1995 Firnhaber et al. ..... 417/295
5,540,558 A * 7/1996 Harden et al. ..... 417/53
2002/0155007 A1 10/2002 Virgilio ..... 417/298

* cited by examiner

*Primary Examiner*—Charles G. Freay
(74) *Attorney, Agent, or Firm*—Edward W. Goebel, Jr.; Jon L. Woodard; MacDonald Illig Jones & Britton LLP

(57) ABSTRACT

An automatic inlet control mechanism and air compressor unit include a valve cavity and valve outlet. The valve cavity includes a valve control chamber and valve inlet chamber. A valve piston assembly is positioned between the valve control chamber and the valve inlet chamber to prevent the flow of air between therebetween. The valve outlet allows air to flow from the valve inlet chamber into the compressor unit. The valve piston assembly prevents air from flowing from the valve inlet chamber to the valve outlet when the compressor unit is not drawing air. A vent passageway allows air to flow between the valve control chamber and the compression cylinder inlet when compression is begun at the start-up of the compressor unit or at the loading of the idling compressor unit. A vent orifice restricts the flow of air from the valve control chamber to the compression cylinder inlet.

54 Claims, 35 Drawing Sheets

AIR COMPRESSOR WITH INLET CONTROL MECHANISM AND AUTOMATIC INLET CONTROL MECHANISM

This application takes priority from U.S. provisional application 60/464,466 filed Apr. 22, 2003, which is incorporated herein by reference.

BACKGROUND

Portable reciprocating air compressor units are commonly used in a variety of applications to produce pneumatic pressure from mechanical energy that is generated from a conventional energy source such as gasoline or electricity. Such an air compressor unit normally includes a compressor pump having a reciprocating piston located within a compression cylinder, a power plant such as a motor or engine that supplies mechanical energy to the piston to cause it to reciprocate and an air reservoir for storing compressed air. The compression cylinder is configured to draw air from the environment surrounding the compressor unit and to compress the drawn air that is discharged into an air reservoir, creating a supply of air pressure having a predeterminable magnitude. A motor, engine, or other power plant is normally connected to the compressor pump to drive the reciprocating piston within a compression cylinder.

During operation of the compressor unit, a rotating crankshaft, flywheel, or other assembly connected to the reciprocating piston stores a sufficient amount of angular momentum to substantially reduce the amount of high speed torque that must be exerted by the power plant to cause the piston to reciprocate. This allows the compressor pump to devote more of the total torque output of the power plant to drawing air into the compression cylinder, compressing the air and discharging the air into the air reservoir.

However, prior to operation, the crankshaft does not rotate and therefore has no angular momentum. The power plant must therefore contend with a substantially increased low speed torque requirement to overcome the combined inertial and compression loaded resistance of the piston and other components of the compressor pump until operating speed is achieved. This increased low speed torque requirement can result in adverse system effects on the power plant such as stalling, overloading, or premature wear. It can also require that a larger or more sophisticated power plant be used to overcome the initial starting torque of the compressor unit, even if such a power plant is not actually needed to sustain reciprocation of the piston after the compressor has attained an operating speed. It follows that if the compression loaded resistance of the piston can be reduced prior to the compressor pump reaching its full operating speed, it becomes possible for the power plant to devote more total torque output to overcoming inertial resistance. This in turn can minimize the adverse effects of combined inertial and compression loading, can allow for the use of a smaller or less powerful and/or less sophisticated power plant or starting system, and can therefore lead to substantial reductions in energy usage by the compressor unit.

SUMMARY

The invention is an automatic inlet control mechanism and an air compressor unit having both a piston reciprocating within a compression cylinder and a compression cylinder inlet for which the automatic inlet control mechanism is a component. The air compressor unit includes a power plant such as a motor or engine to reciprocate the piston and an air reservoir to store compressed air. The control mechanism itself includes a mechanism body having a valve inlet, a valve cavity and a valve outlet. The valve cavity is divided into a valve control chamber and a valve inlet chamber. A valve piston assembly is positioned between the valve control chamber and the valve inlet chamber and is constructed to prevent the flow of air between the two chambers. The valve inlet allows air to flow from the atmosphere surrounding the compressor unit into the valve inlet chamber. The valve outlet allows air to flow from the valve inlet chamber to the compression cylinder inlet and has a size that allows a sufficient amount of air to flow into the compressor unit to allow the compressor unit to produce compressed air at a predetermined rate of production.

The valve piston assembly includes a valve piston that is configured to reciprocate within the valve cavity. In some embodiments, the valve piston assembly includes a diaphragm that is positioned to prevent airflow between the valve control chamber and the valve inlet chamber. A biasing member provides a force that moves the valve piston assembly to a position within the inlet control mechanism that prevents air from flowing from the valve inlet to the valve outlet when the compressor unit is not drawing air through the valve outlet. This occurs, by way of example, when a compressor unit is shut down or when a continuously running compressor unit is unloaded and is idling.

A vent passageway allows air to flow between the valve control chamber and the compression cylinder inlet when compression is begun at the start-up of a compressor unit or at the loading of an idling compressor unit, as the case may be. The vent passageway is at least one source of air to the compressor cylinder inlet at this time and for a period of time after the compressor unit begins to draw air through the compression cylinder inlet, following the movement of the valve piston assembly to a position which prevents air from flowing from the valve inlet chamber and through the valve outlet to the compression cylinder inlet. A vent orifice restricts the flow of air from the valve control chamber to the compression cylinder inlet. The vent orifice has a size that allows the air to be drawn by the compressor unit from the valve control chamber to the compressor cylinder at a preselected rate which causes the compressor unit to produce compressed air at less that its predetermined rate of production.

The valve control chamber has a volume that enables air to be drawn through the vent orifice into the compression cylinder inlet for a preselected period of time, until the air within the control chamber is at a sufficiently reduced pressure level to allow the valve inlet chamber to overcome the force of the biasing member sufficiently to move the valve piston assembly away from the position at which air is prevented from flowing between the valve inlet chamber and the compression cylinder inlet.

During the preselected period of time, the absence of air flow from the valve inlet chamber to the compression cylinder inlet allows the power plant to dedicate more of its torque output on inertial rather than compression loading. Thus, during this preselected period of time, the compressor unit increases its operating speed without subjecting the full combined load of inertial and compression loading on the power plant. This removal of initial operating torque when compression is started can allow for a substantial reduction in power plant wear or allow for a reduction in the power plant size to that which is necessary to maintain the reciprocation of the piston under load when the compressor has attained its operating speed.

By the time that the compressor unit achieves an operating speed, the valve piston assembly has moved away from a position that prevents air from flowing between the valve inlet chamber and compression cylinder inlet. Air then flows unobstructed from the environment surrounding the compressor into the compression cylinder, allowing the compressor to produce air at its predetermined rate of production.

Those skilled in the art will realize that this invention is capable of embodiments that are different from those shown and that details of the structure of the disclosed inlet control mechanism can be changed in various manners without departing from the scope of this invention. Accordingly, the drawings and descriptions are to be regarded as including such equivalent inlet control mechanisms as do not depart from the spirit and scope of the invention.

DETAILED DESCRIPTION

Figure 1:
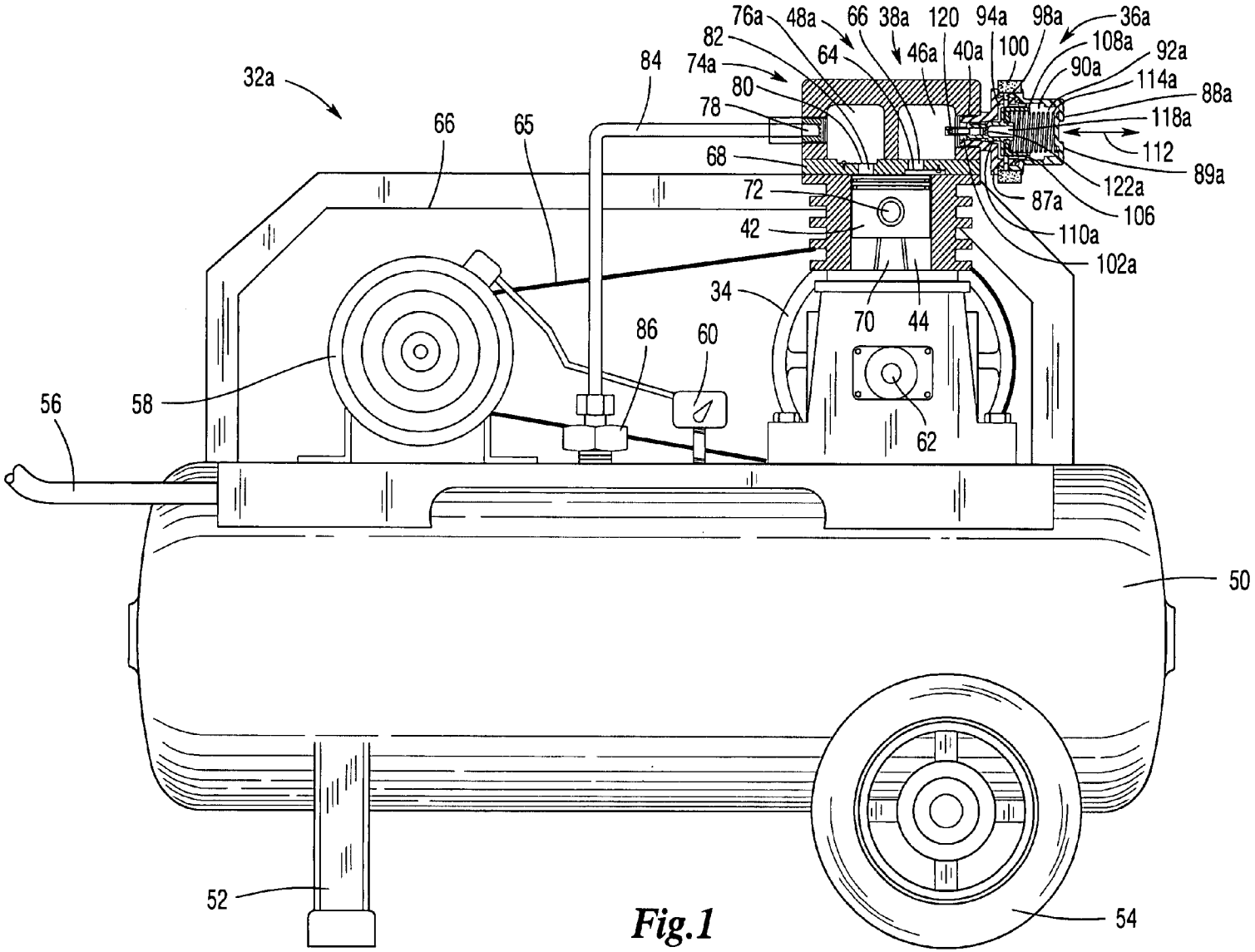
FIG. 1. is a partial cross sectional view of an air compressor unit having an automatic inlet control mechanism according to one embodiment of the invention.

Referring to the drawings, similar reference numerals are used to designate the same or corresponding parts throughout the several embodiments and figures. In some drawings, some specific embodiment variations in corresponding parts are denoted with the addition of lower case letters to reference numerals.

FIG. 1 depicts a typical wheeled portable reciprocating air compressor unit 32*a*. The compressor unit 32*a* includes a compressor pump 48*a* mounted on an air reservoir 50 that forms a structural chassis to support the various components of the compressor unit 32*a*. The compressor unit 32*a* is supported with one or more legs 52 and wheels 54 that are positioned near the ends of the air reservoir 50. A handle 56 allows one end of the compressor unit 32*a* to be lifted off of its legs 52 to enable the compressor unit 32*a* to be moved about on its wheels 54.

An electric motor 58 and pressure switch 60 are also mounted on the air reservoir 50. Although FIG. 1 depicts an electric motor, it will be appreciated that other types of power plants can be similarly implemented and are within the contemplated scope of the invention. The electric motor 58 is connected to draw electrical current from an electrical circuit (not shown) when the pressure switch 60 assumes an ON position. When the pressure switch 60 assumes an ON position, the motor 58 drives a pulley 34 connected to a crank shaft 62 on the compressor pump 48*a* with a drive belt 65. Although the crank shaft 62 is depicted as being belt driven in FIG. 1, it will be appreciated that the invention can be similarly implemented into a direct drive system in which rotational energy is transferred directly from a motor or other power plant to the crankshaft of a compressor pump through a shaft, gear, or other connective mechanism. In some embodiments, the pulley 34 can also function as a flywheel or, alternatively a separate flywheel (not shown) can be connected to the crankshaft 62. The pressure switch 60 is configured to be responsive to air pressure within the air reservoir 50 and to allow operation of the electric motor 58 when the magnitude of the pressure within the air reservoir 50 falls below a predetermined magnitude. A screen guard 66 encloses the drive belt 65 and pulley 34.

Although FIG. 1 depicts an air compressor unit 32*a* having basic compressor components arranged in a typical single reservoir configuration, it will be appreciated that other portable compressor unit configurations are also possible. Such compressor units include those having upright standing, pancake, spherical or multiple air reservoirs and/or liftable, all legged, tailored, wheelbarrow, or sliding chassis configurations. Other similar variations are also possible and are contemplated to be included within the types of portable reciprocating air compressor units that are suitable for use with the invention.

FIG. 1 includes a partial cross sectional view of internal components within the compressor pump 48*a* to further illustrate their relation to the rest of the compressor unit 32*a*. An automatic inlet control mechanism 36*a* is connected to a threaded inlet port 40*a* of a compression cylinder inlet 38*a*. The inlet control mechanism 36*a* and compression cylinder inlet 38*a* allow air to enter the compressor pump 48*a* during each reciprocation of a piston 42 that is located within a compression cylinder 44. The inlet port 40*a* is positioned to channel air from the inlet control mechanism 36*a* to a cylinder inlet chamber 46*a* which receives air before the air is channeled into the compression cylinder 44 through a cylinder inlet valve 64 positioned within a cylinder inlet hole 66. The cylinder inlet hole 66 and cylinder inlet valve 64 can be included as part of a valve plate 68 that is positioned between the cylinder inlet chamber 46*a* and compression cylinder 44. The cylinder inlet valve 64 is unidirectional in that it only allows air to flow through the cylinder inlet hole 66 from the cylinder inlet chamber 46*a* when, during an intake stroke (downward as depicted in FIG. 1) of the piston 42, the piston 42 draws air into the compression cylinder 44. During a compression stroke (upward as depicted in FIG. 1) of the piston 42, the cylinder inlet valve 64 closes to prevent air from flowing from the compression cylinder 44, through the cylinder inlet hole 66 and back into and through the cylinder inlet chamber 46*a*.

The electric motor 58 effects reciprocation of the piston 42 by turning the pulley 34 and crankshaft 62 of the compressor pump 48*a* with the drive belt 65. The crankshaft 62 in turn causes reciprocation of a piston shaft 70 which drives the piston 42, the piston shaft 70 being connected to the piston 42 with a piston pin 72. The amount of work that the electric motor 58 must perform to cause the reciprocation of the piston 42 ultimately depends on the amount of air that is drawn through the compression cylinder inlet 38*a* during each piston reciprocation. This is due to the fact that the amount of air that is drawn through the compression cylinder inlet 38*a* ultimately determines the amount of air that the piston 42 can draw into the compression cylinder 44 and compress during each reciprocation. Thus, the amount of energy that the electric motor 58 must exert to run the compressor unit 32*a* is directly dependent on the amount of air that is permitted to pass through the automatic inlet control mechanism 36*a* during each reciprocation.

A compression cylinder outlet 74*a* is positioned to receive air that has been compressed in the compression cylinder 44 and to channel air from the compression cylinder 44 out of the compressor pump 48*a* during each compression stroke of the piston 42. The compression cylinder outlet 74*a* includes a cylinder outlet chamber 76*a* for receiving air that has been compressed in the compression cylinder 44, an outlet port 78, and a unidirectional cylinder outlet valve 80 located in a cylinder outlet hole 82 for channeling air into the cylinder outlet chamber 76*a*. The cylinder outlet hole 82 and cylinder outlet valve 80 can be included as part of the valve plate 68 that is positioned between the compression cylinder 44 and cylinder outlet chamber 76*a*. The cylinder outlet valve 80 is unidirectional in that it only allows air to flow through the cylinder outlet hole 82 and into the cylinder outlet chamber 76*a* when, during a compression stroke of the piston 42, the piston 42 expels air from the compression cylinder 44. During an intake stroke of the piston 42, the cylinder outlet valve 80 closes to prevent air from flowing from the cylinder outlet chamber 76*a* back through the cylinder outlet hole 82 and into the compression cylinder 44.

A discharge tube 84 is connected to the outlet port 78 to channel compressed air from the compressor pump 48*a* to the air reservoir 50. A check valve 86 is positioned at the end of the discharge tube 84 to allow air to flow from the discharge tube 84 into the air reservoir 50 while preventing backflow from the reservoir 50 into the discharge tube 86 and to prevent loss of air pressure from within the reservoir 50.

The pressure switch 60 is connected to the electric motor 58 and is mounted at a location that allows the pressure switch 60 to sense the pressure of air contained within the air reservoir 50. As air is forced into the air reservoir 50, pressure in the air reservoir 50 increases. When the air pressure within the air reservoir 50 reaches a predetermined maximum magnitude of pressurization, the pressure switch 60 assumes an OFF position since additional air compression is not necessary. Once the air pressure within the air reservoir 50 falls below a minimum predetermined magnitude, the pressure switch 60 assumes an ON position, allowing the electric motor 58 to cause the compressor pump 48*a* to add compressed air to the air reservoir 50 until the air pressure within the air reservoir 50 rises to the predetermined maximum magnitude at which time the pressure switch 60 returns to an OFF position. However, the amount of air that is compressed, and consequently the amount of work that is performed by the electric motor 58 with each reciprocation of the piston 42, will continue to depend on the amount of air that is permitted to enter the compression cylinder through the compression cylinder inlet 38*a*

Since it is the electric motor 58 that is responsible for turning the drive belt 65 and pulley 34 to effect reciprocation of the piston 42, the electric motor 58 must also provide sufficient energy to contend with additional loads resulting from combined inertial and compression loaded resistance of the piston 42 and other components of the compressor pump 48*a*. Thus, if air is permitted to freely enter the compression cylinder 44 through the compression cylinder inlet 38*a*, the electric motor 58 must contend with an increased starting torque that includes both with the compression loaded resistance of the piston 42 and the combined inertial resistance of the piston 42 and other components of the compressor unit 32*a*. If air is restricted from entering the compression cylinder 44 through the compression cylinder inlet 38*a*, the electric motor 58 need only contend with the combined inertial resistance of the piston 42 and other components of the compressor unit 32*a* once air is removed from the compression cylinder inlet 38*a* and compression cylinder 44.

During operation, the rotating crankshaft 62, pulley 34, drive belt 65, and other components of the compressor unit 32*a* rotate at an operating speed and therefore store a sufficient amount of angular momentum to substantially reduce the amount of high speed torque that must be exerted by the electric motor 58 to maintain the reciprocating motion of the piston 42. This allows the compressor pump 48*a* to devote more of the total torque output of the electric motor 58 to drawing air into the compression cylinder 44, compressing the air, and discharging the air into the air reservoir 50.

However, prior to operation, the crankshaft 62, pulley 34, and other components do not rotate at an operating speed and therefore do not provide angular momentum that to assist the electric motor 58 in causing the reciprocation of the piston 42 while the piston is compression loaded. Therefore, in order to reduce the total torque output required from the electric motor 58 at the start of operation, i.e. in order to reduce the starting torque, it is necessary to temporarily remove the compression loaded resistance of the piston 42 until the motor 58 overcomes the inertial resistance of the compressor pump 48*a*, allowing the compressor pump 48*a* to first reach a full operating speed and restore angular momentum to the crankshaft 62, pulley 34, and other components of the compressor unit 32*a*.

Figure 2A:
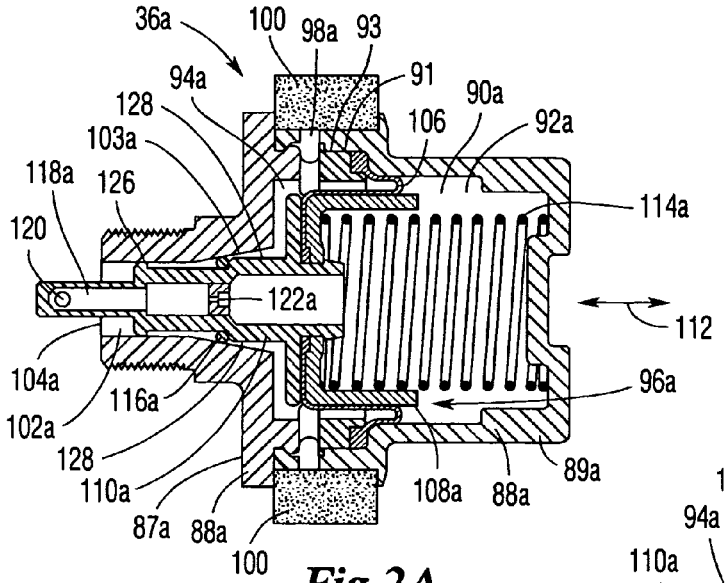
FIG. 2A is a side cross sectional view of the automatic inlet control mechanism of FIG. 1 in a fully closed position.

The automatic inlet control mechanism 36*a* is configured to allow for the temporary removal of piston compression loading until the compressor pump 48*a* reaches a full operating speed. FIG. 1 depicts the inlet control mechanism 36*a* connected to the inlet port 40*a* of the compressor unit 32*a*, the inlet control mechanism 36*a* being shown in a closed position. A magnified view of the inlet control mechanism 36*a* of FIG. 1 is depicted in FIG. 2A. An exploded view depicting the components of the inlet control mechanism is depicted in FIG. 3.

Figure 3:
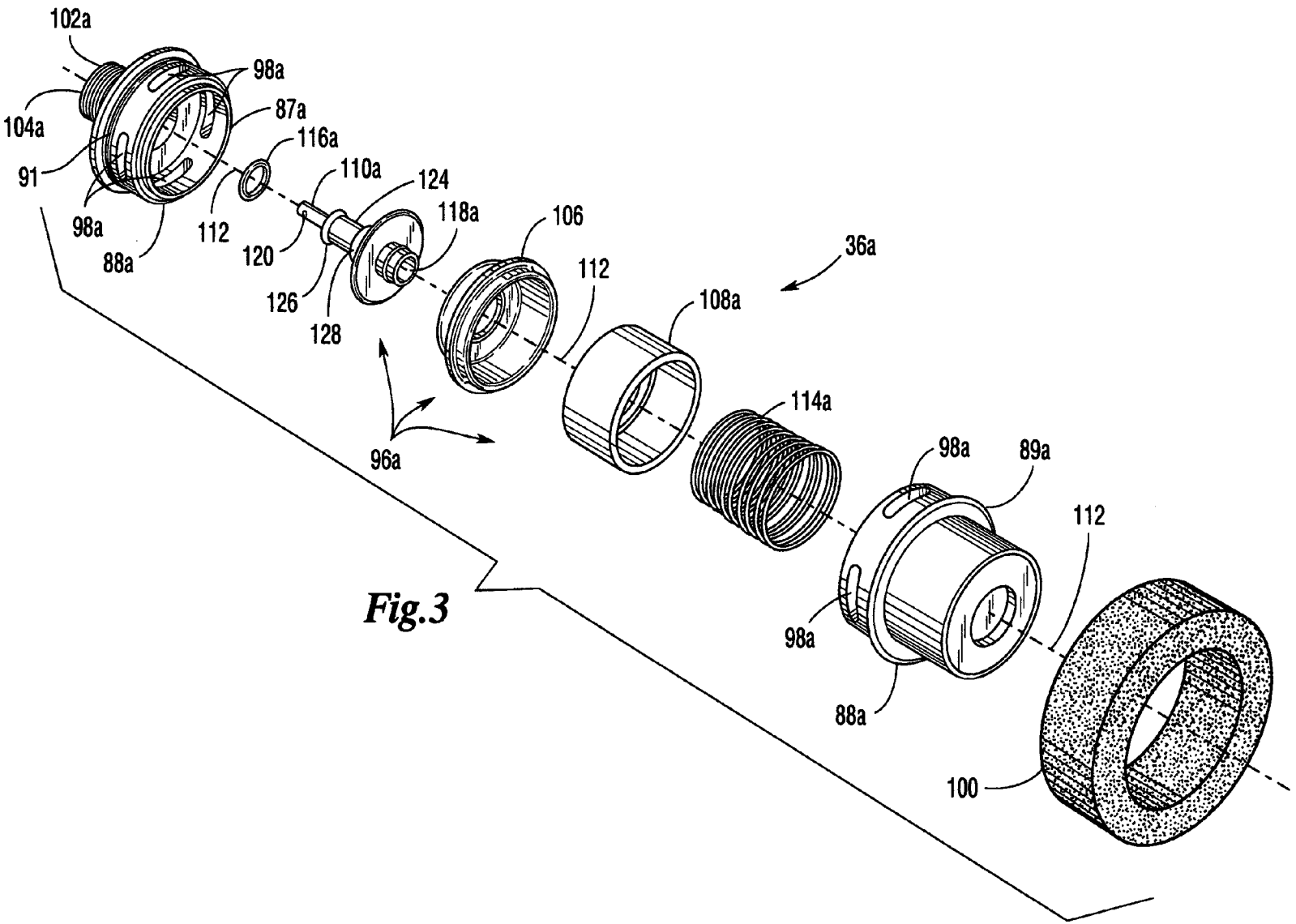
FIG. 3 is an exploded perspective view of the automatic inlet control mechanism of FIGS. 2A–C.

Comparing FIGS. 1, 2A, and 3, the control mechanism 36*a* includes a mechanism body 88*a* having a valve cavity 90*a* that is divided into a valve control chamber 92*a* and a valve inlet chamber 94*a*. The mechanism body 88*a* can include an inlet segment 87*a* and a control segment 89*a* that can be detached from each other prior to assembly to allow for the installation of a valve piston assembly 96*a* and/or other mechanism components into the valve cavity 90*a*. A male connector 91 on the inlet segment 87*a* allows for engagement with a female connector 93 on the control segment 89*a*, the male connector 91 and female connector 93 being snap connected when the mechanism body 88*a* is assembled. When the mechanism body 88*a* is assembled, the valve piston assembly 96*a* is positioned between the valve control chamber 92*a* and valve inlet chamber 94*a* and is configured to reciprocate within the valve cavity 90*a* while preventing air from flowing directly between the valve control chamber 92*a* and valve inlet chamber 94*a*.

A valve inlet 98*a* extends through the mechanism body 88*a* and allows air to flow from the atmosphere surrounding the compressor unit 32*a* into the valve inlet chamber 94*a*. The valve inlet 98*a* can include a filter 100 to remove impurities from air that passes through the valve inlet 98*a* before the air enters the valve inlet chamber 94*a*. A valve outlet 102*a* includes a valve outlet hole 104*a* positioned to allow air to flow from the valve inlet chamber 94*a* into the compression cylinder inlet 38*a*. The valve outlet 102*a* is threaded to allow for connection to the inlet port 40*a* of the compression cylinder inlet 38*a*. The valve outlet hole 104*a* is sized to allow a sufficient amount of air to flow from the inlet control mechanism 36*a* to the compression cylinder inlet 38*a* to allow the compressor unit 32*a* to produce air at its predetermined rate of production. The valve outlet hole 104*a* can further include a tapered portion 103*a*.

The valve piston assembly 96*a* includes a valve piston 108*a*, a diaphragm 106, a valve stem 110*a*, and a valve stem seal 116*a* that are configured to reciprocate within the valve cavity 90*a* along a valve axis 112. Within the valve cavity 90*a*, the diaphragm 106 forms a seal between the inside surface of the mechanism body 88*a* and the rest of the valve piston assembly 96*a* to prevent air from moving directly between the valve control chamber 92*a* and valve inlet chamber 94*a*. A spring biasing member 114*a* produces a force that biases the valve piston assembly to move toward the valve inlet chamber 94*a* and away from the valve control chamber 92*a* to a position within the inlet control mechanism 36*a* in which the valve stem seal 116*a* contacts the inside surface of the mechanism body 88*a* to prevent air from flowing from the valve inlet chamber 94*a* through the valve outlet 102*a*.

A vent passageway 118*a* extends through the valve stem 110*a*, opening to the valve control chamber 92*a* and allowing for the communication of air between the valve control chamber 92*a* and valve outlet 102*a* or compression cylinder inlet 38*a* through a stem hole 120. An orifice 122*a* forms a restriction to air that flows through the vent passageway 118*a*, delaying the rate at which air can communicate between the valve control chamber 92*a* and valve outlet 102*a* or compression cylinder inlet 38*a*.

The valve stem 110*a* also includes a sliding surface 124 on which the valve stem seal 116*a* reciprocates in response to the movement of the valve stem 110*a* with the valve piston assembly 96*a* and/or the air pressure differential between the compression cylinder inlet 38*a* and valve inlet chamber 94*a*. The valve stem seal 116*a* can be constructed of rubber, teflon, a resilient polymer, or any other material that allows for sliding or reciprocation of the valve stem seal 110*a* along the sliding surface 124 while also allowing for the creation of a seal between the sliding surface of the valve stem 110*a* and the inside surface of the mechanism body 88*a* when the piston assembly is in a position within the valve cavity 90*a* that prevents air from flowing from the valve inlet chamber 94*a* to the compression cylinder inlet. A lip 126 and an expanded radius 128 are positioned at opposite ends of the sliding surface 124 to restrict the reciprocating movement of the valve stem seal 116*a*.

To better understand the operation of the automatic inlet control mechanism 36*a*, consider the air compressor unit 32*a* prior to operation, as depicted in FIGS. 1 and 2A. Electric current from an electric circuit (not shown) is not connected to the pressure switch 60 since the compressor unit 32*a* is either not in use (power OFF) or is instead in use (power ON) but air pressure within the air reservoir 50 is greater than a predetermined minimum magnitude. In either case, the pressure switch 60 does not permit electric current to flow to reach the electric motor 58. The electric motor 58 does not cause rotation of the drive belt 65, pulley 34, and drive shaft 62. Therefore, the piston 42 does not reciprocate within the compression cylinder 44 and air is neither drawn through the cylinder inlet valve 64 nor forced through the cylinder outlet valve 80 in the compressor pump 48*a*. The spring biasing member 114*a* forces the valve piston assembly 96*a* away from the valve control chamber 92*a* and toward the valve inlet chamber 94*a*. The valve stem seal 116*a*, having a larger diameter than part of the tapered portion 103*a* of the valve outlet 102*a*, seals between the valve outlet 102*a* and sliding surface 124 of the valve stem 110*a* as the expanded radius 128 forces the valve stem seal 116*a* against the tapered portion 103*a* under the force of the spring biasing member 114*a*. The resulting seal between the valve stem 110*a* and valve outlet 102*a* prevents air from the atmosphere surrounding the air compressor unit from 32*a* entering the compression cylinder 44 through the valve inlet chamber 94*a*.

Now consider the compressor unit 32*a* when electric current is initially connected to the pressure switch 60 (power ON) and/or when pressure within the air reservoir 50 falls below a predetermined minimum magnitude while power is ON. The pressure switch 60 senses the low air pressure within the air reservoir 50 and in response connects the electric motor 58 to electric current from the electrical circuit. The motor 58 begins to rotate the drive belt 65, pulley 34, and drive shaft 62 to initiate reciprocation of the piston 42. However, the motor 58 must contend with the inertial resistance of each of these components. In addition, the motor 58 must also contend with any air that is present within the compressor pump 48*a* or discharge tube 84. However, the valve stem 10*a* and valve stem seal 116*a* prevent air from the atmosphere surrounding the compressor unit 32*a* from entering the compressor pump 48*a* through the inlet control mechanism 36*a*.

As the piston 42 begins to reciprocate, remaining air is quickly drawn out of the cylinder inlet chamber 46*a* and forced through the cylinder outlet valve 80 into the cylinder outlet chamber 76*a* and discharge tube 84. During a very short time interval, the speed of the initial rotation of the drive belt 65, pulley 34, and drive shaft 62 and the speed of reciprocation of the piston 42 is very low. During this very short interval, the electric motor 58 must bear the combined inertial and compression loaded resistance of the piston 42 and other components. Thus, during this short interval, the combined loads cause the electric motor 58 to experience a high current draw or "current spike."

However, after a very small number of piston reciprocations, most of the air initially present in the cylinder inlet chamber 46*a* is removed by the reciprocating piston 42. Most of the air is removed from the cylinder inlet chamber 46*a* while the piston 42 reciprocates at a very low relative speed. Since the valve stem 110*a* and valve stem seal 116*a* prevent additional amounts of air from entering the compressor pump 48*a* from the atmosphere through the valve inlet 98*a* of the inlet control mechanism 36*a*, air drawn through the vent passageway 118*a* from the valve control chamber 92*a* becomes the primary source of air to the compression cylinder inlet 38*a* as the speed of the electric motor 58 and the reciprocation rate of the piston 42 begin to increase.

The air drawn through the vent passageway 118*a* from the valve control chamber 92*a* continues to be the primary source of air to the compression cylinder inlet 38*a* as long as the valve piston assembly 96*a* is in a position that prevents air from flowing from the valve inlet chamber 94*a* to the compressor cylinder inlet 38*a*. However, the orifice 122*a* forms a restriction that limits the rate at which air can be drawn into the compression cylinder inlet 38*a* through the vent passageway 118*a*. As a result of this restriction, the amount of air that can be drawn into the compression cylinder inlet 38*a* from the valve control chamber 92*a* during a given time interval is very small compared to the amount of air that can be drawn from the valve inlet chamber 94*a* when the valve piston assembly 96*a* is in a position that does not prevent air from flowing between the valve inlet chamber 94*a* and compression cylinder inlet 38*a*. Consequently, compression loading of the piston 42 is greatly reduced as long as the valve control chamber 92*a* remains the primary source of air to the compression cylinder inlet 38*a*. This reduction in compression loading of the piston 42 allows the electric motor 58 to devote more total torque output to overcoming inertial resistance as the speed of the motor 58 and reciprocation rate of the piston 42 increase. Since compression loading of the piston 42 is reduced, the compressor unit 32*a* produces compressed air at less than its predetermined rate of production. However, the reduction in initial compression loading can be effective in significantly reducing wear of the electric motor 58 and/or can allow the motor 58 to be reduced in size to only that which is necessary to maintain the reciprocation of the piston 42 once the piston has achieved an operating speed. This can in turn allow for a substantial reduction in wear, component cost, or energy usage.

As the speed of the motor 58 and the reciprocation rate of the piston 42 continue to increase, air continues to be drawn through the vent passageway 118*a*, orifice 122*a*, and stem hole 120 from the valve control chamber 92*a* into the cylinder inlet chamber 46*a*. This reduces the amount of air pressure that is present within the valve control chamber 92*a*. Atmospheric pressure within the valve inlet chamber 94*a* is maintained by air communication through the valve inlet 98*a*. The sealed separation between the valve inlet chamber 94*a* and valve control chamber 92*a* created by the diaphragm 106 results in a pressure differential between the chambers that begins to force the diaphragm 106 and the rest of the valve piston assembly 96*a*, against the force of the spring biasing member 114*a* and toward the valve control chamber 92*a* to an intermediate position within the valve cavity 90*a*.

Figure 2B:
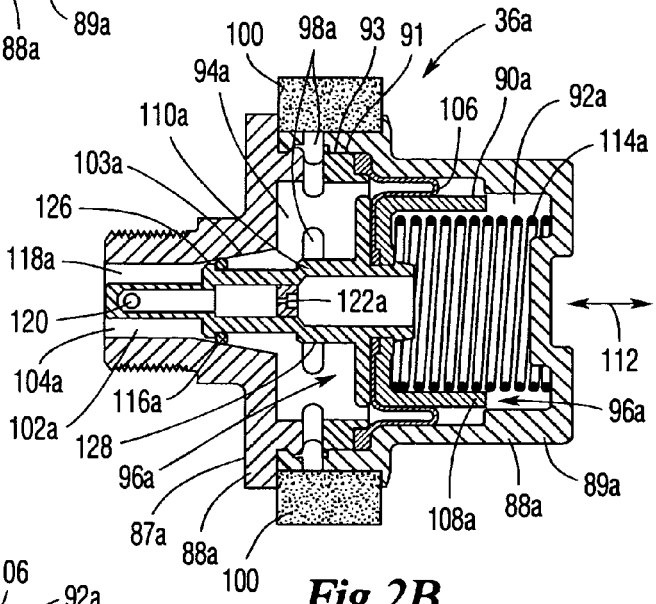
FIG. 2B is a side cross sectional view of the automatic inlet control mechanism of FIG. 1 in an intermediate position.

FIG. 2B depicts the inlet control mechanism 36*a* in which the valve piston assembly 96*a* is located at such an intermediate position within the valve cavity 90*a*. As the valve stem 110*a* moves toward the valve control chamber 92*a*, very little pressure continues to occupy the compression cylinder inlet 38*a* though atmospheric pressure continues to exist within the valve inlet chamber 94*a*. This creates a pressure differential that continues to force the valve stem seal 116*a* against the tapered portion 103*a* of the valve outlet 102*a*. As the valve stem 110*a* moves with the rest of the valve piston assembly 96*a* toward the valve control chamber 92*a*, the valve stem seal 116*a* slides against the sliding surface 124 of the valve stem 110*a*, maintaining the seal between the valve stem 110*a* and the inside surface of the mechanism body 88*a* while continuing to prevent air from flowing from the valve inlet chamber 94*a* and compression cylinder inlet 38*a*. The valve stem 110*a* is normally configured so that the valve stem seal 116*a* continues to seal between the valve stem 110*a* and mechanism body 88*a* until the electric motor 58 and compressor unit 32*a* achieve an operating speed.

Figure 2C:
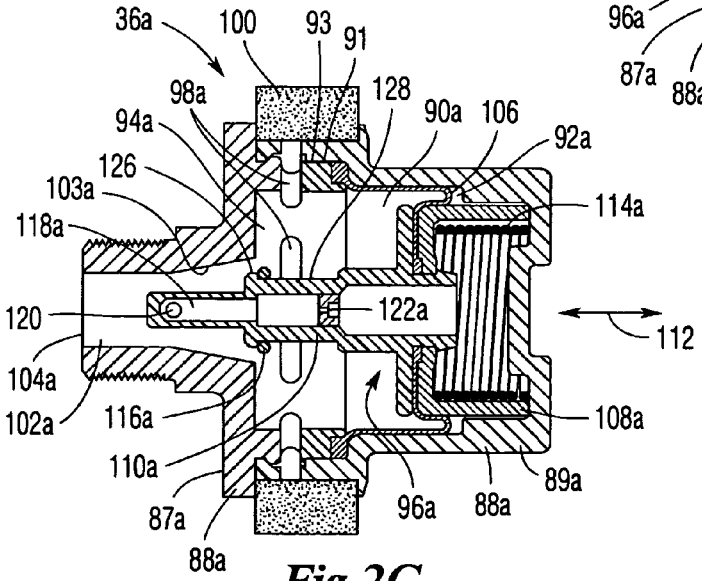
FIG. 2C is a side cross sectional view of the automatic inlet control mechanism of FIG. 1 in an open position.

As the piston 42 continues to draw air from the valve control chamber 92*a*, the pressure differential between the valve inlet chamber 94*a* and compression cylinder inlet 38*a* continues to force the valve stem seal 116*a* against the tapered portion 103*a* of the valve outlet 102*a* until the valve stem seal 116*a*, sliding across the sliding surface 124, contacts the lip 126 of the valve stem 110*a*. The lip 126 forces the valve stem seal 116*a* away from the tapered portion 103*a* of the valve outlet 102*a*. The valve piston assembly 96*a* continues to move toward the valve control chamber 92*a* until the air in the valve control chamber 92*a* is at a sufficiently reduced pressure level that enables atmospheric pressure in the valve inlet chamber 94*a* to overcome the force of the spring biasing member 114*a* sufficiently to move the valve piston 108*a* to contact the mechanism body 88*a* as shown in FIG. 2C. This movement creates an air space 130*a* allowing air from the valve inlet chamber 94*a* and atmosphere to enter the compression cylinder inlet 38*a*. However, by the time that the valve stem seal 116*a* moves away from the mechanism body 88*a*, the electric motor 58 and compressor unit 32*a* will normally have achieved an operating speed and are therefore better equipped to deal with additional compression loading against the piston 42.

The amount of time required for the valve piston assembly 96*a* to move to a position, such as that depicted in FIG. 2C, that does not prevent air from flowing from the valve inlet chamber 94*a* through the valve outlet 102*a* into the compression cylinder inlet 38*a* depends on the rate at which air can be drawn by the piston 42 from the valve control chamber 92*a*, which in turn depends on the size of the orifice 122*a*. Thus, the amount of time during which the automatic inlet control mechanism 36*a* removes compression loading on the piston depends on the size or effective size of the vent restriction of air flowing through the vent passageway 118*a*. This amount of time can be preselected by incorporating an orifice or other restriction having a size or effective size that corresponds to the rate of allowed air flow allowing for sufficient time for the compressor unit 32*a* to achieve a desired operating speed while unloaded.

Figure 4:
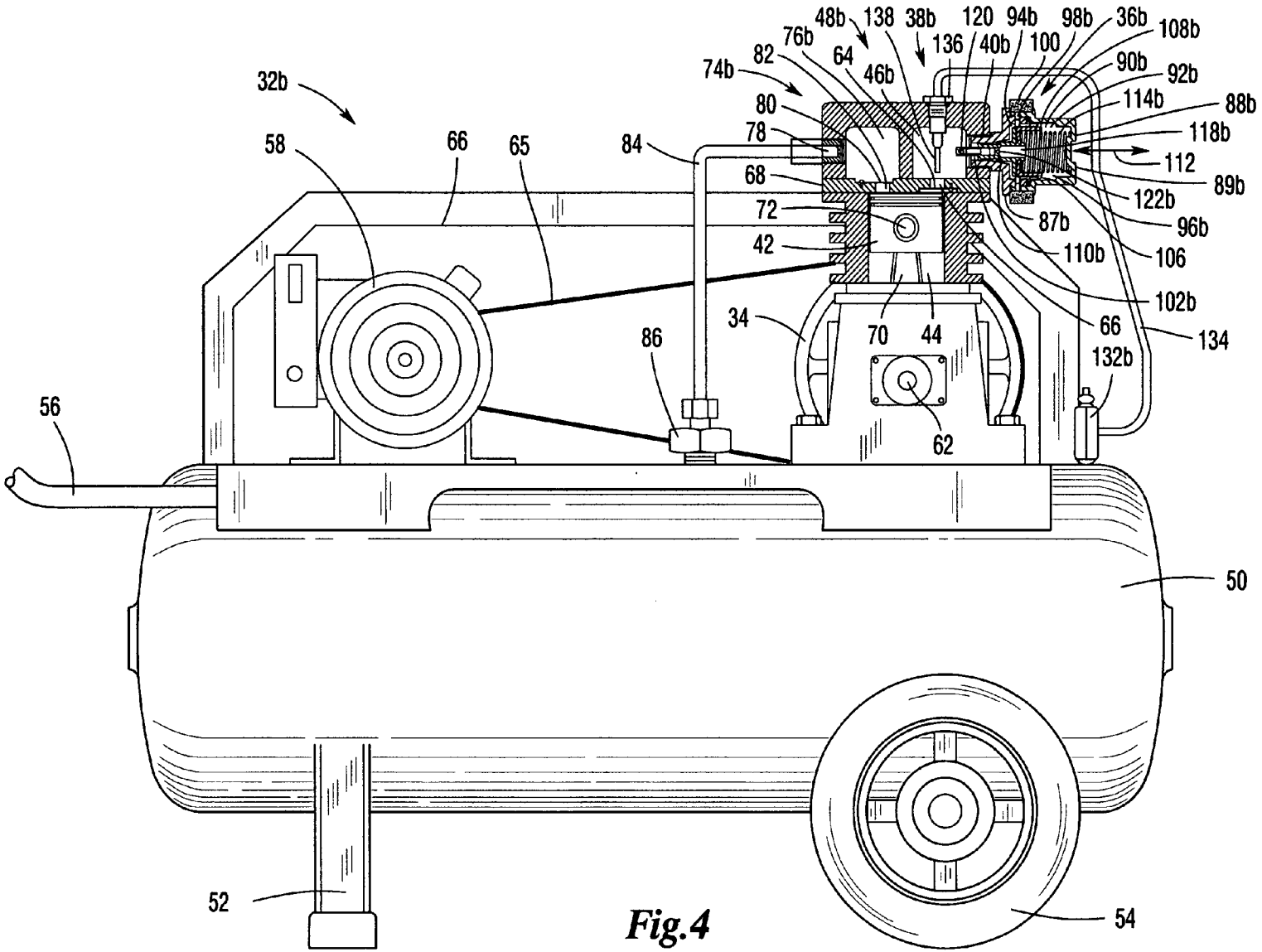
FIG. 4 is a partial cross sectional view of an air compressor unit having an automatic inlet control mechanism according to one embodiment of the invention.

It will be appreciated that the invention can be similarly implemented in continuously operated compressor units. Referring now to FIG. 4, an air compressor unit 32*b* is depicted in which a pilot valve 132*b* takes the place of a pressure switch to enable the electric motor 58 to run continuously without continuously causing the compressor pump 48*b* to add compressed air to the air reservoir 50. The pilot valve 132*b* is positioned on the air reservoir 50 and is configured to be responsive to the magnitude of air pressure that is contained within the air reservoir 50. The pilot valve 132*b* communicates pneumatically through a pilot tube 134 with an inlet unloader 136 that is positioned on the compressor pump 48*b*. The inlet unloader 136 includes an unloader pin 138 that is positioned to extend to and retract from the inlet unloader 136 to interfere with the operation of the cylinder inlet valve 64 and to prevent further reservoir pressurization when the reservoir 50 is fully pressurized to a predetermined maximum magnitude of pressurization.

Consider the air compressor unit 32*b* when, due to usage of air pressure by devices connected to the compressor unit 32*b*, the magnitude of air pressure contained within the air reservoir 50 falls below a predetermined minimum magnitude. The electric motor 58 will be at an idle speed, as explained below. The pilot valve 132*b* senses low pressure within the reservoir 50 and assumes an OFF condition. In response, the pilot valve 132*b* pneumatically communicates the OFF condition to the inlet unloader 136 by removing a pneumatic pressure signal from the pilot tube 134. In turn, the inlet unloader 136 retracts the unloader pin 138 away from the inlet valve 64, allowing the inlet valve 64 to operate to permit air to be drawn from the cylinder inlet chamber 46*b* and through the cylinder inlet hole 66 and into the compression cylinder 44 during each intake stroke of the piston 42, while preventing air from being expelled from the compression cylinder 44 back through the cylinder inlet chamber 46*b* during each compression stroke of the piston 42. The pilot valve 132*b* will continue to prevent the inlet unloader 136 from interfering with the inlet valve 64 as long as air pressure within the reservoir 50 remains below a predetermined maximum magnitude which is larger than the predetermined minimum magnitude.

Since the motor 58 runs continuously, the amount of air that is compressed with each reciprocation of the piston 42 and the amount of torque output required to continue reciprocation of the piston 42 will continue to depend on the amount of air that is permitted by the automatic inlet control mechanism 32*b* to enter the compression cylinder inlet 38*b*. When the pilot valve 132*b* initially removes the pneumatic pressure signal from the pilot tube 134 to cause retraction of the unloader pin 138, the valve piston assembly 96*b* is normally in a position in which the valve stem seal 116 prevents air from moving from the valve inlet chamber 94*b* through the valve outlet 102*b* and into the cylinder inlet chamber 46*b*. Air from the valve control chamber 92*b* becomes the primary source of air to the compression cylinder 44 for an interval of time until which the valve piston assembly 96*b* moves to a position that allows for air to move from the valve inlet chamber 94*b* through the valve outlet 102*b* into the cylinder inlet chamber 46*b*. Since during this interval, the amount of air that can flow from the valve control chamber 92*b* into the compression cylinder inlet 38*b* is restricted by the orifice 122*b*, there is a substantial reduction in the amount of compression loading of the piston 42.

As the piston 42 continues to reciprocate, the valve piston assembly 96*b* gradually moves from an intermediate position that does not permit air to flow between the valve inlet chamber 94*b* and valve outlet 102*b* to an intermediate position that does permit airflow between the valve inlet chamber 94*b* and valve outlet 102*b*, and then continues to move to a fully open position that allows greater air flow to the compression cylinder inlet 38*b*. This has the effect of allowing full compression loading to be reached gradually rather than suddenly. Although the compressor unit 32*b* is a continuous-run system, such smooth operation can nevertheless substantially reduce wear, and can allow for the use of a smaller or less powerful power plant due to the more gradual compression loading. This further allows for reductions in both apparatus cost and energy consumption.

Now consider the same air compressor unit 32*b* when, due to the compression of air by the piston 42, the magnitude of air pressure contained within the reservoir 50 rises above the predetermined minimum magnitude. The pilot valve 132*b* continues to pneumatically communicate the OFF condition to the inlet unloader 136 until the air pressure within the air reservoir 50 rises above the predetermined maximum magnitude. When the air pressure contained within the reservoir 50 rises above the predetermined maximum magnitude, the pilot valve 132*b* senses that the reservoir 50 is fully pressurized and assumes an ON condition. In response, the pilot valve 132*b* pneumatically communicates the ON condition to the inlet unloader 136 by adding a pneumatic pressure signal through the pilot tube 134. In turn, the inlet unloader 136 extends the unloader pin 138 to contact the inlet valve 64 and to prevent the inlet valve 64 from closing during each compression stroke of the piston 42. Although the open inlet valve 64 allows air to be drawn from the valve inlet chamber 94*b* and cylinder inlet chamber 46*b* through the inlet hole 66 into the compression cylinder 44 during each intake stroke of the piston 42, the piston 42 also expels air from the compression cylinder 44 back through the inlet hole 66 into the cylinder inlet chamber 46*b* and valve inlet chamber 94*b*, valve inlet 98*b*, and into the environment during each compression stroke as long as the inlet unloader 136 prevents the cylinder inlet valve 64 from closing.

Since the open inlet valve 64 prevents the piston 42 from removing air pressure from the cylinder inlet chamber 46*b* and valve outlet 102*b*, air is no longer drawn from the valve control chamber 92*b* through the vent passageway 118*b* and orifice 122*b*. Consequently, the spring biasing member 114*b* is free to force the valve piston assembly 96*b* back toward the valve outlet 102*b*. Moreover, since air pressure is restored within the valve outlet 102*b* and compression cylinder inlet 38*b*, air is free to return to the valve control chamber 92*b* as the valve piston 108*b* moves toward the valve inlet chamber 94*b*. This continues until the valve piston assembly 96*b* returns to a position that prevents air from moving from the valve inlet chamber 94*b* to the valve outlet 102*b*. However, the piston 42 continues to be prevented from drawing significant amounts of air from the valve control chamber 92*b* as long as the unloader pin 138 prevents the inlet valve 64 from closing during each compression stroke of piston 42.

The motor 58 then runs continuously at an idle speed, as explained below. However, the compressor pump 48*b* will be prevented from adding air pressure to the reservoir 50, regardless of the amount of electric current drawn by the motor 58 from the electrical circuit, the amount of air that is permitted by the automatic inlet control mechanism 36*b* to enter through the compression cylinder inlet 38*b*, or the amount of torque output that is available from the electric motor 58, until the pilot valve 132*b* again senses that reservoir pressure is below the predetermined minimum magnitude and accordingly removes its pneumatic pressure signal from the pilot tube 134.

Figure 5:
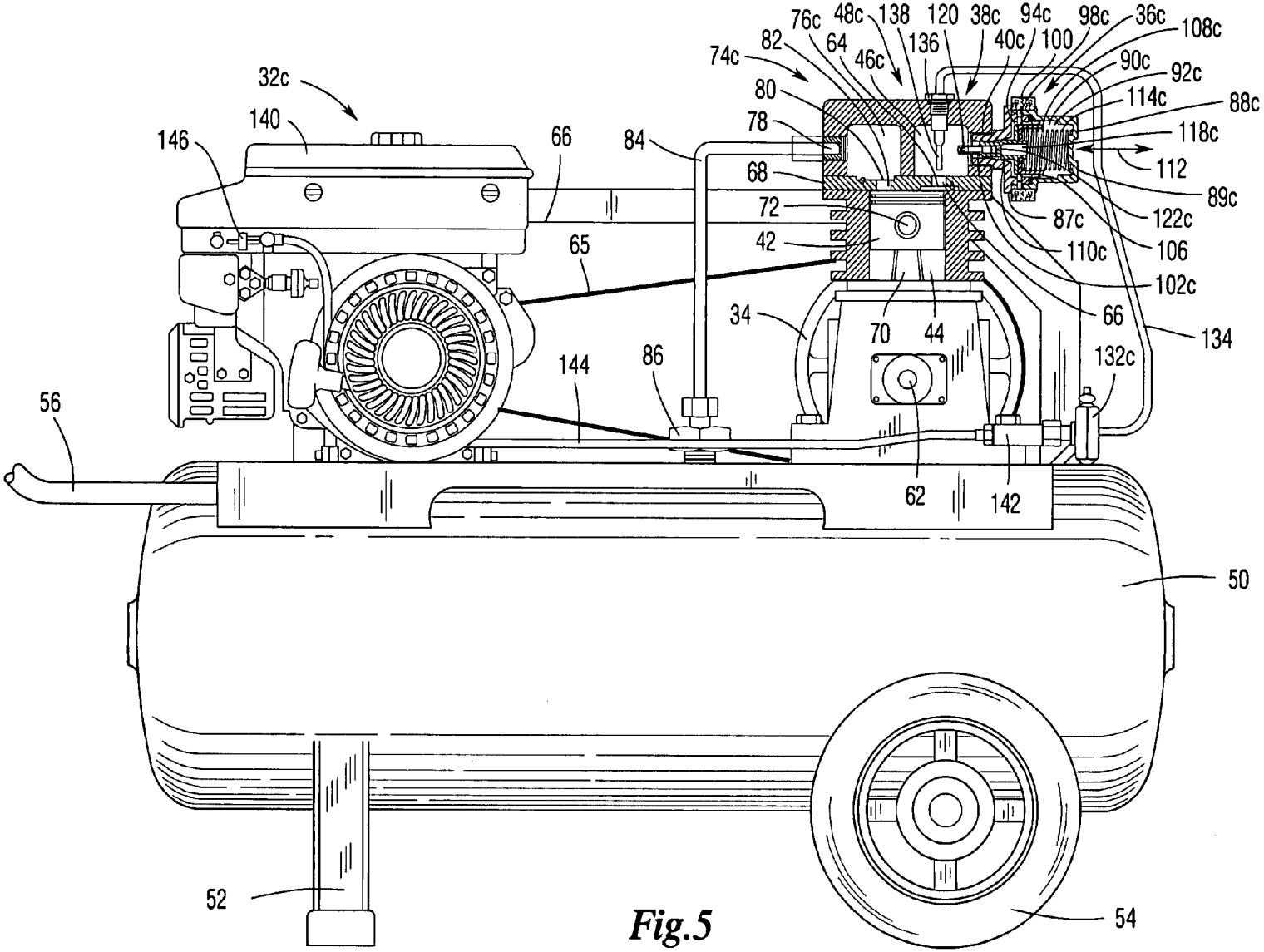
FIG. 5 is a partial cross sectional view of an air compressor unit having an automatic inlet control mechanism according to one embodiment of the invention.

It will be further appreciated that the invention can be implemented into compressor units having different types of power plants. For example, FIG. 5 depicts a continuous drive compressor unit 32*c* having a gasoline engine 140 configured to effect reciprocation of the piston 42 by rotating the pulley 34 and crankshaft 62 with the drive belt 65. Being configured for continuous operation, the compressor unit 32*c* includes a pilot valve 132*c* and pilot tube 134 that control the operation of an inlet unloader 136. The pilot tube 134 is connected to an air cylinder 142 which is itself connected to effect adjustment of the engine throttle control 146 through a conduit 144.

In operation, when air pressure within the reservoir 50 exceeds a predetermined maximum magnitude, the pilot valve 132*c* assumes an ON condition reflecting the fully pressurized condition of the reservoir 50. The pilot valve 132*c* allows a limited amount of the pressure within the reservoir 50 to effect movement of a throttle piston (not shown) located within the air cylinder 142 to an IDLE position. The throttle piston is connected to a wire linkage (not shown) located within the conduit 144. The wire linkage is connected directly to the to throttle control 146 and causes the throttle control to move to an IDLE position when the throttle piston is in the IDLE position.

The pilot valve 132*c* simultaneously communicates an ON condition to the inlet unloader 136 which in turn extends the unloader pin 138 to open the cylinder inlet valve 64 and prevent compression loading of the piston 42. Since compression loading of the piston is therefore at least partially removed, it is only necessary for the engine 140 to exert sufficient torque output to maintain the inertial rotation of the pulley 34, crankshaft 62, and other compressor components. Movement by the wire linkage of the throttle control 146 to the IDLE position lowers the engine speed of the gasoline engine 140 to an idle speed, that is a level that is sufficient to maintain the inertial rotation of compressor components in the absence of compression loading of the piston 42, thereby increasing the overall efficiency of the engine 140.

When air pressure within the reservoir 50 falls below a predetermined minimum magnitude, the pilot valve 132*c* assumes an OFF condition reflecting the low air pressure contained within the reservoir 50. The pilot valve 132*c* removes air pressure from the air cylinder 142 accordingly. Spring returns (not shown) within the air cylinder 142 return the throttle piston to a FULL position, which in turn forces the wire linkage within the conduit 144 to move the throttle control to a FULL position allowing the engine 140 to resume operating speed. The pilot valve 132*c* simultaneously communicates an OFF condition to the inlet unloader 136 which retracts the unloader pin 138 to allow for the continued compression of air by the compressor pump 48*c*.

Figure 6A:
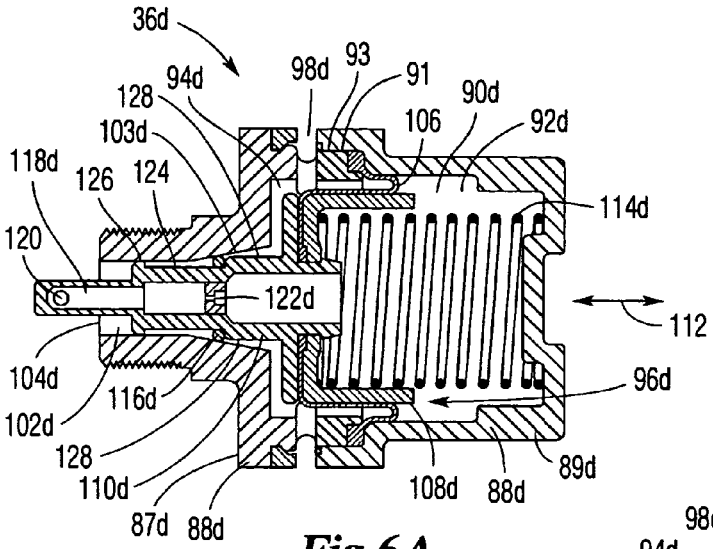
FIG. 6A is a side cross sectional view of the automatic inlet control mechanism according to one embodiment of the invention in a fully closed position.
Figure 6B:
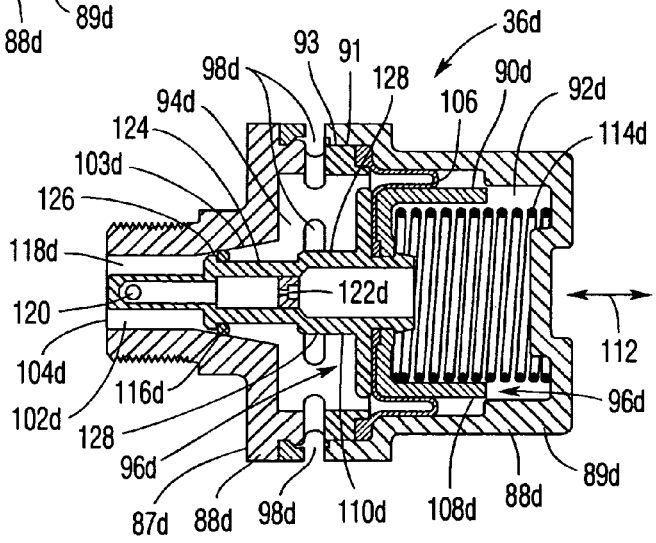
FIG. 6B is a side cross sectional view of the inlet control mechanism of FIG. 6A in an intermediate position.
Figure 6C:
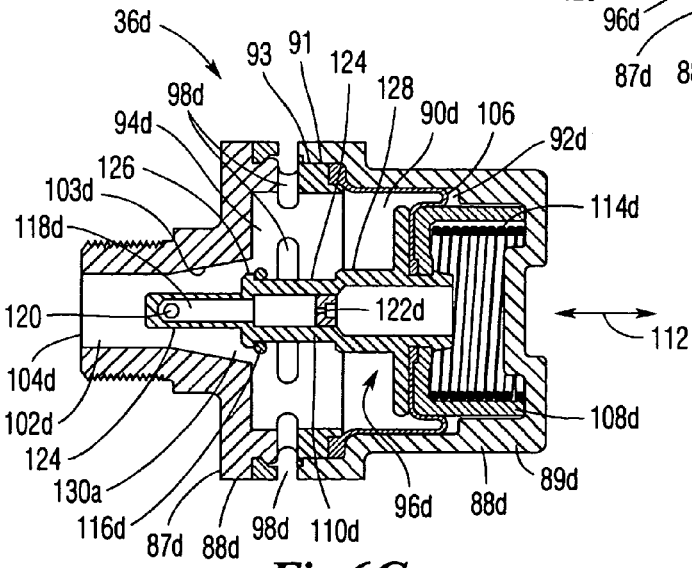
FIG. 6C is a side cross sectional view of the inlet control mechanism of FIG. 6A in an open position.

It will be appreciated that variations in the construction of the automatic inlet control mechanism are possible and within the contemplated scope of the invention. For example, FIGS. 6A–C depict an embodiment inlet control mechanism 36*d* having open valve inlets 98*d*. A filter surrounding the control mechanism 36*d* is omitted to maximize the intake of air into the valve control chamber once the valve piston assembly 96*d* moves from a closed position, as depicted in FIG. 6A, past an intermediate position, as depicted in FIG. 6B, to a position that permits air to flow from the valve inlet chamber 94*d* through the valve outlet 102*d* to the compressor pump, as shown in FIG. 6C.

Figure 7A:
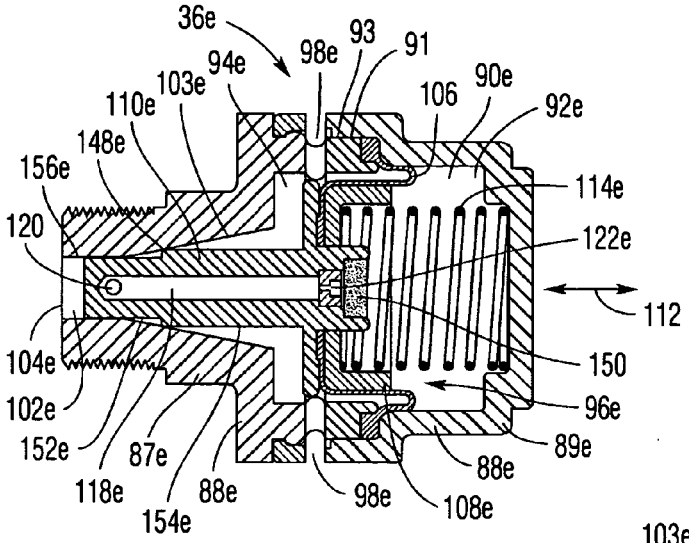
FIG. 7A is a side cross sectional view of an automatic inlet control mechanism according to one embodiment of the invention in a fully closed position.
Figure 7B:
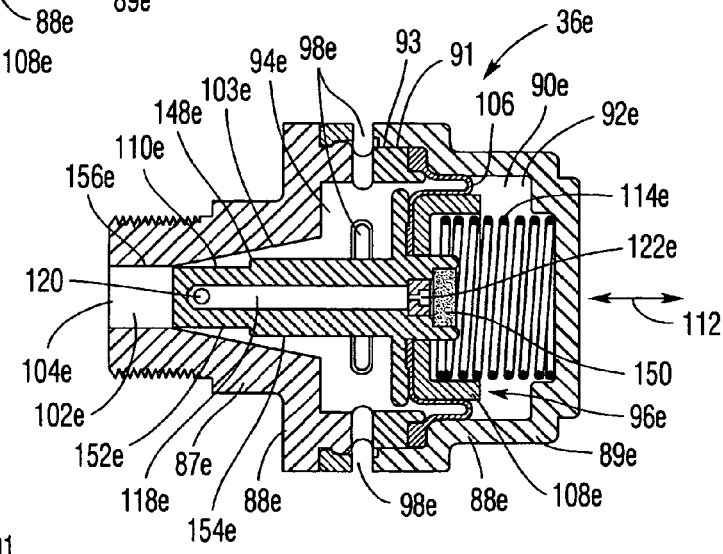
FIG. 7B is a side cross sectional view of the inlet control mechanism of FIG. 7A in an intermediate position.
Figure 7C:
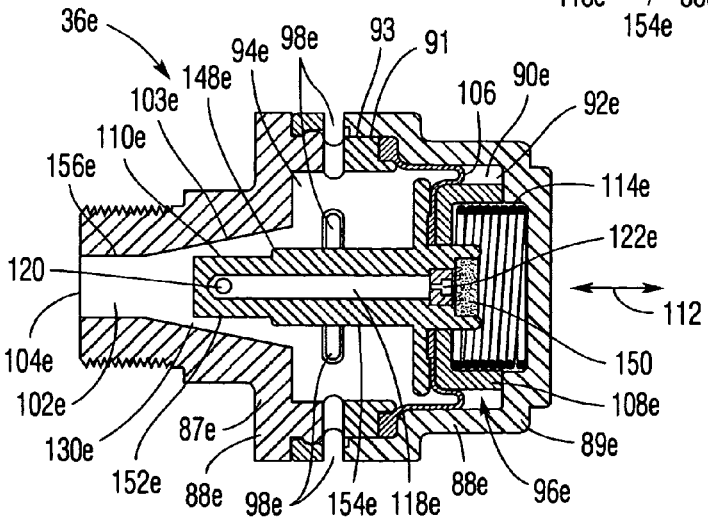
FIG. 7C is a side cross sectional view of the inlet control mechanism of FIG. 7A in an open position.

Other embodiments of the invention having open valve inlets may incorporate filter components at other locations within a mechanism body. For example, FIGS. 7A–C depict an embodiment automatic inlet control mechanism 36*e* having a valve passageway filter 150 located adjacent the orifice 122*e* on the valve stem 110*e*. The valve passageway filter 150 prevents foreign particles from entering the control chamber 92*e*.

To effect sealing between the valve stem 110*e* and mechanism body 88*e*, the valve stem 110*e* is divided into an expanded radius portion 154*e* and a reduced radius portion 152*e*. FIG. 7A, depicts the inlet control mechanism 36*e* in a closed position in which the piston assembly 96*e* prevents air from flowing between the valve inlet chamber 94*e* and valve outlet 102*e*. The piston assembly 96*e* is biased to this position with the spring biasing member 114*e*. When the piston assembly 96*e* is this position, the reduced radius portion 152*e* inserts into a non-tapered portion 156*e* of the valve outlet 102*e*. An edge 148*e* of the expanded radius portion 154*e* of the valve stem 110*e* contacts the tapered portion 103*e* of the valve outlet 102*e*. In this position, the clearance between the reduced radius portion 152*e* of the valve stem 110*e* and non-tapered portion 156*e* of the valve outlet 102*e* is sufficiently small to prevent air from flowing between the valve inlet chamber 94*e* and valve outlet 102*e*. The contact between the edge 148*e* of the expanded radius portion 154*e* and the tapered portion of the valve outlet 102*e* acts to further block the flow of air.

In operation, the piston 42 draws air from the control chamber 92*e* through the vent passageway 118*e* while creating a pressure differential between the vent inlet chamber 94*e* and valve outlet 102*e*, separated by the close proximity of the reduced radius portion 152*e* of the valve stem 110*e* to the non-tapered portion 156*e* of the valve outlet 102*e*. As air continues to be drawn from the valve control chamber 92*e*, atmospheric pressure in the valve inlet chamber 94*e* causes the piston assembly 96*e* to move against the force of the spring biasing member 114*e* and toward the valve control chamber 92*e*, though the reduced radius portion 152*e* of the valve stem 110*e* continues to be in close proximity to the non-tapered portion 156*e* of the valve outlet 102*e*. FIG. 7B depicts the piston assembly 96*e* that has moved to an intermediate position in which the reduced radius portion 152*e* of the valve stem 110*e* remains in close proximity to the non-tapered portion 156*e* of the valve outlet 102*e*. As the valve stem 110*e* moves, as long as the reduced radius portion 152*e* remains in close proximity to the non-tapered portion 156*e* of the valve outlet 102*e*, air continues to be blocked from entering the compression cylinder inlet from the valve inlet chamber 94*e*.

FIG. 7C depicts the piston assembly 96*e* after the force of the pressure differential between the valve inlet chamber 94*e* and valve control chamber 92*e* sufficiently overcomes the bias of the spring biasing member 114*e* to move the piston assembly 96*e* to an open position in which the reduced radius portion 152*e* of the valve stem 110*e* clears the non-tapered portion 156*e* of the valve outlet 102*e*. This creates an air space 130*e* through which air can move from the environment surrounding the inlet control mechanism 36*e* and from the valve inlet chamber 94*e* to the valve outlet 102*e*. The amount of time required for the piston assembly 96*e* to move to a position that allows air to move from the valve inlet chamber 94*e* to the valve outlet 102*e* depends on the rate at which air can be drawn though the vent passageway 118*e* from the valve control chamber 92*e* as permitted by the vent restriction that is created by the orifice 122*e*. It follows that the amount of time in which the control mechanism 36*e* removes piston compression loading depends on the amount of time that the reduced radius portion 152*e* of the valve stem 110*e* remains in close proximity to the non-tapered portion 156*e* of the valve outlet 102*e*, as permitted by the vent restriction created by the orifice 122*e*.

Figure 8A:
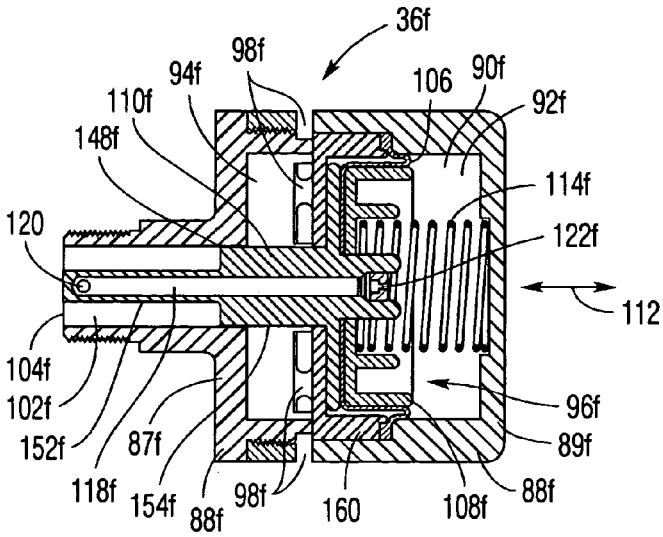
FIG. 8A is a side cross sectional view of an automatic inlet control mechanism according to one embodiment of the invention in a fully closed position.

FIG. 8A depicts an automatic inlet control mechanism 36*f* in which the valve outlet 102*f* does not include a tapered portion. The valve stem 110*f* includes an expanded radius portion 154*f* and a reduced radius portion 152*f*, the expanded radius portion 154*f* being dimensioned to allow for insertion into the valve outlet 102*f* without a substantial amount of clearance.

FIG. 8A depicts the inlet control mechanism 36*f* in a closed position in which the piston assembly 96*f*, due to its insertion into the valve outlet 102*f*, prevents air from flowing between the valve inlet chamber 94*f* and valve outlet 102*f*. The piston assembly 96*f* is biased to this position with the spring biasing member 114*f*. In this position, the clearance between the expanded radius portion 154*f* of the valve stem 110*f* and the valve outlet 102*f* is sufficiently small to prevent air from flowing between the valve inlet chamber 94*f* and valve outlet 102*f*. Guides 160 restrict lateral movement of the valve stem 110*f* and center the valve stem 110*f* as it reciprocates along the valve axis 112.

In operation, the piston 42 draws air from the control chamber 92*f* through the vent passageway 118*f* while creating a pressure differential between the vent inlet chamber 94*f* and valve outlet 102*f*, separated by the close proximity of the expanded radius portion 154*f* of the valve stem 110*f* to the valve outlet 102*f*. As air continues to be drawn from the valve control chamber 92*f*, atmospheric pressure in the valve inlet chamber 94*f* causes the piston assembly 96*f* to move against the bias of the spring biasing member 114*e* and toward the valve control chamber 92*f*, though the expanded radius portion 154*f* of the valve stem 110*f* continues to be in close proximity to the valve outlet 102*f*.

Figure 8B:
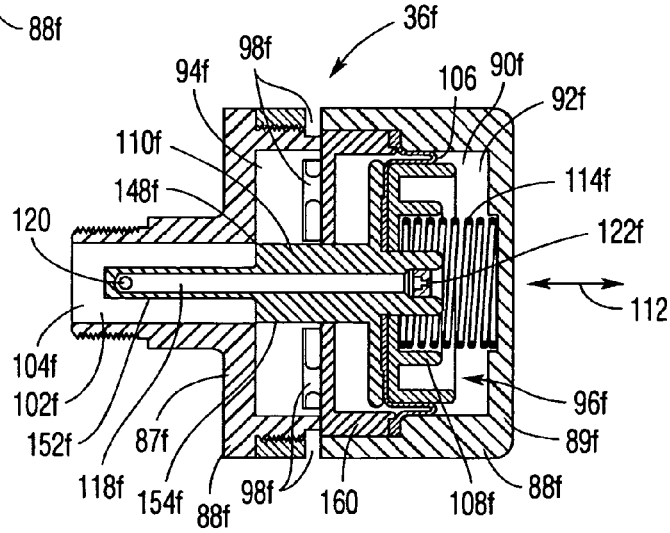
FIG. 8B is a side cross sectional view of the inlet control mechanism of FIG. 8A in an intermediate position.

FIG. 8B depicts the piston assembly 96*f* that has moved to an intermediate position in which the expanded radius portion 154*f* of the valve stem 110*f* remains in close proximity to the valve outlet 102*f*. As the valve stem 110*f* moves, it continues to block air from entering the compression cylinder inlet from the valve inlet chamber 94*f* as long as the expanded radius portion 154*f* remains in close proximity to the valve outlet 102*f*.

Figure 8C:
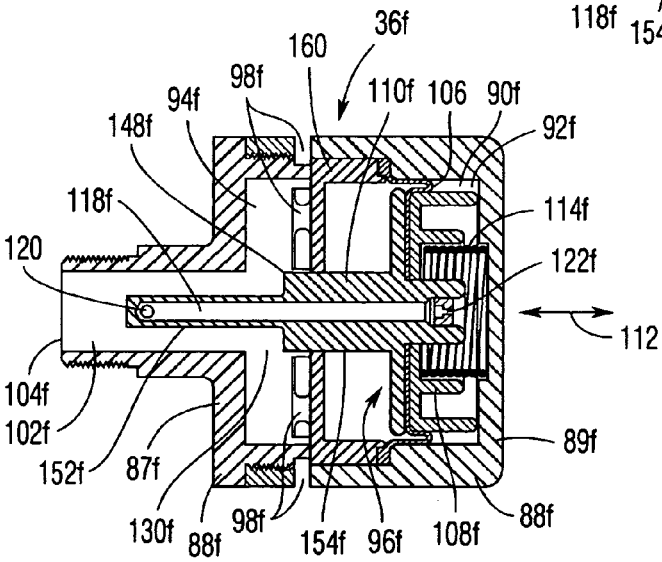
FIG. 8C is a side cross sectional view of the inlet control mechanism of FIG. 8A in an open position.

FIG. 8C depicts the piston assembly 96*f* after the force of the pressure differential between the valve inlet chamber 94*f* and valve control chamber 92*f* sufficiently overcomes the bias of the spring biasing member 114*f* to move the piston assembly 96*f* to an open position in which the expanded radius portion 154*f* of the valve stem 110*f* has cleared the valve outlet 102*f*. This creates an air space 130*f* through which air can move from the environment surrounding the inlet control mechanism 36*f* through the valve inlet chamber 94*f* to the valve outlet 102*f*. The amount of time required for the piston assembly 96*f* to move to a position that allows air to move from the valve inlet chamber 94*f* to the valve outlet 102*f* depends on the rate at which air can be drawn though the vent passageway 118*f* from the valve control chamber 92*f* as permitted by the vent restriction created by the orifice 122*f*. It follows that the amount of time in which the control mechanism 36*f* removes piston compression loading depends on the amount of time that the expanded radius portion 154*f* of the valve stem 110*f* remains in close proximity to the valve outlet 102*f*, as permitted by the vent restriction created by the orifice 122*f*.

Figure 9A:
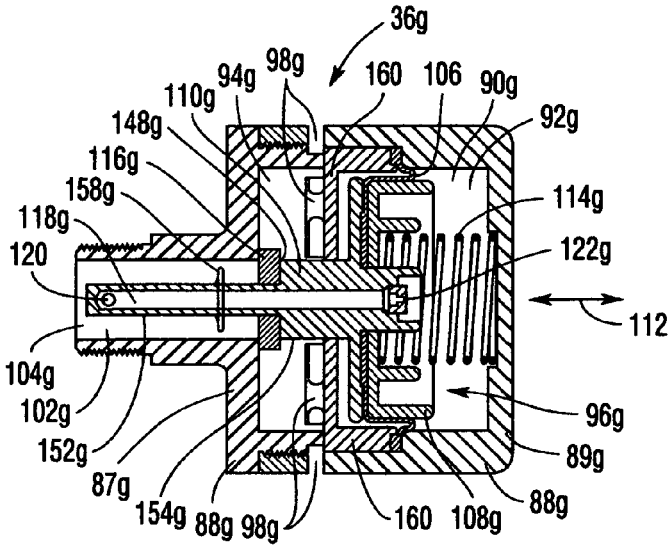
FIG. 9A is a side cross sectional view of an automatic inlet control mechanism according to one embodiment of the invention in a fully closed position.
Figure 9B:
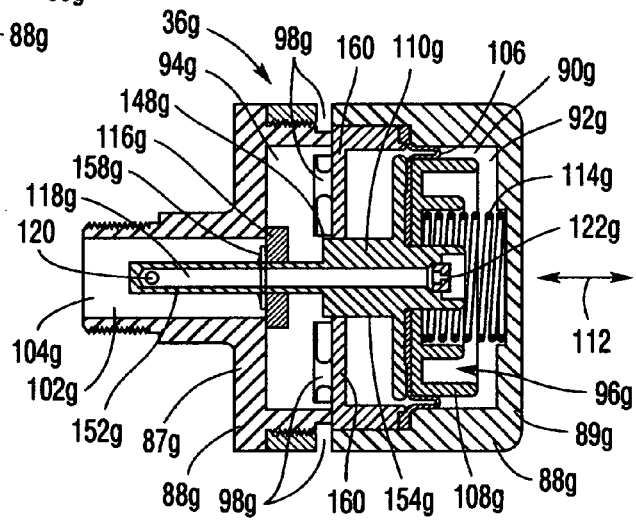
FIG. 9B is a side cross sectional view of the inlet control mechanism of FIG. 9A in an intermediate position.
Figure 9C:
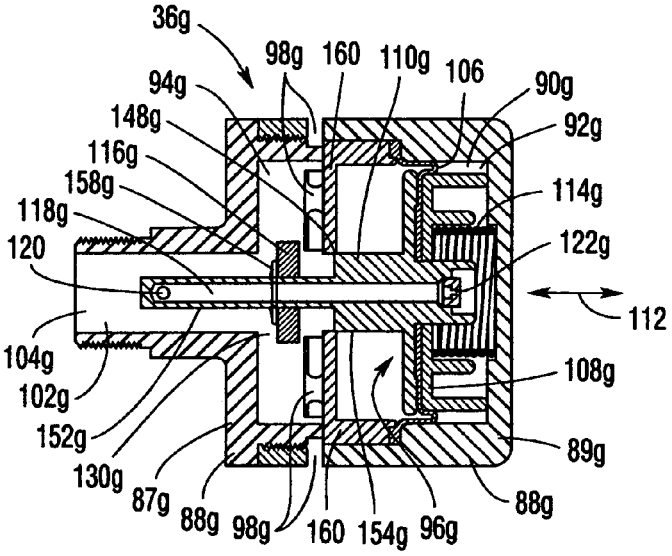
FIG. 9C is a side cross sectional view of the inlet control mechanism of FIG. 9A in an open position.

Some embodiments having non-tapered valve outlets also allow for the use of sliding valve stem seals to restrict air flow. FIGS. 9A–C depict an inlet control mechanism 36*g* having a valve stem seal 116*g* positioned to reciprocate along a reduced radius portion 152*g* of a valve stem 110*g*. Lost sliding motion of the valve stem seal 116*g* is restricted with a stem clip 158*g* that is positioned along the length of the reduced radius portion 152*g* and the edge 148*g* of an expanded radius portion 154*g* of the valve stem 110*g*. Guides 160 restrict lateral movement of the valve stem 110*g* and center the valve stem 110*g* as it reciprocates along the valve axis 112.

FIG. 9A depicts the control mechanism 36*g* in a closed position in which the spring biasing member 114*g* biases the piston assembly 96*g* away from the valve control chamber 92*g*. The edge 148*g* of the expanded radius portion 154*g* contacts the valve stem seal 116*g* which seals against the mechanism body 88*g*. This prevents air from moving from the valve inlet chamber 94*g* to the valve outlet 102*g* and creates a pressure differential as air is drawn through the valve outlet hole 104*g*.

As air is drawn through the vent passageway 118*g*, the piston assembly 96*g*, including the valve stem 110*g*, moves against the force of the spring biasing member 114*g* toward the valve control chamber 92*g*. However, the pressure differential between the valve inlet chamber 94*g* and valve outlet 102*g* continues to force the sliding seal 116*g* against the mechanism body 88*g*, the reduced radius portion 152*g* of the valve stem 110*g* sliding through the valve stem seal 116*g*. This continues until the piston assembly 96*g* moves to an intermediate position in which the stem clip 158*g* contacts the valve stem seal 116*g*. This intermediate position is depicted in FIG. 9B.

The time required for the piston assembly 96*g* to move to the intermediate position depicted in FIG. 9B depends on the rate at which air can be drawn from the valve control chamber 92*g* as permitted by the vent restriction created by the orifice 122*g*. If, from the intermediate position depicted in FIG. 9B, the piston assembly 96*g* continues to move toward the valve control chamber 92*g*, the stem clip 158*g* pulls the valve stem seal 116*g* away from the mechanism body 88*g*. This causes the inlet control mechanism 36*g* to assume an open condition as depicted in FIG. 9C, creating an air space 130*g* that allows air to flow between the valve inlet chamber 94*g* and valve outlet 102*g*. Thus, the time required for the piston assembly 96*g* to move past the intermediate position depicted in FIG. 9B determines the preselected amount of time during which air from the environment is prevented from flowing from the valve inlet chamber 94*g* to the compression cylinder inlet.

Figure 10A:
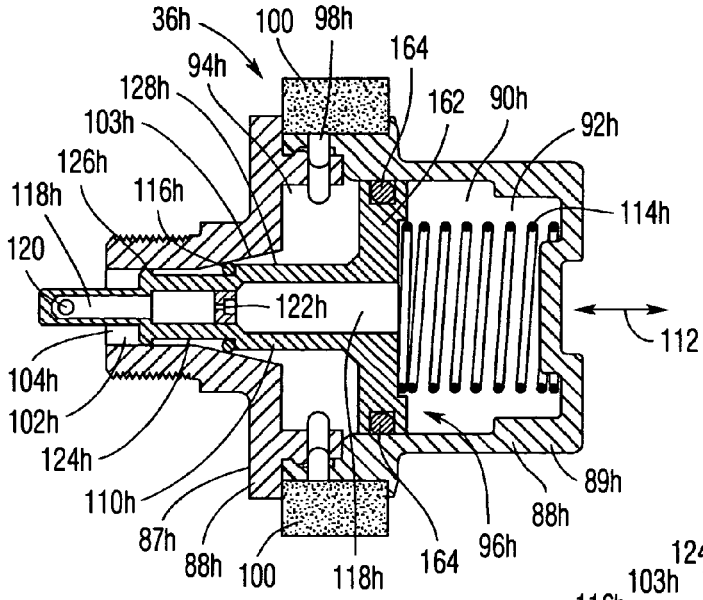
FIG. 10A is a side cross sectional view of an automatic inlet control mechanism according to one embodiment of the invention in a fully closed position.
Figure 10B:
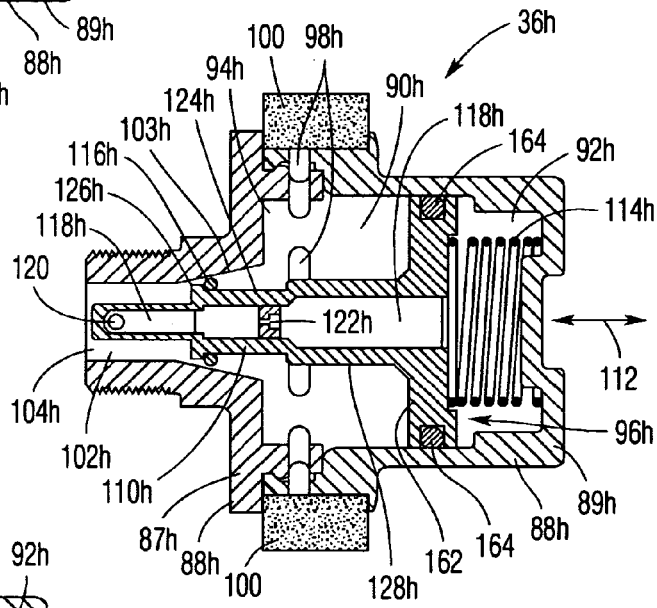
FIG. 10B is a side cross sectional view of the inlet control mechanism of FIG. 10A in an intermediate position.
Figure 10C:
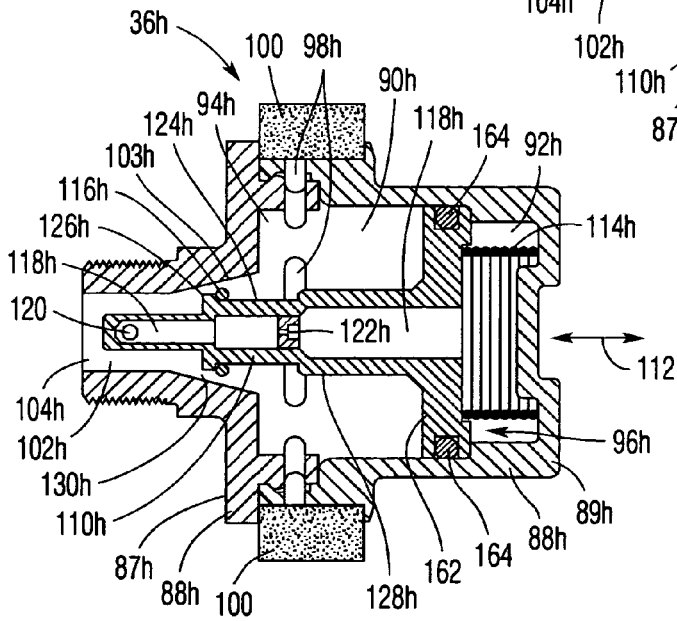
FIG. 10C is a side cross sectional view of the inlet control mechanism of FIG. 10A in an open position.

It will be further appreciated that the automatic inlet control mechanism can be constructed to operate without the use of a diaphragm. FIGS. 1A–C depict an inlet control mechanism 36*h* having a valve piston 162 that is integrated into the structure of the valve stem 110*h*. The valve piston 162 has a diameter that is sufficient to extend fully across the valve cavity 90*h* as the valve piston assembly 96*h* reciprocates along the valve axis 112. As it reciprocates with the valve piston assembly 96*h*, the valve piston 162 seals against the inside surface of the mechanism body 88*h* with a piston seal 164, preventing air from flowing directly between the valve control chamber 92*h* and valve inlet chamber 94*h*. The piston seal 164 can be constructed of rubber, teflon, a resilient polymer, or any other material that allows for sliding or reciprocation of the valve piston 162 against the inside surface of the mechanism body 88*h*, eliminating the need for a diaphragm positioned between the valve stem 110*h* and valve piston 162. In operation, the valve stem seal 116*h* prevents air from flowing between the valve inlet chamber 94*b* to the valve outlet 102*h* until the valve piston assembly 96*h* moves to an intermediate position as shown in FIG. 10B. As air is withdrawn from the valve control chamber 92*h* through the vent passageway 118*h* and orifice 122*h*, atmospheric pressure in the valve inlet chamber 94*h* forces the piston assembly 96*h* toward the valve control chamber 92*h*. Once the piston assembly moves past the intermediate position to an open position, such as that shown in FIG. 10C, the sliding seal 116*h* clears the tapered portion 103*h* to create an air space 130*h*, allowing air to flow from the valve inlet chamber 94*h* to the valve outlet 102*h*.

Figure 11A:
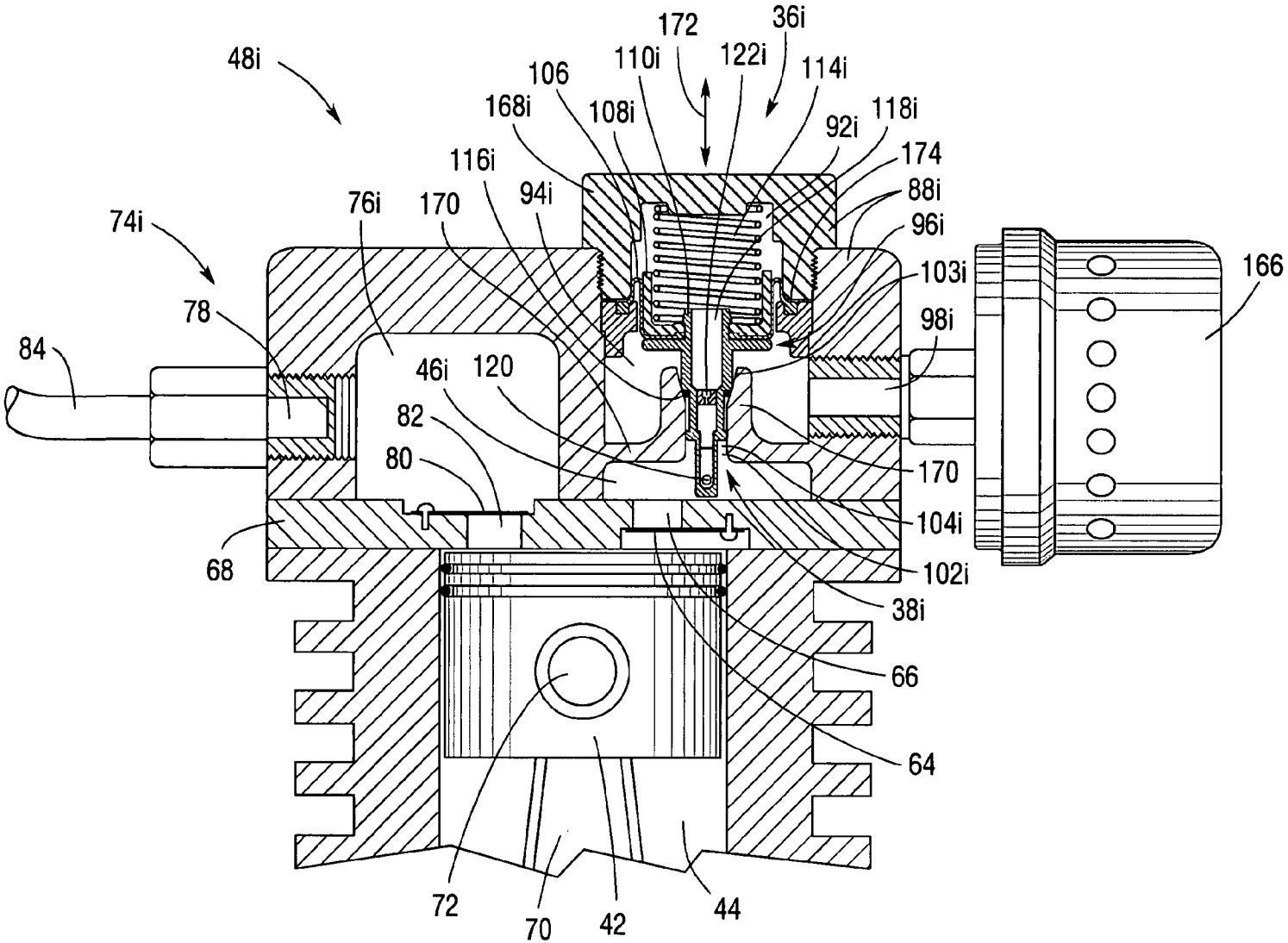
FIG. 11A is a cross sectional view of an automatic inlet control mechanism according to one embodiment of the invention in a closed position.

Although the invention has been shown and described as having an automatic inlet control mechanism where the mechanism body is external to the compressor pump, it will be appreciated that in some embodiments, the inlet control mechanism can be integrated directly into the structure of the compressor pump. For example, FIG. 11A depicts a compressor pump 48*i* having an automatic inlet control mechanism 36*i* that includes a mechanism body 88*i* integrated into the structure of the compressor pump 48*i*. The mechanism body 88*i* includes a removable portion 168*i* that is threaded and sealed with an enclosure seal 174 to allow for installation of components of the inlet control mechanism 36*i* in the compressor pump 48*i*. An external filter 166 is attached to a valve inlet 98*i* leading to a valve inlet chamber 94*i* located below a valve control chamber 92*i*. A valve outlet partition 170 includes a valve outlet 102*i* having a tapered portion 103*i* and valve outlet hole 104*i*. The valve piston assembly 96*i* includes a piston 108*i*, valve stem 110*i*, and vent passageway 118*i* configured to reciprocate vertically along a vertical valve axis 172. When assuming a fully closed position, as shown in FIG. 11A, the valve stem 110*i* extends fully through the valve outlet hole 104*i* so that the stem hole 120 extends through the compression cylinder inlet 38*i* and enters the compression cylinder inlet chamber 46*i*. The valve stem seal 116*i* prevents air from the atmosphere from flowing between the valve inlet chamber 94*i* through the valve outlet hole 104*i* to the valve outlet 102*i*.

Figure 11B:
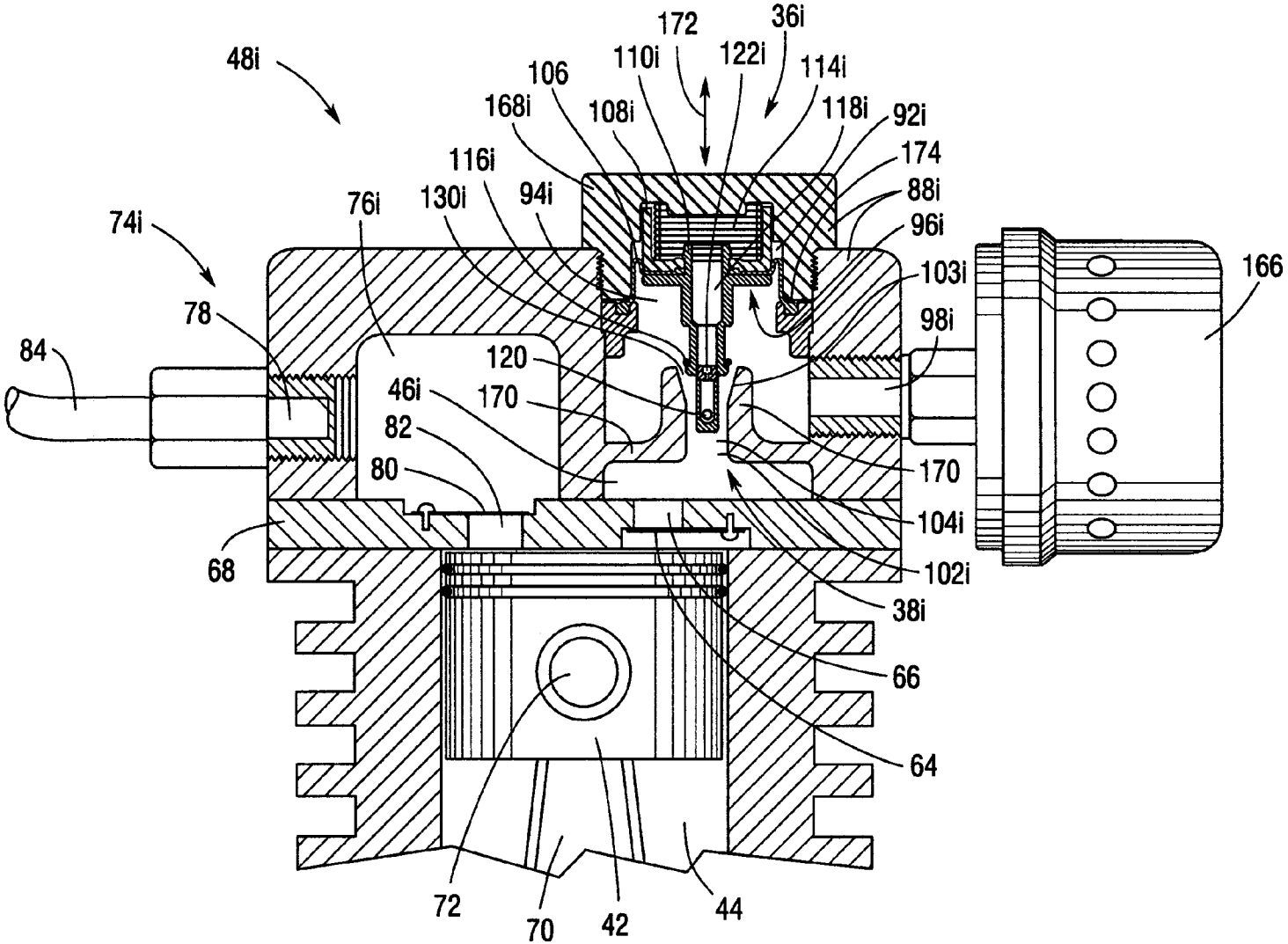
FIG. 11B is a cross sectional view of the inlet control mechanism of FIG. 11A in an open position.

When air is drawn by the piston 42 from the control chamber 92*i* through the valve passageway 118*i* and cylinder inlet chamber 46*i*, the valve piston assembly 96*i* moves upward along the vertical valve axis 172 as depicted in FIG. 11B. This upward movement creates an air space 130*i* between the valve stem seal 116*i* and tapered portion 103*i* allowing air to enter the compression cylinder inlet 38*i* from the valve inlet chamber 94*i*.

Figure 12A:
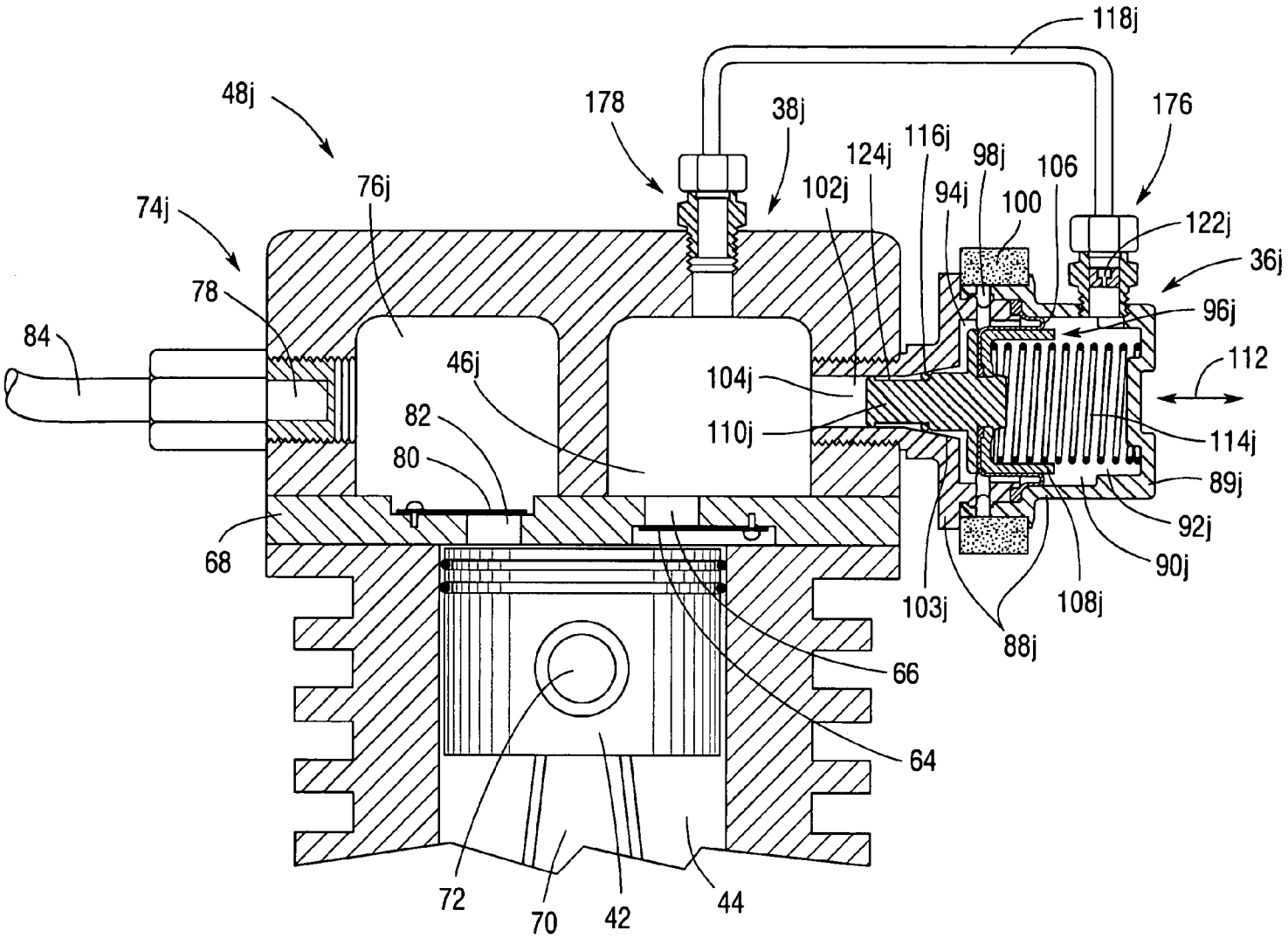
FIG. 12A is a cross sectional view of an automatic inlet control mechanism according to one embodiment of the invention in a closed position.

While the invention has been shown in various embodiments having vent passageways that extend though valve stems, it will be appreciated that appropriate vent passageways can be configured in alternate positions as well. FIG. 12A depicts an embodiment compressor pump 48*j* having an externally positioned inlet control mechanism 36*j*. A vent passageway 118*j* extends outside of the inlet control mechanism 36*j* and compressor pump 48*j* and is connected to the valve control chamber 92*j* with a control chamber coupling 176 and connected to the cylinder inlet chamber 46*j* with an inlet chamber coupling 178. A vent orifice 122*j* is positioned in the vent passageway 118*j* near the control chamber coupling 176 to restrict the flow of air from the valve control chamber 92*j* into the cylinder inlet chamber 46*j*. The valve stem 110*j* is solid along its length, preventing air from moving directly between the valve control chamber 92*j* and valve outlet 102*j*.

Figure 12B:
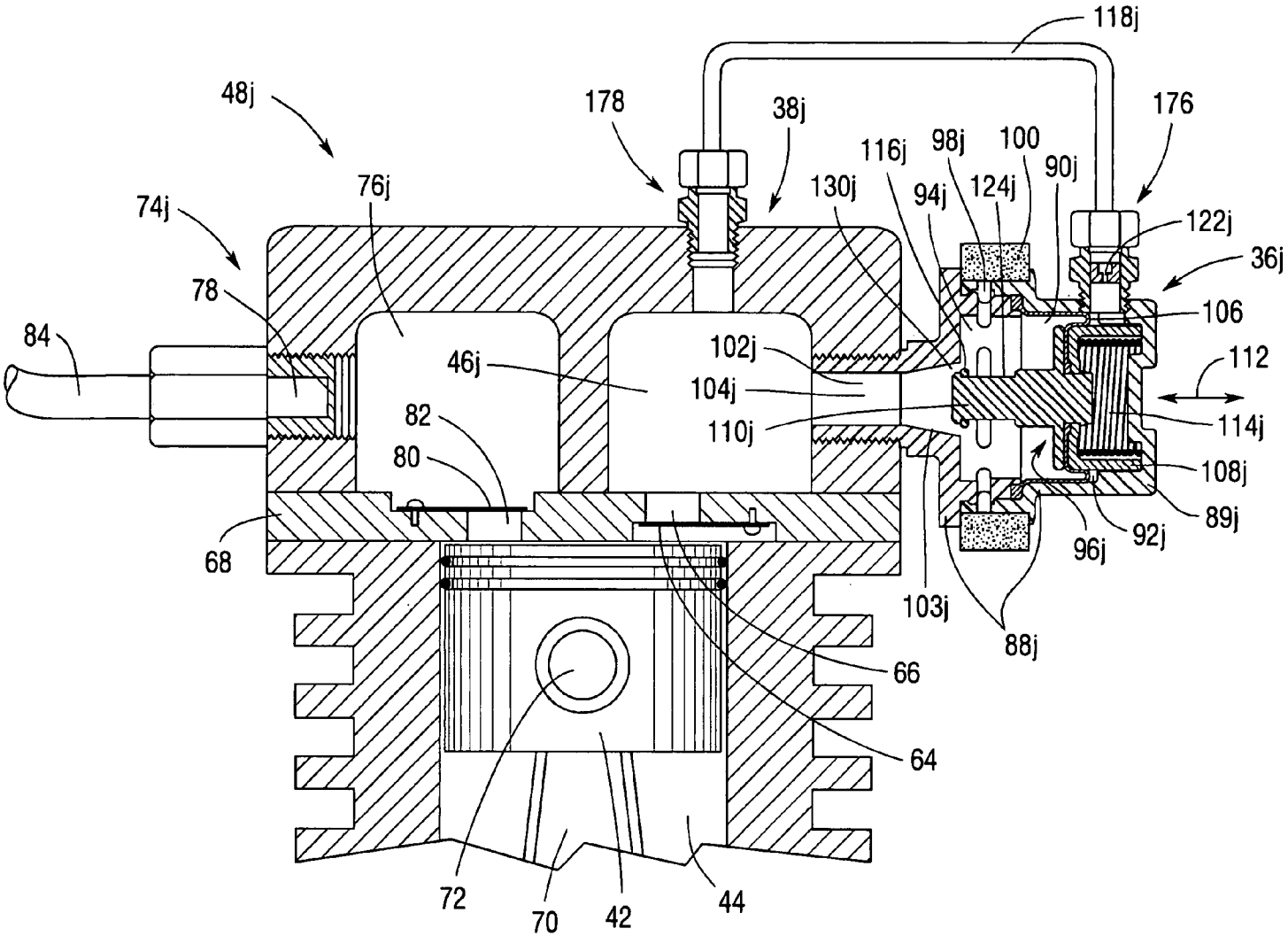
FIG. 12B is a cross sectional view of the inlet control mechanism of FIG. 12A in an open position.

When the piston 42 reciprocates within the compression cylinder 44 while the valve piston assembly 96*j* is in the position shown in FIG. 12A, air is drawn through the externally mounted vent passageway 118*j* from the valve control chamber 92*j* which becomes the primary source of air to the compression cylinder 44 and which loses air pressure as air is progressively drawn by the piston 42. The rate at which air is drawn through the vent passageway 118*j* depends on the size of the orifice 122*j*. The valve control chamber 92*j* continues to be the primary source of air to the compression cylinder 44 until atmospheric pressure within the valve inlet chamber 94*j* forces the valve piston assembly 96*j* to the open position shown in FIG. 12B, creating an air space 130*j* through which air can enter the compression cylinder 44 from the environment.

Figure 13A:
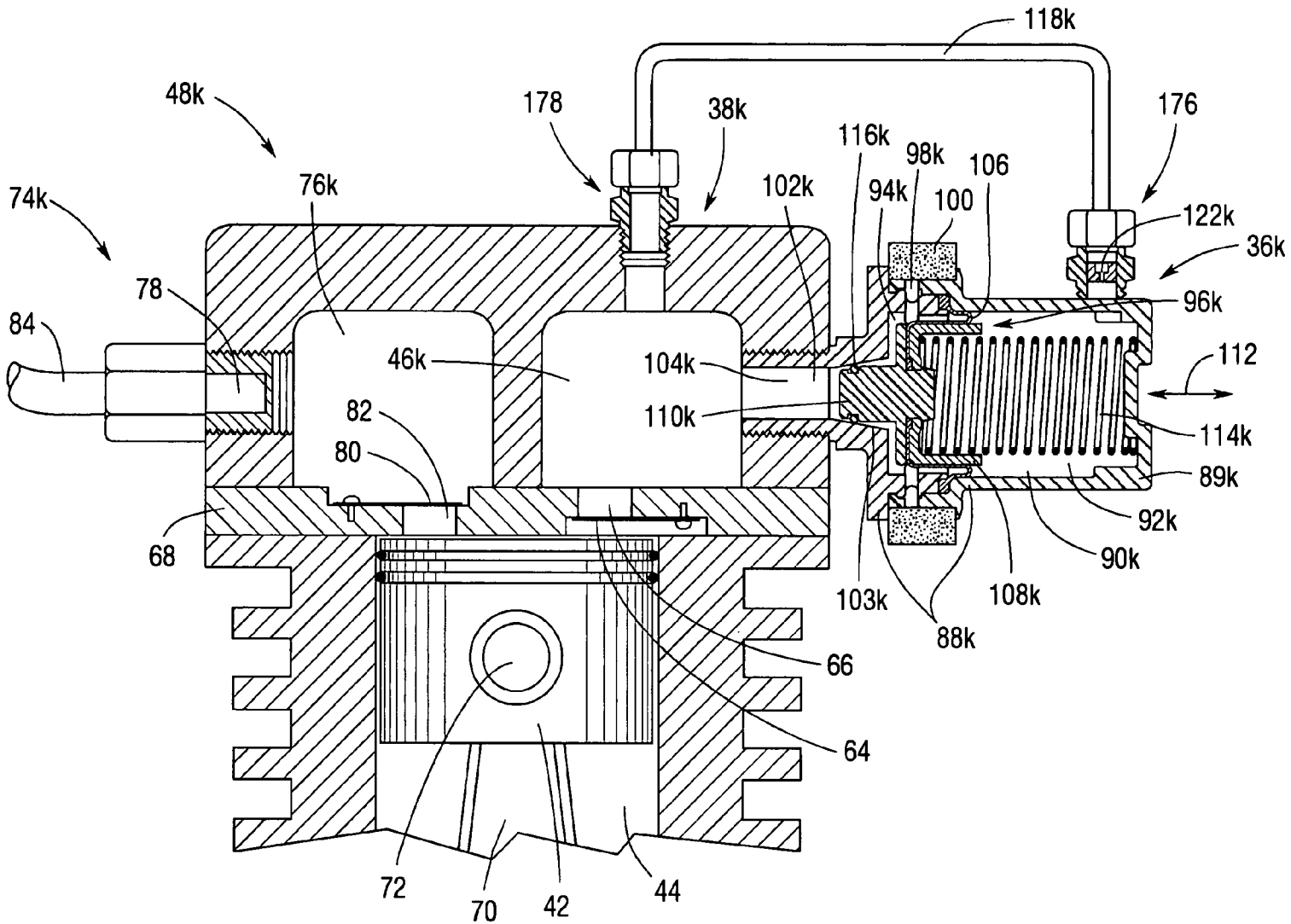
FIG. 13A is a cross sectional view of an automatic inlet control mechanism according to one embodiment of the invention in a closed position.

It will be further appreciated that in some embodiments, the period of time required for a valve piston assembly to move from a fully closed to a fully open position can also be controlled by changing the relative size of the inlet control mechanism and/or valve control chamber. For example, FIG. 13A depicts an embodiment compressor pump 48*k* having an enlarged control segment 89*k* of the mechanism body 88*k* that effectively increases the size of the valve control chamber 92*k*. In operation, the increased size of the valve control chamber 92*k* increases the amount of time that is required for the piston 42 to draw a sufficient amount of air through the vent passageway 118*k*, to produce a pressure differential between the valve inlet chamber 94*k* and valve control chamber 92*k* sufficient to overcome the force of the biasing spring 114*k* to effect movement of the valve piston assembly 96*k*. Thus, the increased size of the valve control chamber 92*k* allows the vent passageway 118*k* to continue to comprise the primary source of air to the compression cylinder inlet 38*k* for a period of time after the piston 42 begins to draw air into the compression cylinder 44 without requiring lost mechanical motion by the valve stem seal 116*k* or other components of the inlet control mechanism 36*k*.

Figure 13B:
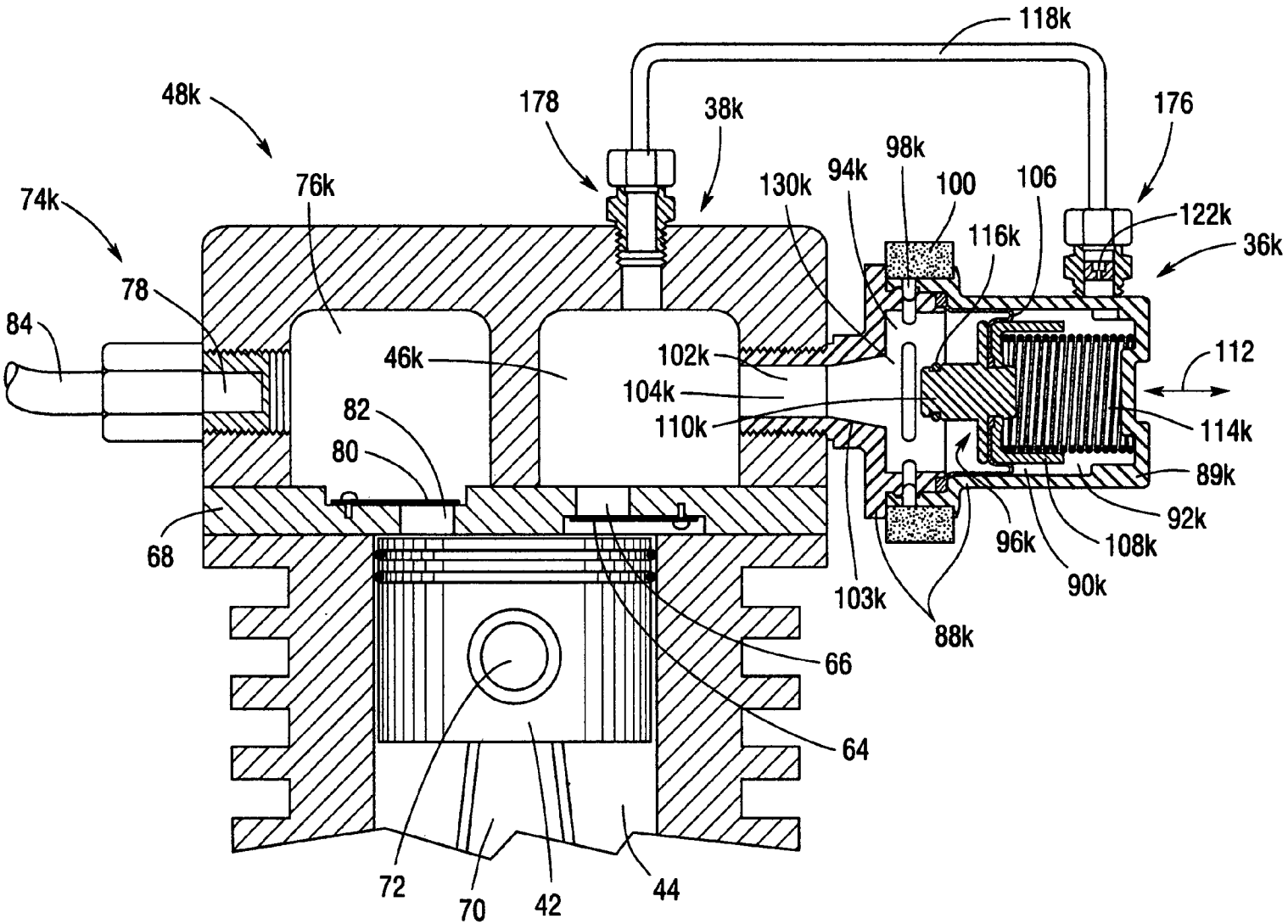
FIG. 13B is a cross sectional view of the inlet control mechanism of FIG. 13A in an open position.

Referring now to FIG. 13B, the piston assembly 96*k* moves to an open position once a sufficient amount of air has been drawn through the orifice 122*k* and vent passageway 118*k* to create a pressure differential between the valve inlet chamber 94*k* and valve control chamber 92*k* sufficient to overcome the force of the biasing spring 114*k*, creating an air space 130*k* that allows air to flow from the valve inlet chamber 94*k* to the valve outlet 102*k*. However, it will be appreciated that, depending on the requirements of a given specific embodiment, it may be necessary to construct the inlet control mechanism 36*k* to have a valve control chamber 92*k* that is significantly larger than corresponding control mechanisms incorporating lost mechanical motion of internal components to achieve a comparable period of delay before opening. It will be further appreciated that in some embodiments, a comparable period of delay can be achieved by adjusting the size of an orifice in a vent passageway to affect the rate at which air can be drawn from the valve control chamber. In addition, it is possible to control the period of delay by combining changes in both the orifice and control chamber sizes.

Figure 14A:
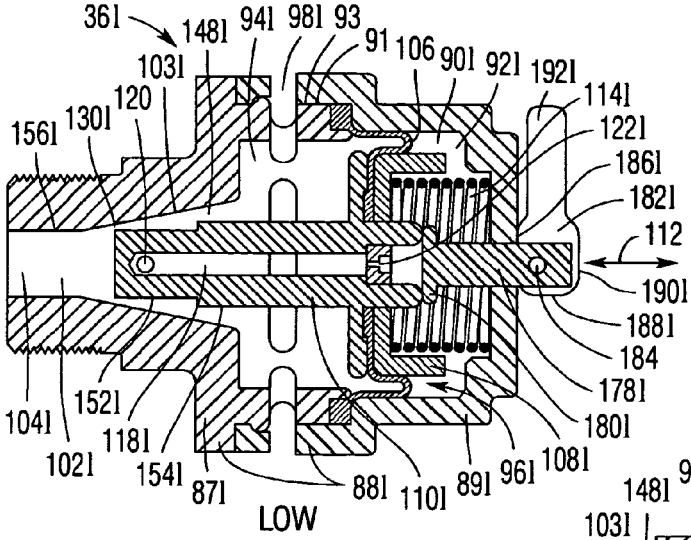
FIG. 14A is a side cross sectional view of an automatic inlet control mechanism according to one embodiment of the invention at a LOW setting.
Figure 14C:
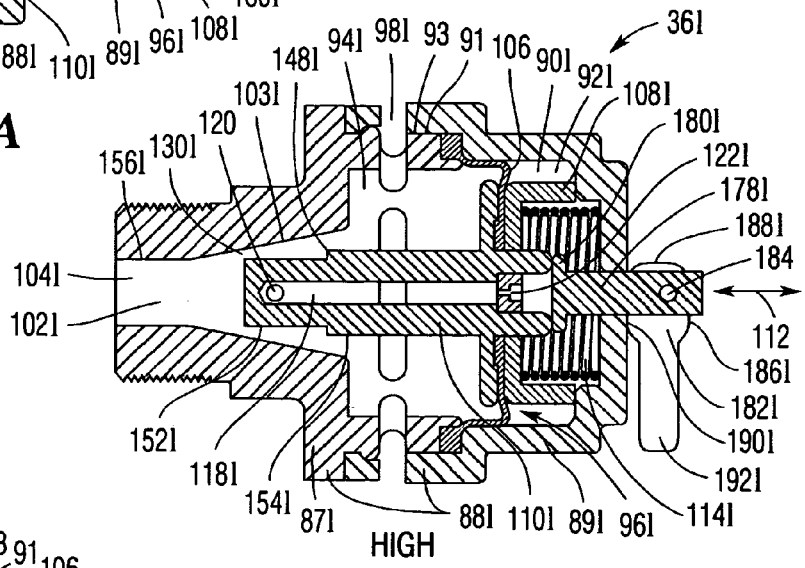
FIG. 14C is a side cross sectional view of the inlet control mechanism of FIG. 14A at a HIGH setting.
Figure 14B:
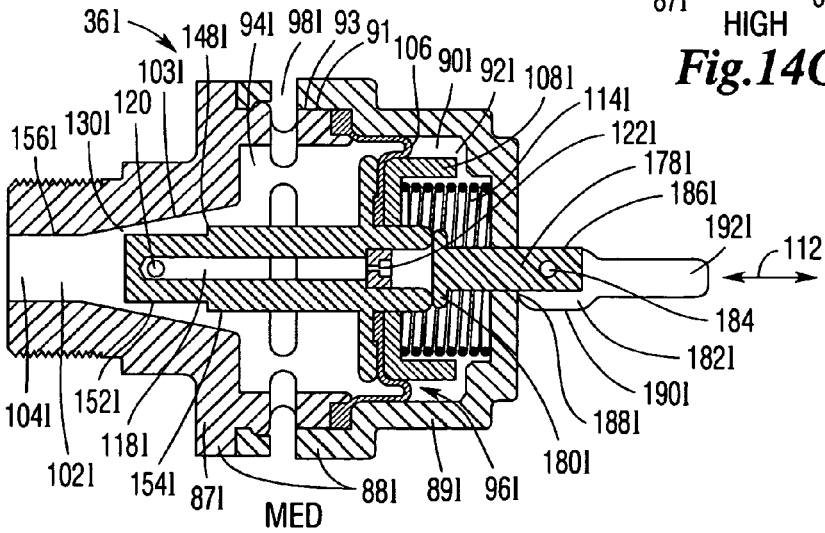
FIG. 14B is a side cross sectional view of the inlet control mechanism of FIG. 14A at a MEDIUM setting.

In some embodiments, the extent to which the piston assembly moves from the fully closed position can be manually limited, allowing for manual restriction of air flow between the atmosphere and compression cylinder. FIGS. 14A–C depict an embodiment inlet control mechanism 36*l* having a stem restrictor 178*l* that extends through the control segment 89*l* of the mechanism body 88*l*. The stem restrictor 178*l* is configured to reciprocate along the valve axis 112 and includes restrictor legs 180*l* positioned to engage and limit the movement of the valve stem 110*l* toward the valve control chamber 92*l*. An adjustment cam 182*l* is connected to rotate on the stem restrictor 178*l* with a pivot 184. The adjustment cam 182*l* includes a low cam surface 186*l*, a medium cam surface 188*l*, and a high cam surface 190*l* that are each positioned to contact the control segment 89*l* of the mechanism body 88*l* on its outside surface. The stem restrictor 178*l* is spring biased to move along the valve axis 112 toward the valve inlet chamber 94*l* and is locked in place by the adjustment cam 182*l* with the pivot 184.

A cam lever 192 allows the adjustment cam 182*l* to be manually rotated to selectively position the low, medium, or high cam surface 186*l*, 188*l*, or 190*l* in contact with the mechanism body 88*l*. The inlet control mechanism 36*l* is depicted in the LOW position in FIG. 14A, the low cam surface 186*l* being positioned adjacent the mechanism body 88*l*. The low cam surface 186*l* is located a relatively small distance from the pivot 184, allowing the adjustment cam 182*l* to lock the stem restrictor 178*l* against its spring bias at a position that is relatively close to the valve inlet chamber 94*l*. This in turn places the restrictor legs 180*l* in a position that restricts the valve stem 110*l* to move no further than an open position that creates a relatively small air space 130*l* between the valve stem 110*l* and tapered portion 103*l* of the valve outlet 102*l*, allowing a maximum amount of air to pass from the valve inlet chamber 94*l* that is less than when the control mechanism 36*l* is in the MEDIUM or HIGH positions.

The inlet control mechanism 36*l* is depicted in the MEDIUM position in FIG. 14B, the medium cam surface 188*l* being positioned adjacent the mechanism body 88*l*. The medium cam surface 188*l* is located a medium distance from the pivot 184, allowing the adjustment cam 182*l* to lock the stem restrictor 178*l* against its spring bias at a position that is a medium distance from the valve inlet chamber 94*l*. This in turn places the restrictor legs 180*l* in a position that restricts the valve stem 110*l* to move no further than an open position that creates a medium sized air space 130*l* between the valve stem 110*l* and tapered portion 103*l* of the valve outlet 102*l*, allowing a maximum amount of air to pass from the valve inlet chamber 94*l* that is less than when the control mechanism 36*l* is in the HIGH position but greater than when the control mechanism 36*l* is in the LOW position.

The inlet control mechanism 36*l* is depicted in the HIGH position in FIG. 14C, the high cam surface 190*l* being positioned adjacent the mechanism body 88*l*. The high cam surface 190*l* is located a relatively large distance from the pivot 184, allowing the adjustment cam 182*l* to lock the stem restrictor 178*l* against its spring bias at a position that is relatively far away from the valve inlet chamber 94*l*. This in turn places the restrictor legs 180*l* in a position that restricts the valve stem 110*l* to move no further than an open position that creates a relatively large air space 130*l* between the valve stem 110*l* and tapered portion 1031 of the valve outlet 102*l*, allowing a maximum amount of air to pass from the valve inlet chamber 94*l* that is greater than when the control mechanism 36*l* is in the LOW or MEDIUM positions.

Figure 15A:
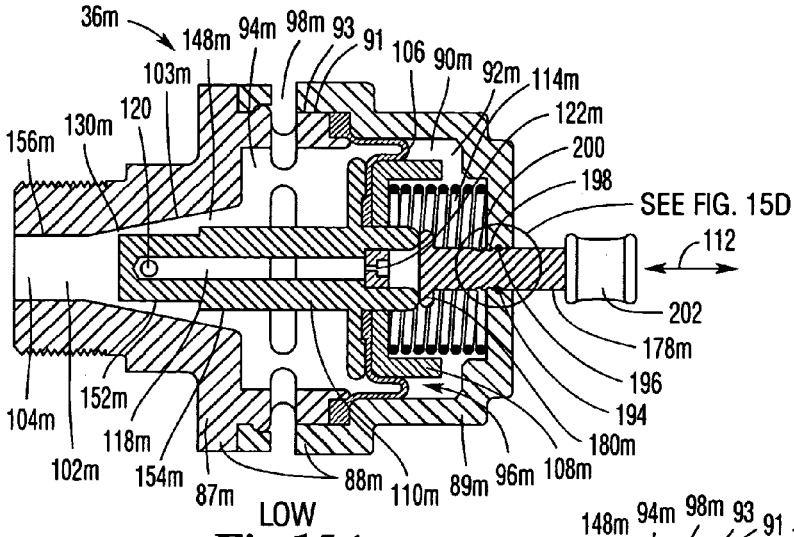
FIG. 15A is a side cross sectional view of an automatic inlet control mechanism according to one embodiment of the invention at a LOW setting.
Figure 15C:
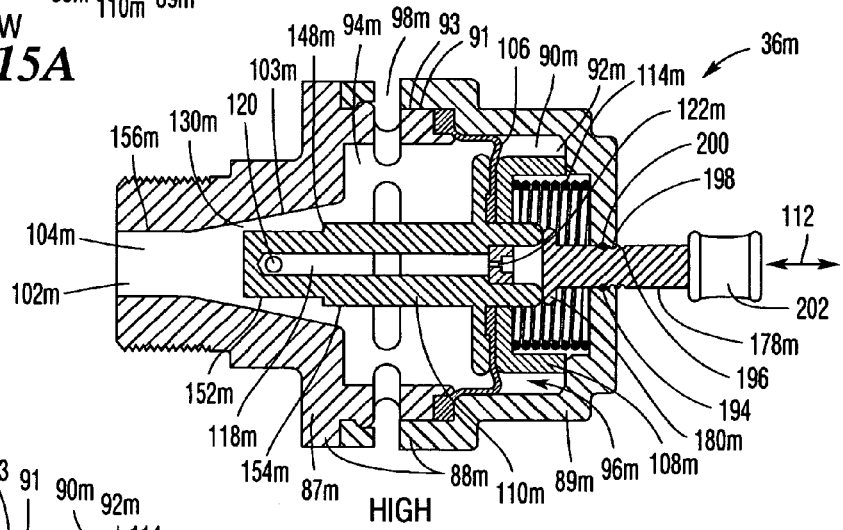
FIG. 15C is a side cross sectional view of the inlet control mechanism of FIG. 15A at a HIGH setting.
Figure 15B:
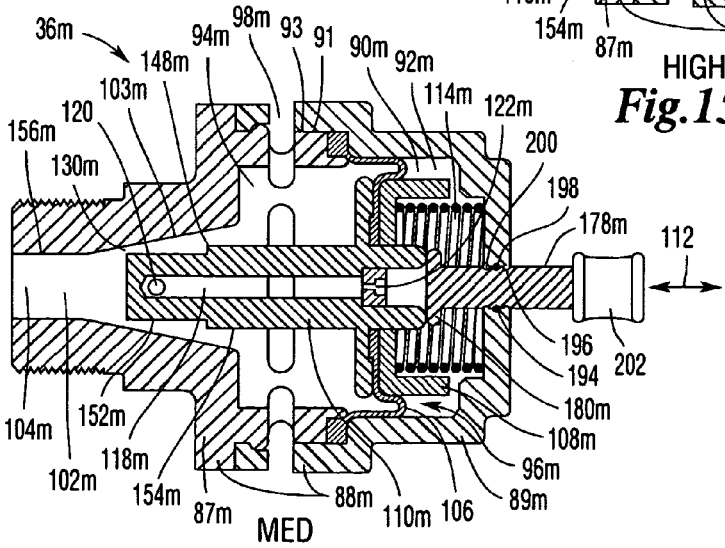
FIG. 15B is a side cross sectional view of the inlet control mechanism of FIG. 15A at a MEDIUM setting.
Figure 15D:
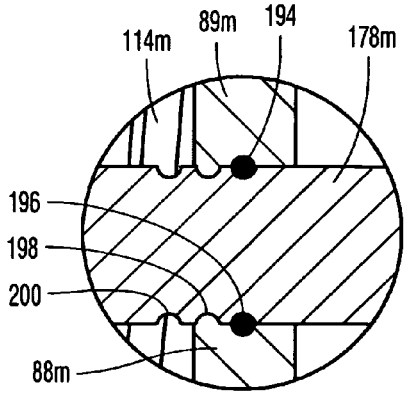
FIG. 15D is a magnified view of the inlet control mechanism of FIG. 15A at the LOW setting.

FIGS. 15A–D depict an embodiment inlet control mechanism 36*m* having a stem restrictor 178*m* that extends through a resilient ring 194 positioned within the control segment 89*m* of the mechanism body 88*m*. The stem restrictor 178*m* is configured to reciprocate along the valve axis 112 and includes restrictor legs 180*m* positioned to engage and limit the movement of the valve stem hOrn toward the valve control chamber 92*m*. A low adjustment notch 196, medium adjustment notch 198, and high adjustment notch 200 are located along the length of the stem restrictor 178*m*. The low, medium, and high adjustment notches 196, 198, and 200 are each positioned to compress and engage the resilient ring 194 to lock the stem restrictor 178*m* against the mechanism body 88*m*. A magnified cross sectional view of the engagement of the resilient ring 194 by the stem restrictor 178*m* is depicted in FIG. 15D in the LOW position.

A restrictor handle 202 allows the stem restrictor 178*m* to be manually adjusted to selectively compress and engage the resilient ring 194 with the low, medium, or high adjustment notches 196, 198, or 200. The inlet control mechanism 36*m* is depicted in the LOW position in FIG. 15A, the low adjustment notch 196 being positioned in engagement with the resilient ring 194 to lock with the mechanism body 88*m*. The low adjustment notch 196 is located a relatively small distance from the restrictor legs 180*m*. This allows the restrictor legs 180*m* to assume a position that restricts the valve stem 110*m* to move no further than an open position that creates a relatively small air space 130*m* between the valve stem 110*m* and tapered portion 103*m* of the valve outlet 102*m*, allowing a maximum amount of air to pass from the valve inlet chamber 94*m* that is less than when the control mechanism 36*m* is in the MEDIUM or HIGH positions.

The inlet control mechanism 36*m* is depicted in the MEDIUM position in FIG. 15B, the medium adjustment notch 198 being positioned in engagement with the resilient ring 194 to lock with the mechanism body 88*m*. The medium adjustment notch 198 is located a medium distance from the restrictor legs 180*m*. This allows the restrictor legs 180*m* to assume a position that restricts the valve stem 110*m* to move no further than an open position that creates a medium sized air space 130*m* between the valve stem 110*m* and tapered portion 103*m* of the valve outlet 102*m*, allowing a maximum amount of air to pass from the valve inlet chamber 94*m* that is greater than when the control mechanism 36*m* is in the LOW position but less than when the control mechanism 36*m* is in the HIGH position.

The inlet control mechanism 36*m* is depicted in the HIGH position in FIG. 15C, the high adjustment notch 200 being positioned in engagement with the resilient ring 194 to lock with the mechanism body 88*m*. The high adjustment notch 200 is located a relatively large distance from the restrictor legs 180*m*. This allows the restrictor legs 180*m* to assume a position that restricts the valve stem 110*m* to move no further than an open position that creates a relatively large sized air space 130*m* between the valve stem 110*m* and tapered portion 103*m* of the valve outlet 102*m*, allowing a maximum amount of air to pass from the valve inlet chamber 94*m* that is greater than when the control mechanism 36*m* is in the LOW or MEDIUM positions.

Figure 16A:
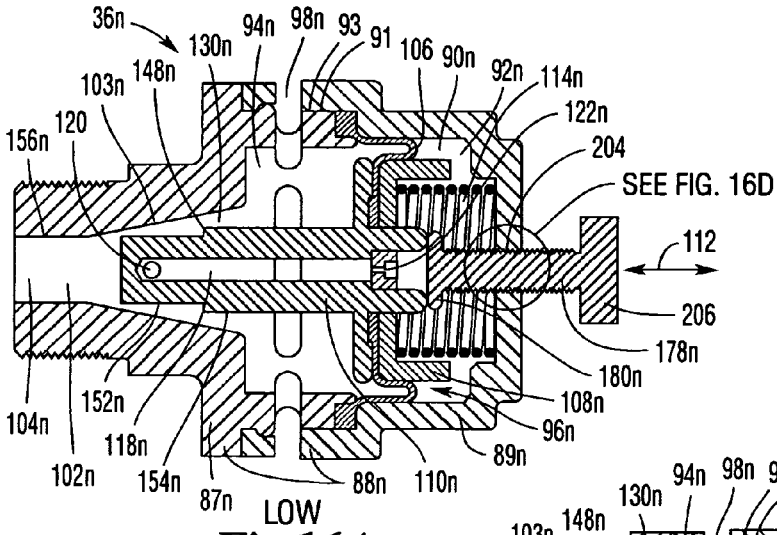
FIG. 16A is a side cross sectional view of an automatic inlet control mechanism according to one embodiment of the invention at a low setting.
Figure 16C:
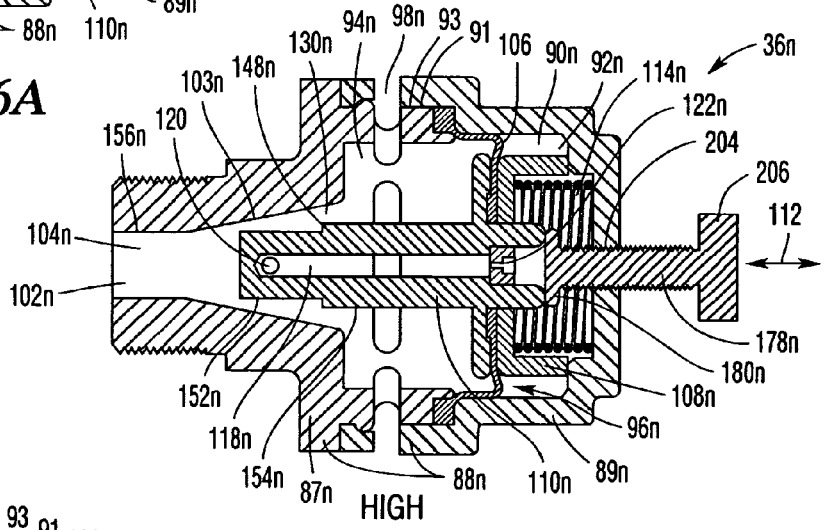
FIG. 16C is a side cross sectional view of the inlet control mechanism of FIG. 16A at a high setting.
Figure 16B:
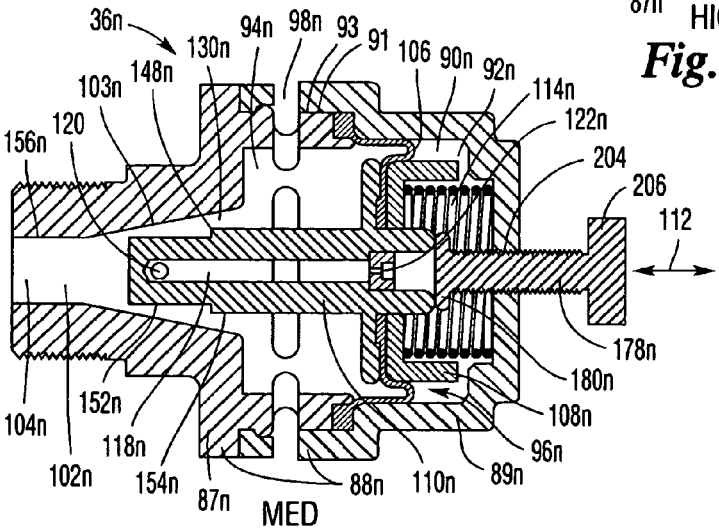
FIG. 16B is a side cross sectional view of the inlet control mechanism of FIG. 16A at an intermediate setting.
Figure 16D:
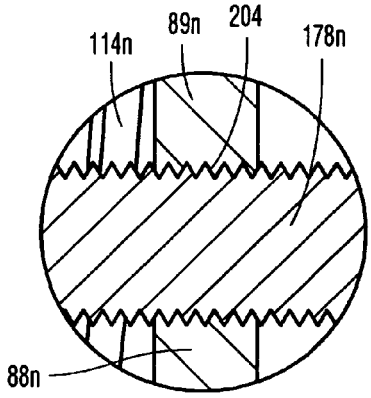
FIG. 16D is a magnified view of the adjustment mechanism of FIG. 16A.

FIGS. 16A–D depict an embodiment inlet control mechanism 36*n* having a threaded stem restrictor 178*n* that extends through a threaded portion 204 of the control segment 89*n* of the mechanism body 88*n*. The stem restrictor 178*n* is configured to rotate about and reciprocate along the valve axis 112 and includes restrictor legs 180*n* that are positioned to engage and limit the movement of the valve stem 110*n* toward the valve control chamber 92*n*. A magnified cross sectional view of the threaded portion 204 of the mechanism body 88*n* and the stem restrictor 178*n* is depicted in FIG. 16D.

A restrictor knob 206 allows the stem restrictor 178*n* to be manually rotated to adjust the maximum distance that the valve stem 110*n* and valve piston assembly 96*n* can move toward the valve control chamber 92*n*. The inlet control mechanism 36*n* is depicted in a position in FIG. 16A that restricts the valve stem 110*n* to move no further than an open position that creates a relatively small air space 130*n* between the valve stem 110*n* and tapered portion 103*n* of the valve outlet 102*n*, allowing a maximum amount of air to pass from the valve inlet chamber 94*n* that is of a relatively small magnitude.

The inlet control mechanism 36*n* is depicted in a position in FIG. 16B that restricts the valve stem 110*n* to move no further than an open position that creates an intermediate sized air space 130*n* between the valve stem 110*n* and tapered portion 103*n* of the valve outlet 102*n*, allowing a maximum amount of air to pass from the valve inlet chamber 94*n* that is of an intermediate magnitude.

The inlet control mechanism 36*n* is depicted in a position in FIG. 16C that restricts the valve stem 110*n* to move no further than an open position that creates a relatively large air space 130*n* between the valve stem 110*n* and tapered portion 103*n* of the valve outlet 102*n*, allowing a maximum amount of air to pass from the valve inlet chamber 94*n* that is of a relatively large magnitude.

Figure 17A:
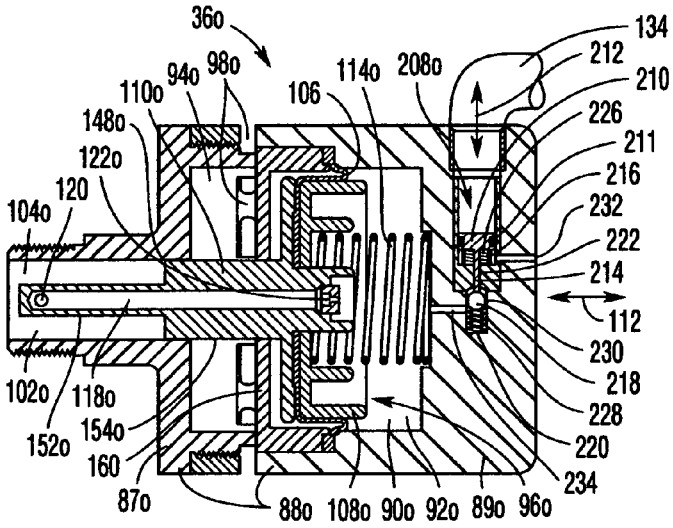
FIG. 17A is a side cross sectional view of an automatic inlet control mechanism according to one embodiment of the invention in a closed position.
Figure 17B:
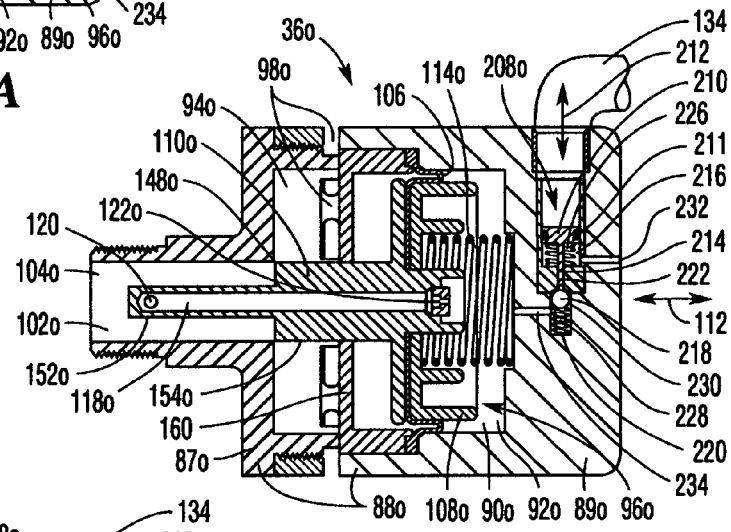
FIG. 17B is a side cross sectional view of the inlet control mechanism of FIG. 17A in an intermediate position.
Figure 17C:
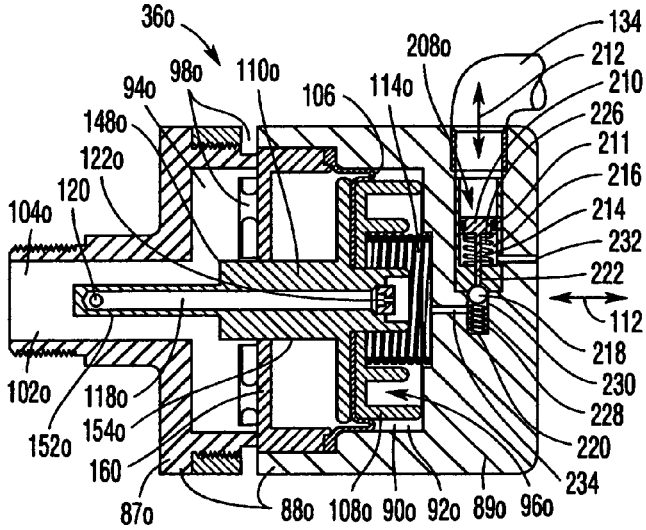
FIG. 17C is a side cross sectional view of the inlet control mechanism of FIG. 17A in an open position.

Some embodiments of the invention also allow for continuous operation of the compressor unit without requiring the use of an inlet unloader for actuation of the cylinder inlet valve. FIGS. 17A–C depict an inlet control mechanism 154*o* having an equalization valve 208*o* positioned within the control segment 89*o* of the mechanism body 88*o*. The equalization valve 208*o* is connected through a pilot tube 134 to a pilot valve (not shown) mounted on the air reservoir of a compressor unit. The equalization valve 208*o* includes an equalization piston 210 that is configured to reciprocate along an equalization valve axis 212 in a piston chamber 216. The equalization piston 210 includes a piston ring 211 that allows the equalization piston 210 to seal against the walls of the piston chamber 216 during operation. The equalization piston 210 is connected to an equalization rod 214 that extends from the piston chamber 216 through a rod passage 222 into a ball chamber 220 where the equalization rod 214 engages a ball 218. The rod passage 222 is sufficiently large to allow air to pass freely from the piston chamber 216 past the equalization rod 214 toward the ball chamber 220.

The equalization piston 210 is biased with an equalization spring 226 to move to a position that is away from the ball chamber 220 (upwards as depicted in FIGS. 17A–C). The ball 218 also reciprocates along the equalization valve axis 212 within the ball chamber 220 and is biased with a ball spring 228 to move in the same direction as the equalization piston 210. The ball 218 is sized to allow air to pass freely around between the ball 218 and ball chamber walls 230 but to seal against the upper taper 231 of the ball chamber 220 when pressed against the upper taper 231 by the ball spring 228, preventing air flow from the rod passage 222 to the ball chamber 220. An equalization inlet 232 allows air to freely enter the piston chamber 216 from the environment to maintain atmospheric pressure within the piston chamber 216. A control inlet 234 allows for the free passage of air between the ball chamber 220 and control chamber 92*o*.

When used with a continuously running air compressor unit, the inlet control mechanism 36*o* operates according to pneumatic signals received from the pilot valve. During operation, as long as air pressure contained within the air reservoir of the compressor unit remains above a predetermined minimum magnitude, the pilot valve assumes an ON condition. In turn, the pilot valve sends a pressure signal to the equalization valve 208*o* through the pilot tube 134. The pressure signal forces the equalization piston 210 against the bias of the equalization spring 226, forcing the equalization rod 214 to push the ball 218 against the bias of the ball spring 228 and away from the upper taper 231 of the ball chamber 220. This position is depicted in FIG. 17A and allows air from the environment to freely enter the ball chamber 220 by way of the equalization inlet 232 piston chamber 216, and rod passage 222. This also allows air from the environment to freely enter the control chamber 92*o* through the control inlet 234 and maintain atmospheric pressure within the control chamber 92*o* as long as the ball 218 remains away from the upper taper 231 of the ball chamber 220.

Air pressure within the control chamber 92*o* remains at atmospheric pressure as long as the pilot valve continues to send a pressure signal to the equalization valve 208*o*. The orifice 122*o* has a relative size that allows air to pass at a much slower rate than air can pass through the open equalization valve 208*o* from the environment. Although the compressor unit operates continuously, air cannot be drawn through the vent passageway 122*o* of the valve stem 110*o* as quickly as it is supplied by the open equalization valve 208*o*. As a result, no pressure differential exists between the valve control chamber 92*o* and valve inlet chamber 94*o* as long as the pressure signal continues and the inlet control mechanism 36*o* does not open to allow air from the atmosphere to flow though the valve outlet 102*o* to the compression cylinder.

When air pressure within the air reservoir falls below the predetermined minimum magnitude, the pilot valve assumes an OFF condition. In turn, the pilot valve removes the pressure signal from the equalization valve 208*o* through the pilot tube 134. With the pressure signal removed, the bias of the equalization spring 226 forces the equalization piston 210 away from the ball spring 228, drawing the equalization rod 214 away from the ball 218. The bias of the ball spring 228 forces the ball 218 against the upper taper 231 of the ball chamber 220. This position is depicted in FIG. 17B and prevents air from the environment from entering the ball chamber 220 by way of the equalization inlet 232, piston chamber 216, and rod passage 222. This also prevents air from the environment from entering the control chamber 92*o* through the control inlet 234.

Since the ball 218 blocks the flow of air from the environment into the control chamber 92*b*, air pressure contained within the control chamber 92*b* begins to drop as air is drawn through the vent passageway 118*o* and orifice 122*o*. This creates a pressure differential between the valve control chamber 92*o* and valve inlet chamber 94*o* that forces the piston assembly 96*o* toward the valve control chamber 92*o*, eventually opening the control mechanism 36*o* to the position depicted in FIG. 17C.

Once the inlet control mechanism 36*o* is in the position depicted in FIG. 17C, the air compressor begins to add pressure to the air reservoir. This continues until the pressure within the air reservoir returns to a predetermined maximum magnitude that is greater than the predetermined minimum magnitude. When the air pressure within the reservoir reaches the predetermined maximum magnitude, the pilot valve again assumes an ON condition to restore the pressure signal to the equalization valve 208*o*, removing the pressure differential between the valve inlet chamber 94*o* and valve control chamber 92*o* and returning the inlet control mechanism 36*o* to the position depicted in FIG. 17A.

Figure 18A:
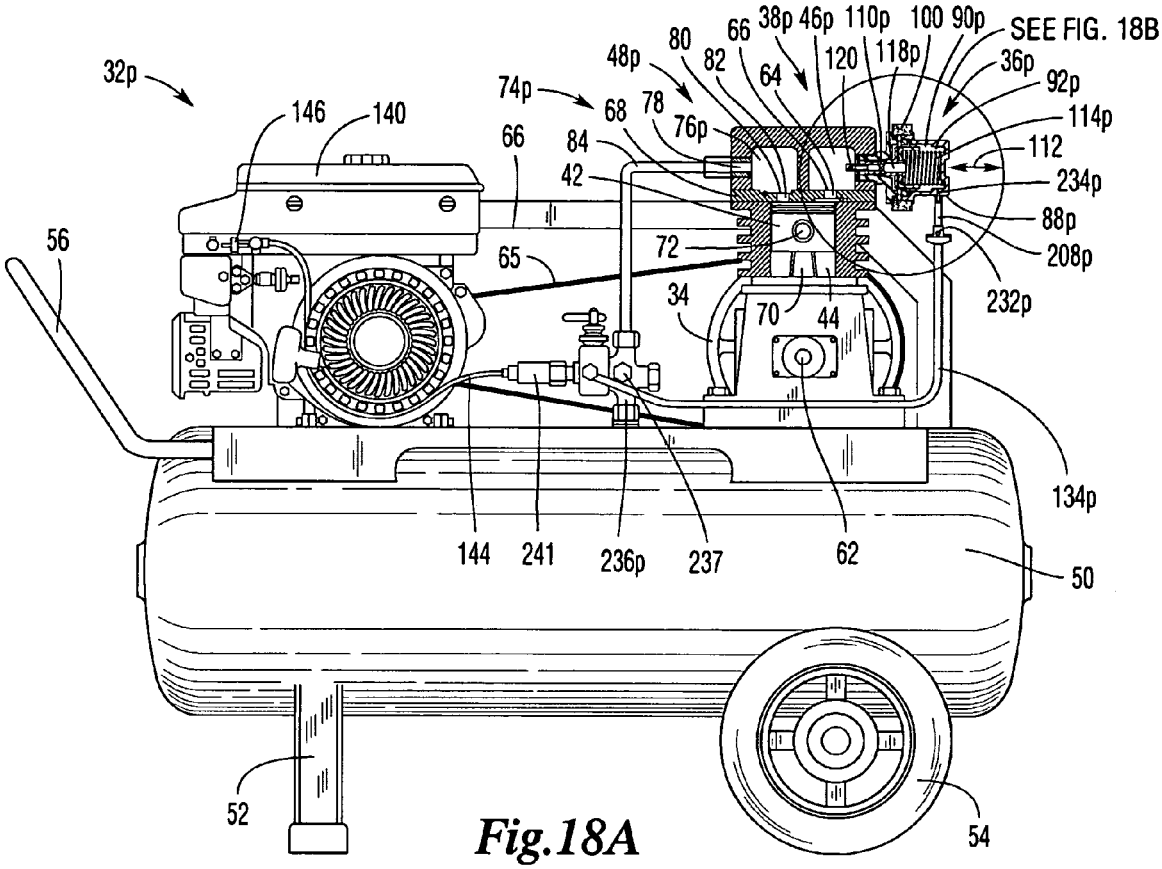
FIG. 18A is a partial cross sectional view of an air compressor unit having an automatic inlet control mechanism according to one embodiment of the invention.
Figure 18B:
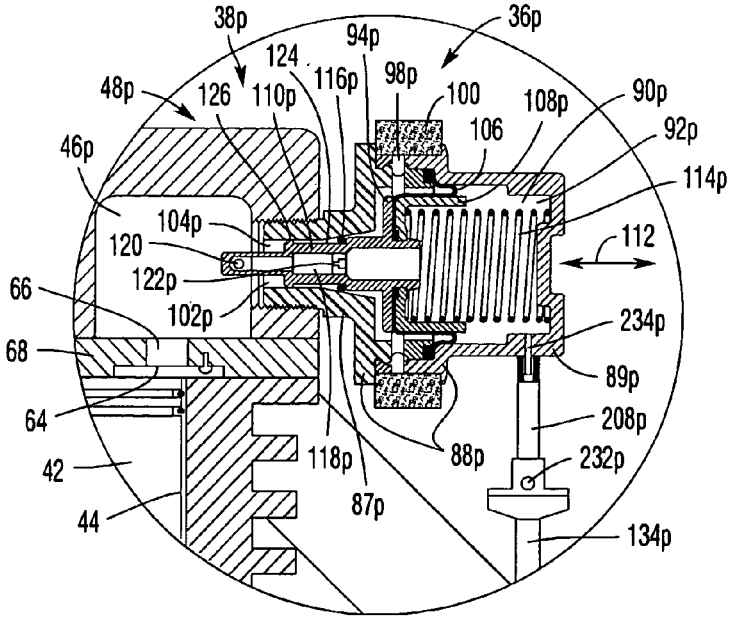
FIG. 18B is a magnified side cross sectional view of the automatic inlet control mechanism of FIG. 18A.

Although FIGS. 17A–C depict an equalization valve 208*o* mounted within the mechanism body of the inlet control mechanism, it is also possible to mount an equalization valve externally. FIGS. 18A and B depict a compressor unit 32*p* having an externally mounted equalization valve 208*p* attached to the control segment 89*p* of the mechanism body 88*p*. The externally mounted equalization valve 208*p* can be mechanically similar to the equalization valve 208*o* positioned within the mechanism body 88*o* in FIGS. 17A–C, the externally mounted equalization valve 208*p* of FIGS. 18A and 18B being configured to allow air to be drawn from the environment through an equalization inlet 232*p* to a control inlet 234*p* leading to the control chamber 92*p*. A magnified cross sectional view of the inlet control mechanism 36*p* of FIG. 18A is depicted in FIG. 18B.

Referring again to FIG. 18A, the compressor unit can also include a combination valve 236*p* that combines the functions of a check valve, pilot valve, air cylinder, and a discharge unloader valve, the combination valve 236*p*, being connected to the discharge tube 84 from the compressor pump 48*p*, the pilot tube 134*p*, air reservoir 50, and the conduit 144 leading to the throttle control 146 of the gasoline engine 140. In this combined configuration, the discharge unloader valve is responsive to the pilot valve and is configured to allow air that is compressed with the compressor pump 48*p* to be channeled to the surrounding atmosphere through a discharge port 237 on the combination valve 236*p* rather than into the air reservoir 50 when the pilot valve assumes an ON condition. This occurs as the pilot valve sets the engine control throttle 146 to idle through the conduit 144 with the air cylinder 241.

The automatic inlet control mechanism 36*p* allows for a substantial size reduction in the discharge unloader valve compared to that which is required for a comparable compressor unit that does not have an inlet control. Consider the compressor unit 32*p* of FIGS. 18A and B when the pilot valve of the combination valve 236*p* assumes on ON condition. The equalization valve 208*p* responds to the pilot valve by allowing air to pass from the control chamber 92*p* through the equalization inlet 232*p* to the environment, removing the pressure differential between the valve inlet chamber 94*p* and valve control chamber 92*p*. The piston assembly 96*p* moves to a position that is depicted in FIGS. 18A and B that prevents air from moving from the valve inlet chamber 94*p* to the valve outlet 102*p* and compression cylinder inlet 38*p*. As the piston 42 continues to reciprocate, the valve control chamber 92*p* continues to be the primary source of air to the compression cylinder 44, the air being drawn through the vent passageway 118*p* and vent orifice 122*p*. Although the pressure within the valve control chamber 92*p* remains commensurate with atmospheric pressure, the amount of air that is drawn through the vent passageway 118*p* is substantially restricted by the orifice 122*p*. Thus, the amount of air that must be discharged by the discharge unloader vale in the combination valve 236*p* is also substantially reduced.

Due to this substantial reduction in the amount of air that must be discharged, the structural size of the discharge unloader valve can also be substantially reduced. In some embodiments, the unloader opening of the valve can be reduced by an order of ten or more, significantly reducing apparatus cost.

Figure 19A:
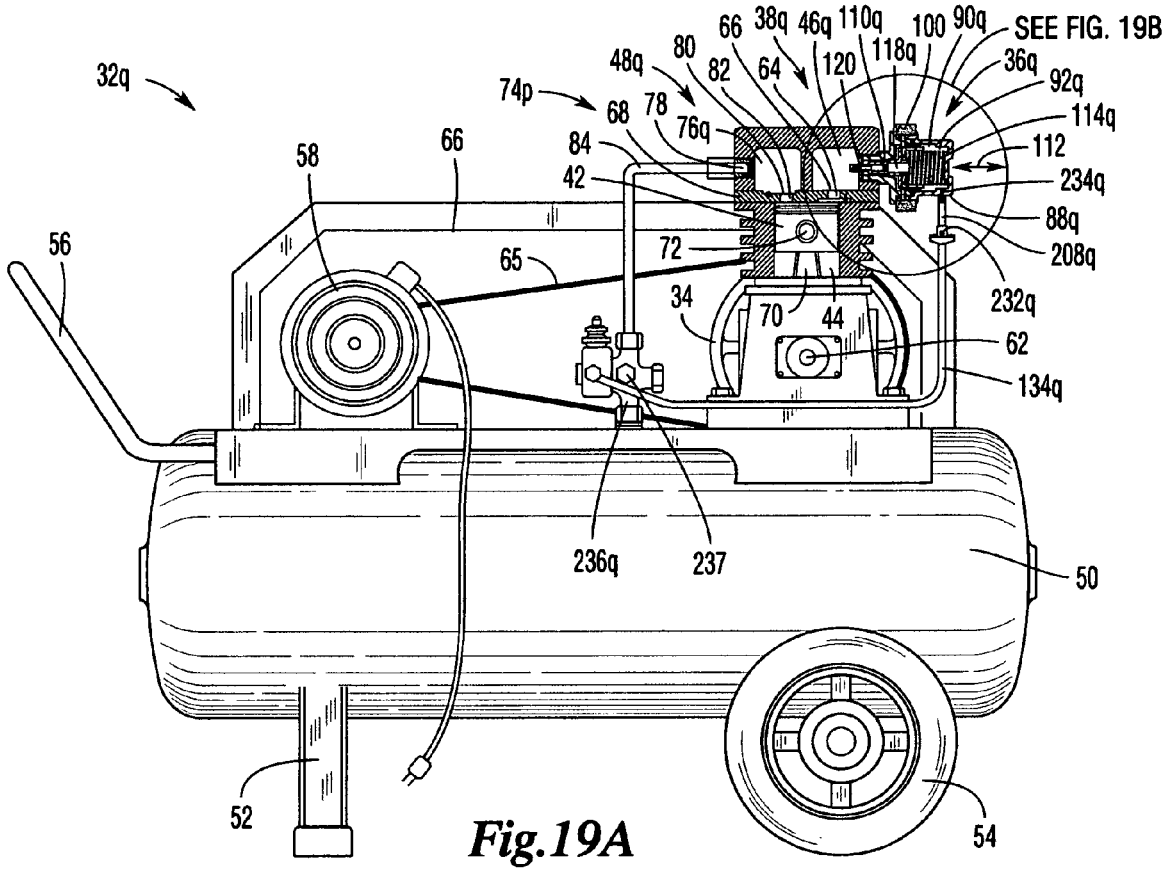
FIG. 19A is a partial cross sectional view of an air compressor unit having an automatic inlet control mechanism according to one embodiment of the invention.
Figure 19B:
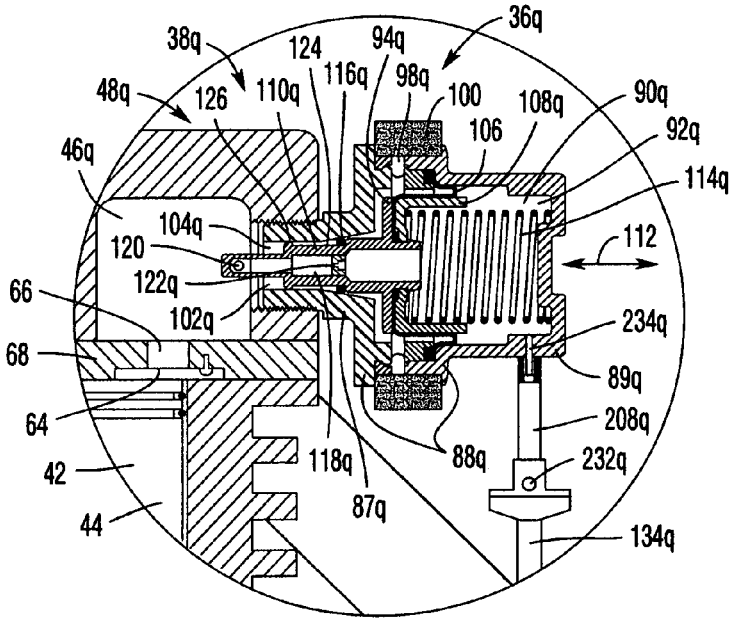
FIG. 19B is a magnified side cross sectional view of the automatic inlet control mechanism of FIG. 19A.

Similar inlet control mechanisms can be implemented in electrically operated continuous drive compressor units as well. FIGS. 19A and B depict a compressor unit 32*q* having an electric motor 58 and a combination valve 236*q* that combines the functions of a check valve and pilot valve, being connected to the discharge tube 84 from the compressor pump 48*q*, the pilot tube 134*q*, and air reservoir 50. FIG. 19B depicts a magnified cross sectional view of the inlet control mechanism 36*q* which is similar to the inlet control mechanism 36*p* of FIGS. 18A and B.

Figure 20A:
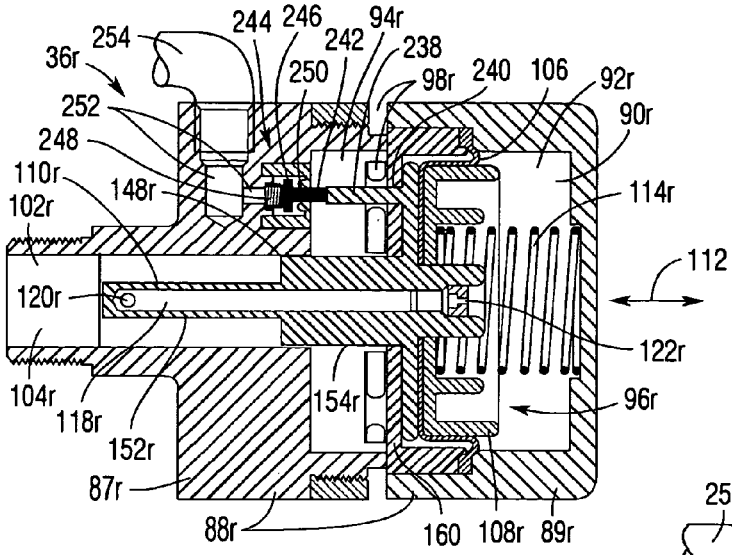
FIG. 20A is a side cross sectional view of an automatic inlet control mechanism according to one embodiment of the invention in a closed position.
Figure 20B:
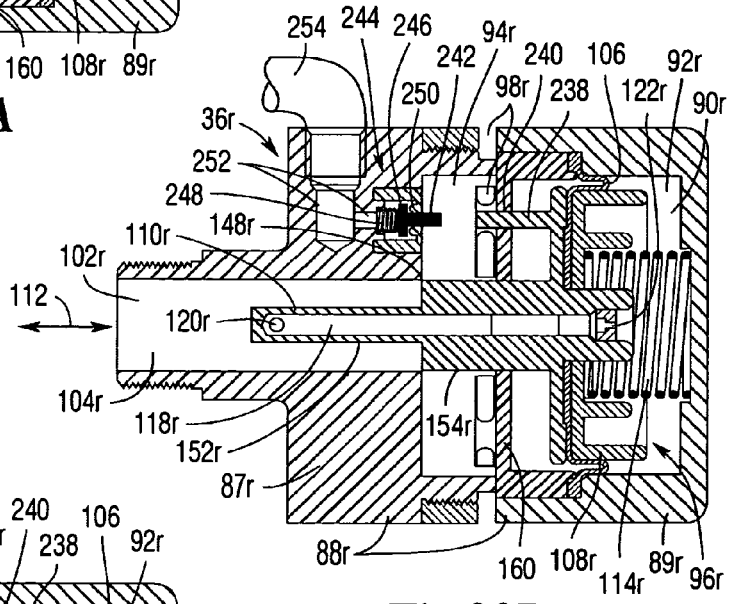
FIG. 20B is a side cross sectional view of the inlet control mechanism of FIG. 20A in a closed, intermediate position.
Figure 20C:
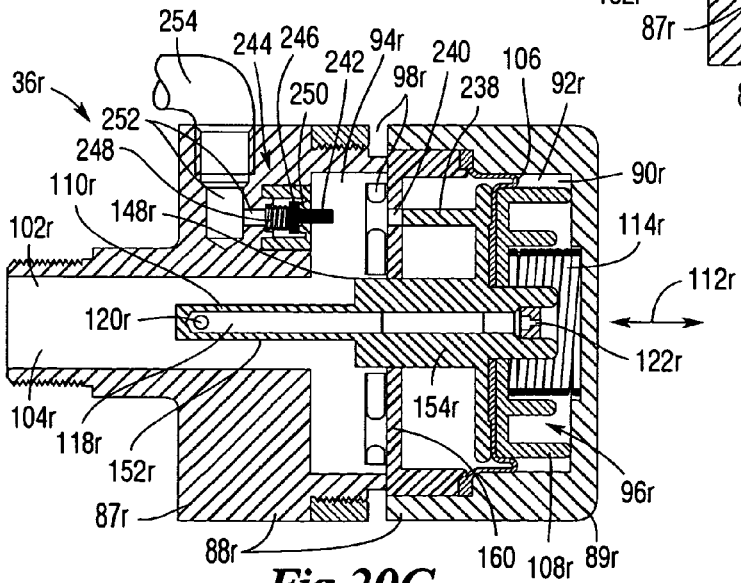
FIG. 20C is a side cross sectional view of the inlet control mechanism of FIG. 20A in an open position.

In some embodiments of the invention, the reciprocating motion of the piston assembly can be used to operate and/or actuate other components of the compressor unit. For example, FIGS. 20A–C depict an automatic inlet control mechanism 36*r* in which the piston assembly 96*r* includes an actuation pin 238 mounted on the valve stem 110*r* and positioned to reciprocate through a pin space 240 in the guide 160. The actuation pin 238 allows the piston assembly 96*r* to function as an actuator, the actuation pin 238 being sufficiently long to engage the venting stem 242 of a vent valve 244 positioned within the inlet segment 87*r* of the mechanism body 88*r* when the piston assembly 96*r* is in the closed position as depicted in FIG. 20A. The vent valve 244 includes a stem seal 246 that is connected to reciprocate with the venting stem 242 and is biased with a stem spring to seal against the stem seat 248 when the actuation pin 238 is not in engagement with the venting stem 242 as shown in FIG. 20C. The vent valve 244 connects the valve inlet chamber 94*r* to a vent passage 252 that can allow the attachment of a vent line 254. The vent line 254 can itself be linked to a discharge tube or other component of the compressor unit that requires the release of air pressure when the compressor unit is not compressing air and when the inlet control mechanism 36*r* is in the closed position, as shown in FIG. 20A.

Consider the inlet control mechanism 36*r* either before or at the start of operation of a compressor unit. The inlet control mechanism 36*r* is in a closed position as depicted in FIG. 20A with the valve stem 110*r* preventing the flow of air between the valve inlet chamber 94*r* and valve outlet 102*r*. The actuation pin 238 pushes the venting stem 242 against the bias of the stem spring 248 to pull the stem seal 246 away from the stem seat 250, allowing air to pass from the valve inlet chamber 94*r* through the vent passage 252 to the vent line 254. Since the compressor unit has not yet begun to compress air, the discharge tube leading from the compressor pump to the air reservoir does not yet need to be pressurized. The vent line 254 can be connected to the discharge tube to allow pressure contained therein to escape through the vent valve 244 to the valve inlet chamber 94*r*, valve inlet 98*r*, and back into the atmosphere. As the piston assembly 96*r* moves toward the valve control chamber 92*r*, the actuation pin 238 disengages the venting stem 242 and allows the stem seal 246 to seal against the stem seat 250 under the force of the stem spring 248, as depicted in FIG. 20B. By the time the piston assembly 96*r* moves to a position that allows air to move from the valve inlet chamber 94*r* to the valve outlet 102*r* such that the compressor unit begins to compress air, as depicted in FIG. 20C, the vent valve 244 prevents air from being discharged to the atmosphere through the valve inlet chamber 94*r*, allowing compressed air to instead flow into the air reservoir.

Figure 21A:
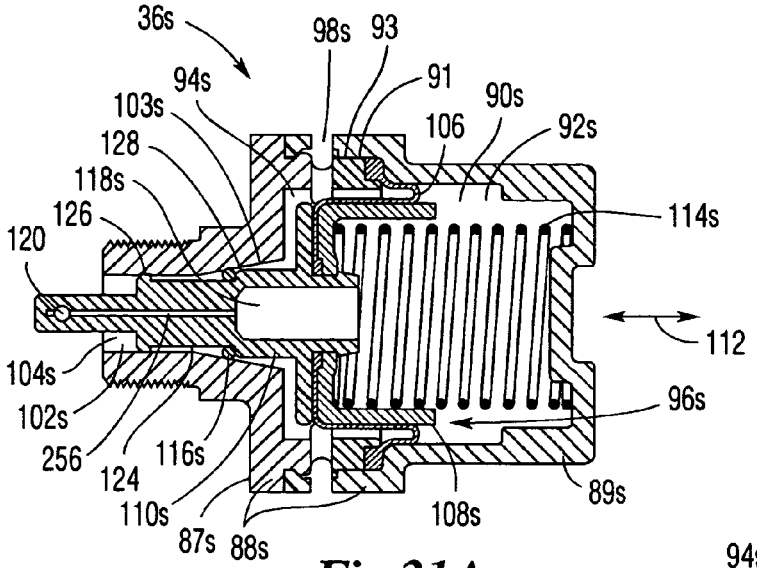
FIG. 21A is a side cross sectional view of an automatic inlet control mechanism according to one embodiment of the invention in a fully closed position.
Figure 21B:
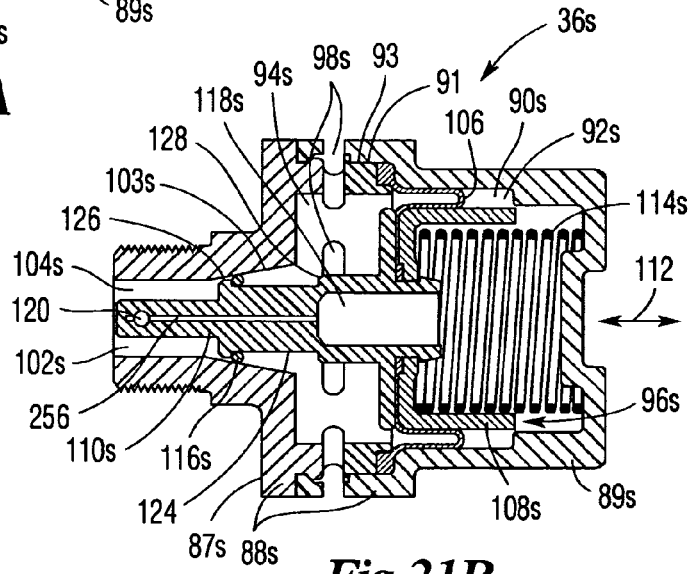
FIG. 21B is a side cross sectional view of the inlet control mechanism of FIG. 21A in a closed, intermediate position.
Figure 21C:
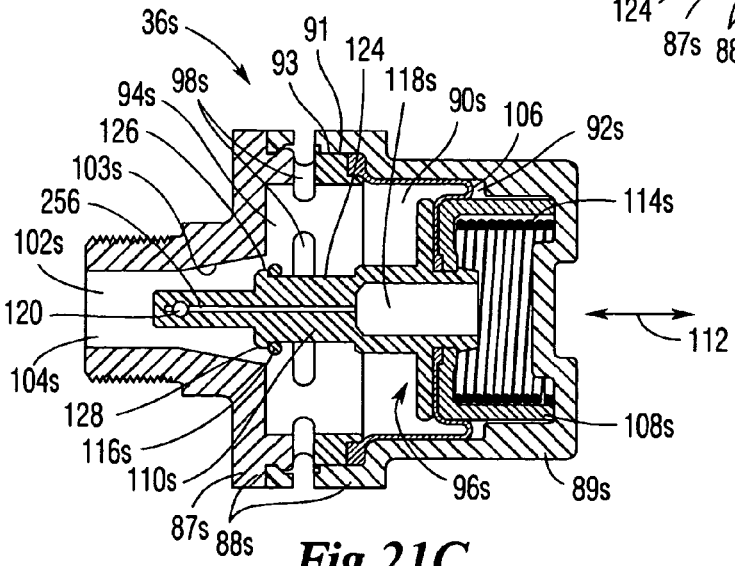
FIG. 21C is a side cross sectional view of the inlet control mechanism of FIG. 21A in a fully open position.

Although the invention has been shown and described as having a vent passageway having an air restriction that comprises an orifice, it will be appreciated that many types of restrictions can be appropriately implemented. FIGS. 21A–C depict an inlet control mechanism 36*s* in which the restriction is formed by a reduced diameter segment 256 of the vent passageway 118*s*. Due to the extremely small relative diameter of the reduced diameter segment 256, the segment 256, like an orifice, greatly restricts the rate at which air can flow from the valve control chamber 92*s* through the vent passageway 118*s* to the valve outlet 102*s*, thereby restricting the speed at which the piston assembly 96*s* can move from the closed positions of FIGS. 21A and B toward to the open position of FIG. 21C.

Figure 22A:
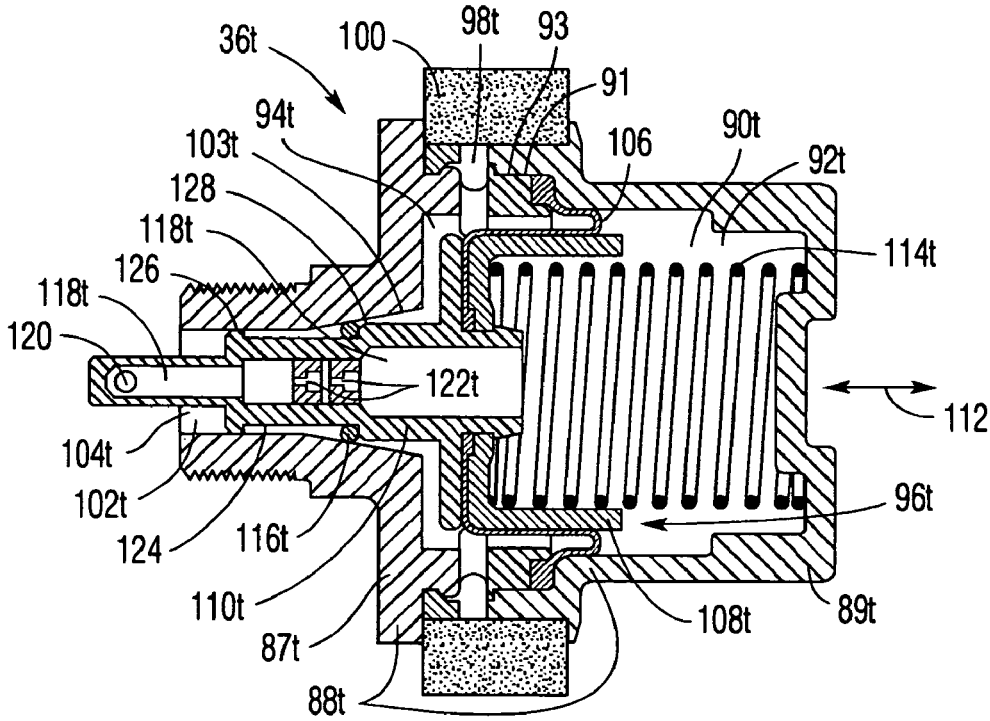
FIG. 22A is a side cross sectional view of an automatic inlet control mechanism according to one embodiment of the invention in a fully closed position.
Figure 22B:
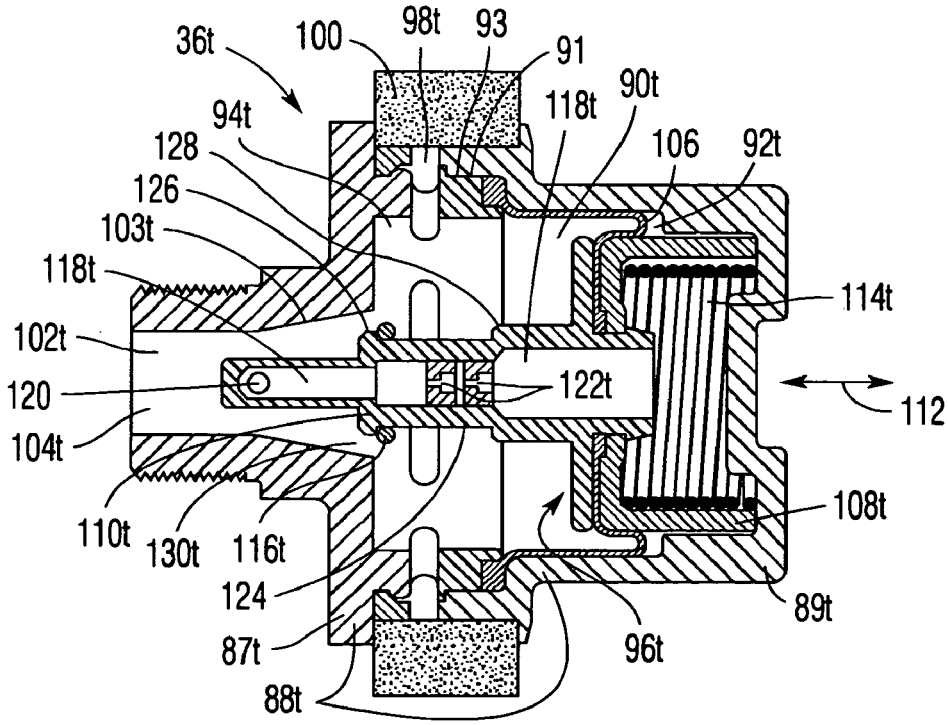
FIG. 22B is a side cross sectional view of the inlet control mechanism of FIG. 22A in a fully open position.

FIGS. 22A and B depict an inlet control mechanism 36*t* in which the vent passageway 118*t* has a restriction comprising multiple orifices 122*t* positioned in a series along the length of the valve stem 110*t*. Each orifice 122*t* of the configuration is identical to the other and each creates a successive air flow restriction reducing the downstream air pressure by roughly one order of magnitude. Thus the successive multiple orifices can be used to substantially increase the amount of time that is necessary for the valve piston assembly 96*t* to move from a closed position, as depicted in FIG. 22A, to a position that allows air to move from the valve inlet chamber 94*t* to the valve outlet 102*t*, as depicted in FIG. 22B.

Figure 23A:
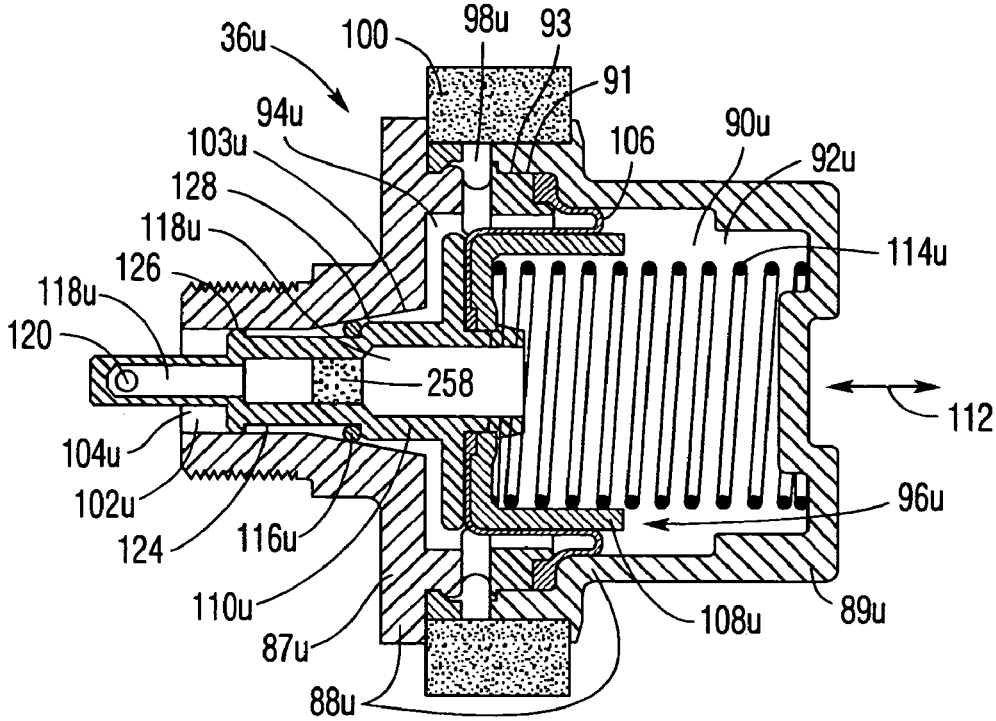
FIG. 23A is a side cross sectional view of an automatic inlet control mechanism according to one embodiment of the invention in a fully closed position.
Figure 23B:
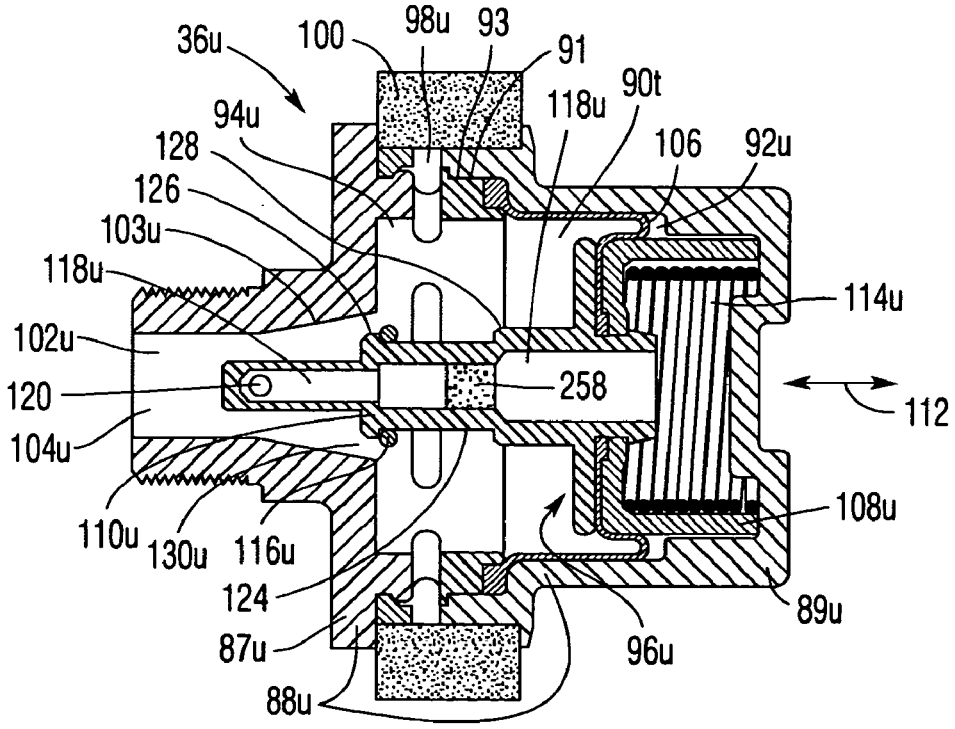
FIG. 23B is a side cross sectional view of the inlet control mechanism of FIG. 23A in a fully open position.

FIGS. 23A and B depict an inlet control mechanism 36*u* in which the vent passageway 118*u* has a restriction comprising a porous metal restrictor 258 that is press fitted within the valve stem 110*u*. The porous metal restrictor 258 is air permeable and allows a limited amount of air to pass therethrough, restricting airflow and reducing downstream air pressure accordingly. The effective magnitude of the restriction created can depend on the thickness or number of restrictors incorporated into the control mechanism 36*u* and/or the exact type or permeability of the material used. Thus, the placement of the porous metal restrictor 258 can be used to substantially increase the amount of time that is necessary for the valve piston assembly 96*u* to move from a closed position, as depicted in FIG. 23A, to a position that allows air to move from the valve inlet chamber 94*u* to the valve outlet 102*u*, as depicted in FIG. 23B.

Figure 24A:
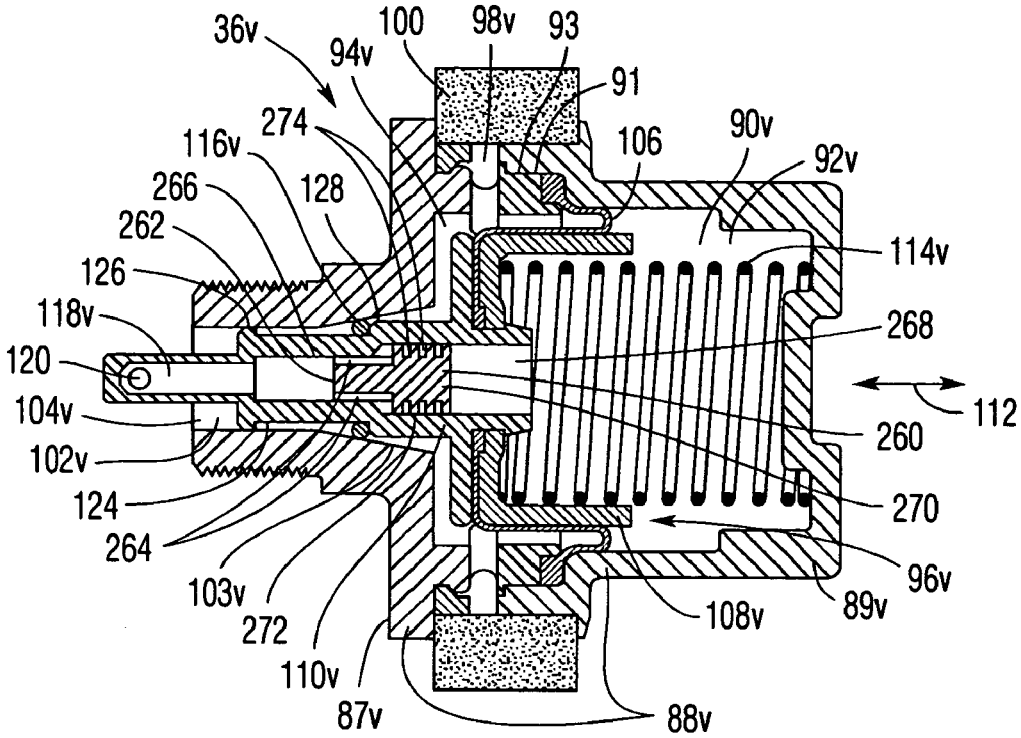
FIG. 24A is a side cross sectional view of an automatic inlet control mechanism according to one embodiment of the invention in a fully closed position.

FIGS. 24A and B depict an inlet control mechanism 36*v* in which the vent passageway 118*v* has a restriction comprising a labyrinth restrictor 260 that is press fitted into the vent passageway 118*v* of the valve stem 110*v*. Four different views of the labyrinth restrictor 260 are depicted in FIGS. 25A–D. The labyrinth restrictor 260 includes a plurality of flutes 264 extending along a reduced radius portion 262, the reduced radius portion 262 being sized to allow for press fitting into a reduced diameter portion 266 of the vent passageway 118*v*. When positioned within the reduced diameter portion 266 of the vent passageway 118*v*, the flutes 264 and the inside walls of the vent passageway 118*v* together form fluted passages allowing for the passage of air between the reduced diameter portion 266 and an expanded diameter portion 268 of the vent passageway 118*v*.

Figure 24B:
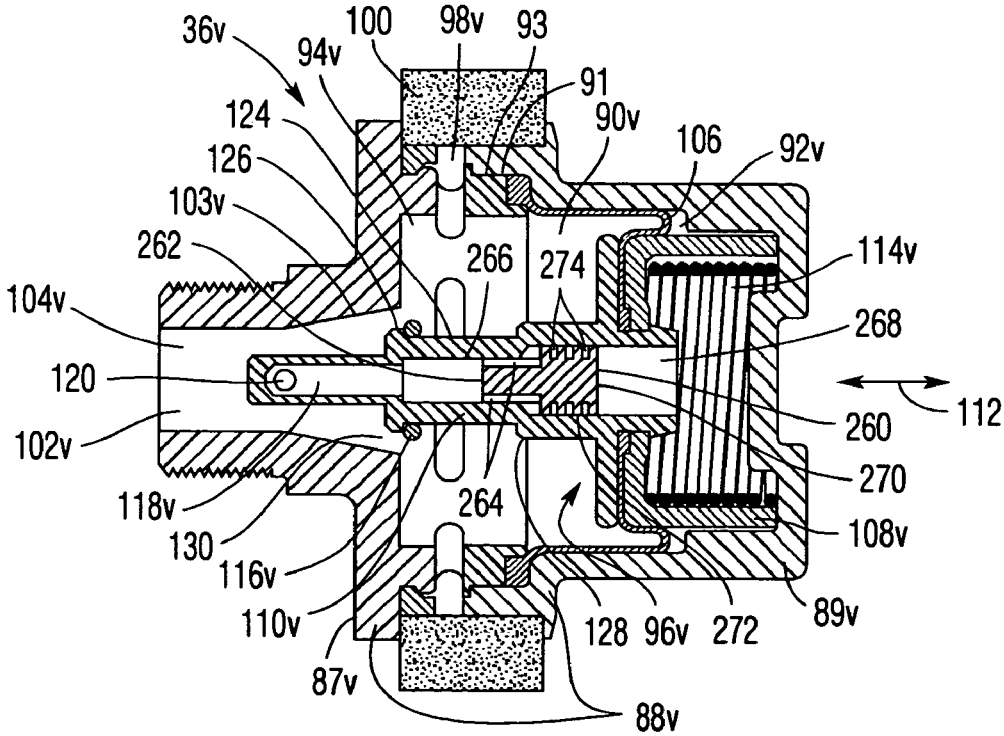
FIG. 24B is a side cross sectional view of the inlet control mechanism of FIG. 24A in a fully open position.
Figure 25C:
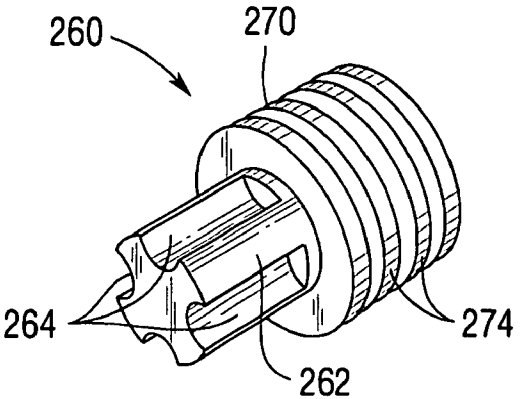
FIG. 25C is a rear perspective view of the labyrinth restrictor of FIG. 25A.
Figure 25D:
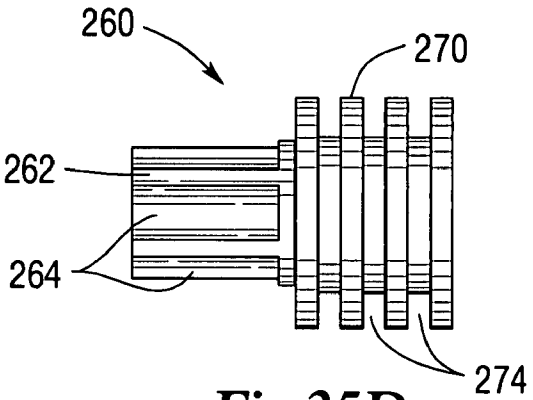
FIG. 25D is a side view of the labyrinthine restrictor of FIG. 25A.
Figure 25A:
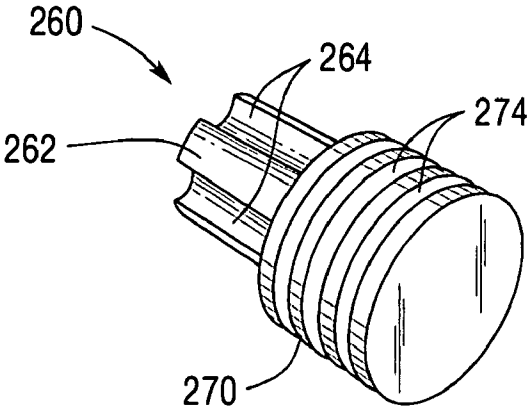
FIG. 25A is a front perspective view of an individual labyrinth restrictor of FIGS. 24A and B.
Figure 25B:
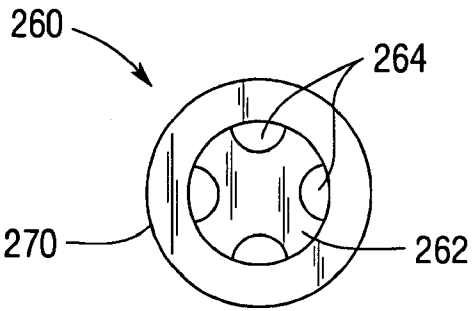
FIG. 25B is a rear view of the labyrinth restrictor of FIG. 25A.

The labyrinth restrictor 260 also includes an expanded radius portion 270 that is sized to allow a slight air clearance 272 to exist with the walls of the expanded diameter portion 268 of the vent passageway 118*v* when installed within the valve stem 110*v*. The expanded radius portion 270 of the restrictor 260 includes multiple grooves 274 that are incrementally spaced and positioned around the diameter of the expanded radius portion 270. The flutes 264 of the reduced radius portion 266 of the restrictor 260 are open to the air clearance 272 with the walls of the expanded diameter portion 268 of the vent passageway 118*v* to allow air to bypass the restrictor 260 when it is installed within the valve stem 110*v*. However, the close proximity of the expanded radius portion 270 of the restrictor 260 to the walls of the expanded diameter portion 268 of the vent passageway 118*v* creates a restriction for passing air that has a restriction size allowing air to be drawn by the compressor unit at a preselected rate to cause the compressor unit to produce compressed air at less than its predetermined rate of production. Each groove 274 creates an air expansion space with the walls of the expanded diameter portion 268 of the vent passageway 118*v*. As a result, each successive groove 274 creates a further, successive reduction in downstream air pressure. Where each successive groove 274 is of approximately equal size, each successive reduction in downstream air pressure will be of approximately one order of magnitude. Thus, the amount of time that is necessary for the valve piston assembly 96*v* to move from a closed position, as depicted in FIG. 24A, to a position that allows air to move from the valve inlet chamber 94*v* to the valve outlet 102*v*, as depicted in FIG. 24B, can be determined by the respective size, shape/orientation, or number of grooves 274 that are included on the expanded radius portion 270 of the restrictor 260.

Figure 26A:
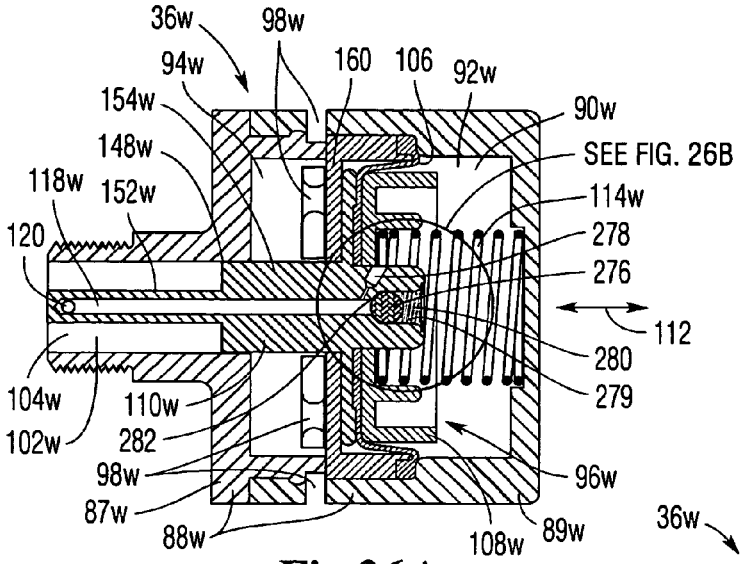
FIG. 26A is a side cross sectional view of an automatic inlet control mechanism according to one embodiment of the invention in a fully closed position.
Figure 26B:
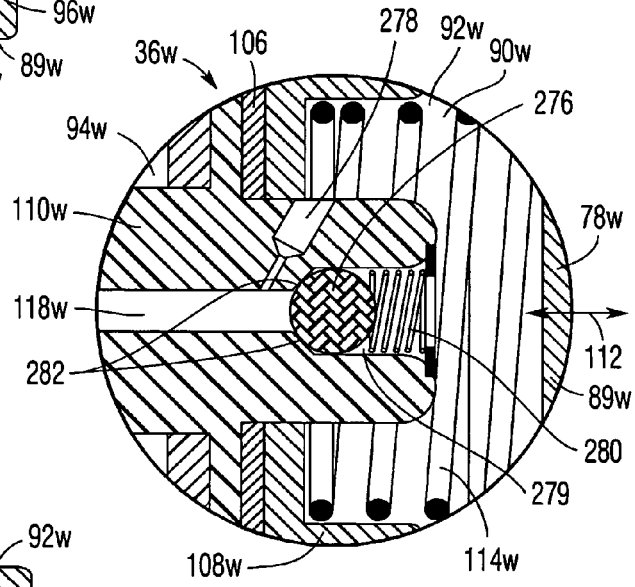
FIG. 26B is a magnified side cross sectional view of the restriction in the vent passageway of the inlet control mechanism of FIG. 26A.
Figure 26C:
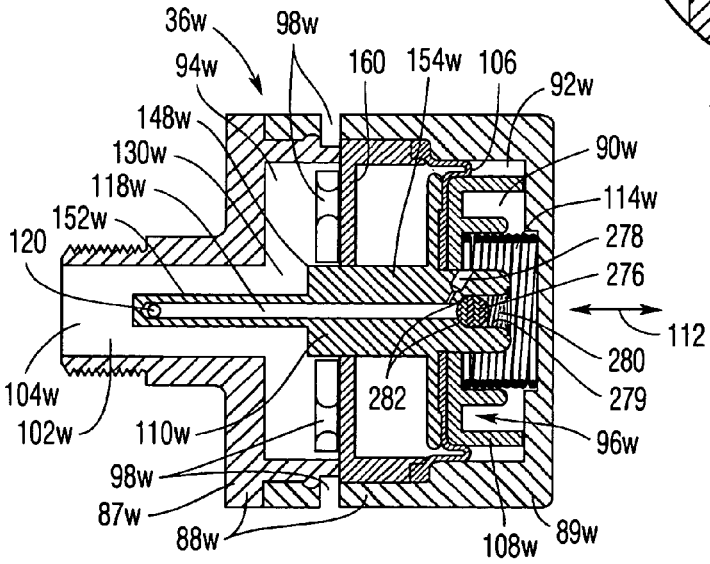
FIG. 26C is a side cross sectional view of the inlet control mechanism of FIG. 26A in a fully open position.

FIGS. 26A–C depict an inlet control mechanism 36*w* of the invention having a restriction comprising a restriction ball 276 positioned adjacent a diagonal orifice 278. The restriction ball 276 is sized to allow air to pass between the restriction ball 276 and a ball chamber 279 of the vent passageway and allows a substantially greater amount of air to move between the vent passageway 118*w* and valve control chamber 92*w* than does the diagonal orifice 278 when the restriction ball 276 is not in contact a passageway cone 282. The restriction ball 276 is biased with a ball spring 280 located within the ball chamber 279 to engage and seal against the passageway cone 282. FIG. 26A depicts the inlet control mechanism 36*w* in a closed position that prevents air from moving from the valve inlet chamber 94*w* to the valve outlet 102*w*. FIG. 26B depicts a magnified view of the restriction when in the closed position depicted in FIG. 26A.

Consider the inlet control mechanism 36*w* prior to or at the start of operation of a compressor unit. As air begins to be drawn through the vent passageway 118*w*, the combined biasing force of the ball spring 280 and the suction force of the compressor unit through the vent passageway 118*w* force the restriction ball 276 against the passageway cone 282, preventing the movement of air from the control chamber 92*w* past the restriction ball 276 within the vent passageway 118*w*. The suction force of the compressor unit does draw air through the diagonal orifice 278. However, a comparatively small amount of air is permitted to move between the vent passageway 118*w* and valve control chamber 92*w* with the restriction ball 276 sealing against the passageway cone 282 due to the relatively small size of the diagonal orifice 278. The diagonal orifice 278 continues to restrict the rate at which air can be drawn from the valve control chamber 92*w* as the inlet control mechanism 36*w* moves to an open position, such as the position depicted in FIG. 26C.

Now, referring to FIG. 26C, consider the inlet control mechanism 36*w* as the compressor unit ceases operation. The valve inlet chamber 94*w*, being open to the environment surrounding the compressor unit, allows air from the atmosphere to enter the vent passageway 118*w* through the stem hole 120. Atmospheric pressure in the vent passageway 118*w* forces the restriction ball 276, against the bias of the ball spring 280, to move away from the passageway cone 282. Since the restriction ball 276 is sized to allow for a substantially greater amount of air to move between the vent passageway 118*w* and valve control chamber 92*w* than does the diagonal orifice 278, the movement of the restriction ball 276 away from passageway cone 282 allows air to enter the valve control chamber 92*w* relatively quickly. This further allows the valve control chamber 92*w* to quickly return to atmospheric pressure as the piston assembly 96*w* moves back toward the valve inlet chamber 94*w* under the force of the spring biasing member 114*w*, eventually returning the inlet control mechanism 36*w* to a closed position as depicted in FIG. 26A.

Figure 27A:
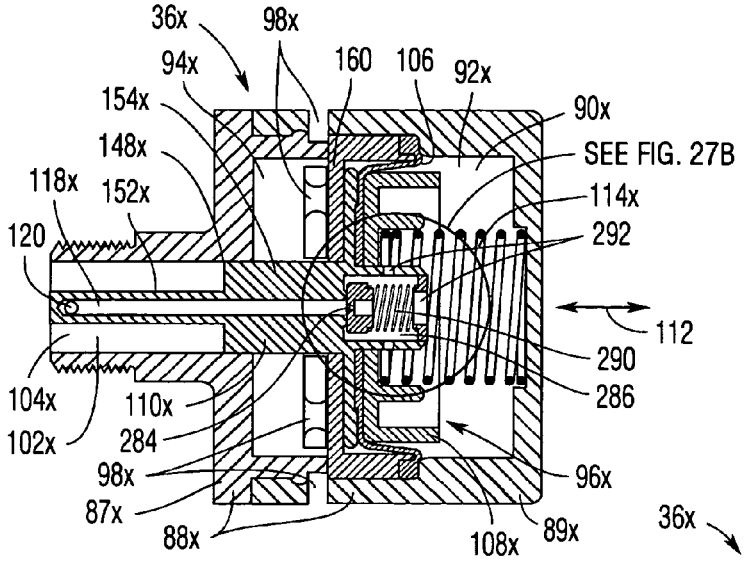
FIG. 27A is a side cross sectional view of an automatic inlet control mechanism according to one embodiment of the invention in a fully closed position.
Figure 27B:
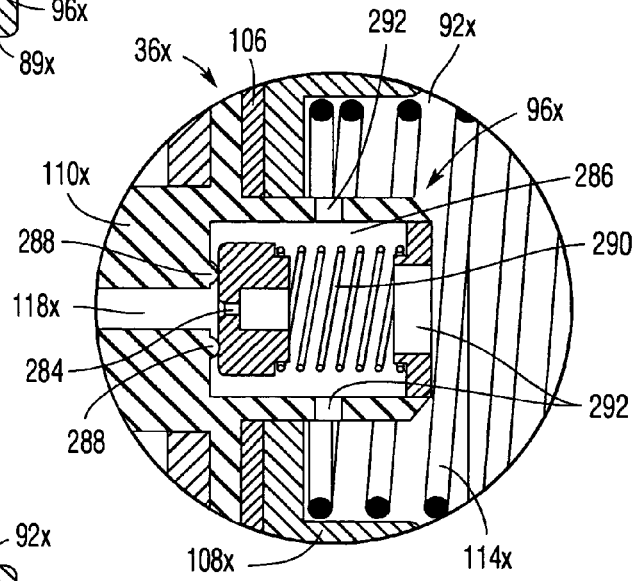
FIG. 27B is a magnified side cross sectional view of the restriction in the vent passageway of the inlet control mechanism of FIG. 27A.
Figure 27C:
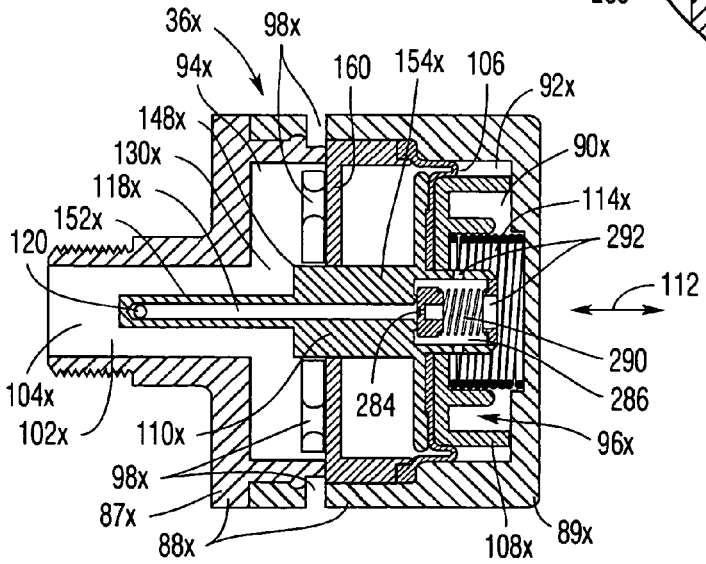
FIG. 27C is a side cross sectional view of the inlet control mechanism of FIG. 27A in a fully open position.

FIGS. 27A–C depict an inlet control mechanism 36*x* of the invention having a restriction comprising a reciprocating orifice 284 positioned within an orifice chamber 286 that forms a segment of the vent passageway 118*x*. The reciprocating orifice 284 is biased to rest against passageway seals 288 with an orifice spring 290. Air passages 292 allow for the unobstructed flow of air between the orifice chamber 286 and valve control chamber 92*x*. The reciprocating orifice 284 is sized to allow a substantially smaller amount of air to pass through the vent passageway 118*x* to the valve control chamber 92$x$ when the reciprocating orifice 284 is resting against the passageway seals 288 than when the force of air pushes the reciprocating orifice 284 against its bias away from the passageway seals 288. FIG. 27A depicts the inlet control mechanism 36$x$ in a closed position that prevents air from moving from the valve inlet chamber 94$x$ to the valve outlet 102$x$. FIG. 27B depicts a magnified view of the restriction when in the closed position depicted in FIG. 27A.

Consider the inlet control mechanism 36$x$ prior to or at the start of operation of a compressor unit. As air begins to be drawn through the vent passageway 118$x$ into the compression cylinder of the compressor unit, the combined biasing force of the orifice spring 290 and the suction force of the compressor unit through the vent passageway 118$x$ force the reciprocating orifice 284 against the passageway seals 288, restricting the movement of air from the control chamber 92$x$ to the vent passageway 118$x$ through the reciprocating orifice 284. However, due to the sizing of the reciprocating orifice 284, the amount of air that is permitted to move through the reciprocating orifice 284 between valve control chamber 92$x$ and the vent passageway 118$x$ is substantially less than the amount that would be permitted if the reciprocating orifice 284 were withdrawn from contact with the passageway seals 288. The reciprocating orifice 284 continues to restrict the rate at which air can be drawn from the valve control chamber 92$x$ as the inlet control mechanism 36$x$ moves to an open position, such as the position depicted in FIG. 27C.

Now, referring to FIG. 27C, consider the inlet control mechanism 36$x$ as the compressor unit ceases operation. The valve inlet chamber 94$x$, being open to the environment surrounding the compressor unit, allows air from the atmosphere to enter the vent passageway 118$x$ through the stem hole 120. Atmospheric pressure in the vent passageway 118$x$ forces the reciprocating orifice 284, against the bias of the orifice spring 290, to move away from the passageway seals 288. Since a substantially greater amount of air can move between the vent passageway 118$x$ and valve control chamber 92$x$ when the reciprocating orifice 284 is not in contact with the passageway seals 288 than when air is limited to movement through the reciprocating orifice 284, air enters the valve control chamber 92$x$ from the vent passageway 118$x$ relatively quickly. This further allows the valve control chamber 92$x$ to quickly return to atmospheric pressure as the piston assembly 96$x$ moves back toward the valve inlet chamber 94$x$ under the force of the spring biasing member 114$x$, eventually returning the inlet control mechanism 36$x$ to a closed position as depicted in FIG. 26A 27A.

Figure 28A:
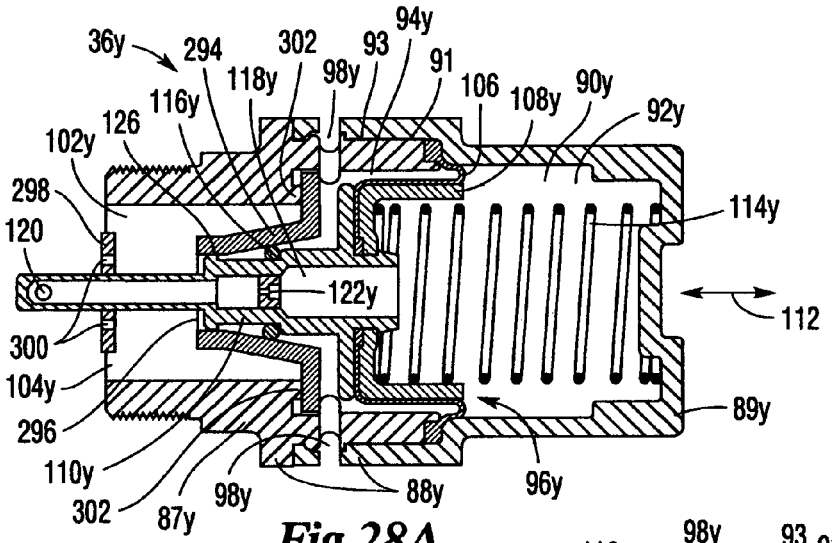
FIG. 28A is a side cross sectional view of an automatic inlet control mechanism according to one embodiment of the invention at a closed position.
Figure 28B:
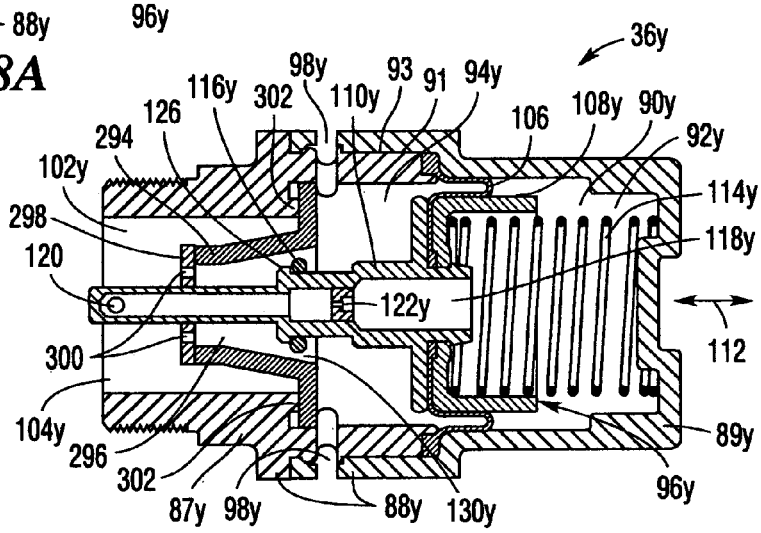
FIG. 28B is a side cross sectional view of the inlet control mechanism of FIG. 28A at an intermediate position.
Figure 28C:
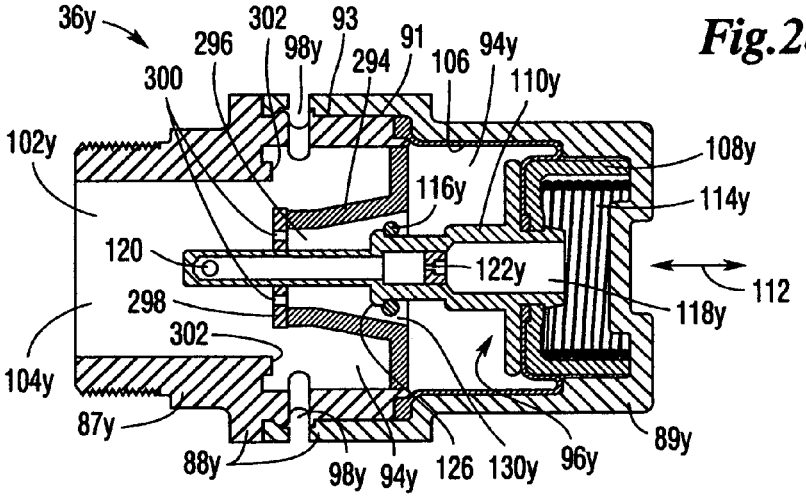
FIG. 28C is a side cross sectional view of the inlet control mechanism of FIG. 28A at an open position.

The invention can also be constructed to incorporate multiple, separately reciprocating members that act in concert to reduce compression loading. For example, FIGS. 28A–C depict an inlet control mechanism 36$y$ having a reciprocating tapered section 294 that is positioned to reciprocate within the valve inlet chamber 94$y$ and valve outlet 102$y$. A separate piston assembly 96$y$ reciprocates between the valve inlet chamber 94$y$ and valve control chamber 92$y$, the piston assembly 96$y$ including a valve stem 110$y$ that extends to the valve outlet 102$y$. When the inlet control mechanism 36$y$ is in a closed position such as that depicted in FIG. 28A, the valve stem 110$y$ extends through the valve outlet hole 104$y$. The valve stem 110$y$ also extends through a section hole 296 located at the narrow end of the reciprocating tapered section 294. A section clip 298 is positioned to reciprocate with the valve stem 110$y$ and is configured to engage the narrow end of the reciprocating tapered section 294 near the section hole 296 when the inlet control mechanism 36$y$ is at a closed, intermediate position that is depicted in FIG. 28B. The section clip 298 is further configured to cause the reciprocating tapered section 294 to move with the valve piston assembly 96$y$ as it continues to mover toward the valve control chamber 92$y$ to the open position depicted in FIG. 28C. The section clip 298 includes clip holes 300 that allow air to pass in a restricted manner through, the section clip 298 from the valve inlet chamber 94$y$ to the valve outlet 102$y$ when the section clip 298 is in engagement with the reciprocating tapered section 294.

Consider the inlet control mechanism 36$y$ prior to or at the start of operation of a compressor unit. As air begins to be drawn through the vent passageway 118$y$ from the valve control chamber 92$y$ into the compression cylinder of the compressor unit, the atmospheric pressure in the valve inlet chamber 94$y$ begins to force the piston assembly 96$y$ toward the valve control chamber 92$y$. Air is removed by the compressor pump from the valve outlet 102$y$ while atmospheric pressure from the valve inlet chamber 94$y$ is prevented from entering the valve outlet 102$y$ by the reciprocating tapered section 294, the valve stem 110$y$, and the valve stem seal 116$y$. Although there is a resulting pressure differential that exists between the valve inlet chamber 94$y$ and the valve outlet 102$y$, the reciprocating tapered section 294 does not move further toward the valve outlet hole 104$y$ past the position depicted in FIG. 28A since such movement is restricted by a section seat 302 positioned on the inside surface of the inlet segment 87$y$.

As the piston assembly 96$y$ continues to move toward the valve control chamber 92$y$, the valve stem seal 116$y$, moving along the sliding surface 124, continues to prevent air from moving from the valve inlet chamber 94$y$ to the valve outlet 102$y$ until the lip 126 of the valve stem 110$y$ withdraws the valve stem seal 116$y$ from its contact with the reciprocating tapered section 294. Referring to FIG. 28B, this creates an air space 130$y$ between the valve stem seal 116$y$ and reciprocating tapered section 294. The section clip 298 contacts the reciprocating tapered section 294 near the section hole 296, but allows air to pass from the section hole 296 to the valve outlet 102$y$ through clip holes 300. Air is therefore permitted to flow from the valve inlet chamber 94$y$ to the valve outlet 102$y$ when the inlet control mechanism 36$y$ is in the position depicted in FIG. 28B, the amount of air permitted to pass depending on the size and number of clip holes 300.

As the piston assembly 96$y$ continues to move toward the valve control chamber 92$y$, the section clip 298 forces the reciprocating tapered section 294 to withdraw from its contact with the section seat 302 toward the position depicted in FIG. 28C. As the piston assembly 96$y$ and reciprocating tapered section 294 move toward the valve control chamber 92$y$, the movement is further restricted by the rate at which air is permitted to move through the clip holes 300, increasing the amount of time required for the inlet control mechanism 36$y$ to move to the position depicted in FIG. 28A. Movement to this position opens the valve inlet chamber 94$y$ to the valve inlet 98$y$, thereby opening the valve outlet 102$y$ to atmospheric pressure and allowing air from the environment to enter the compressor pump for compression. Thus, there is sequential opening of the sealing action that is created both by the valve stem seal 116$y$ and by the reciprocating tapered section 294 and section clip 298.

By incorporating the additional actuation and reciprocation of the reciprocating tapered section 294, the load of actuation is divided into smaller portions, distributing the total load more evenly through the stroke range of the valve piston assembly 96*y*. This is due to the elimination of a need for a large pressure differential-created force at a single point in the stroke range of the valve piston 108*y*. As a result, the inlet control mechanism 36*y* can have a relatively small construction while performing the equivalent compression unloading of larger inlet control mechanisms.

It will be further appreciated that some embodiments of the invention allow for incorporation of an inlet control mechanism in which the valve inlet chamber, valve control chamber, portions of the valve cavity and/or other components are located in positions that are not located along a common valve axis. For example, FIGS. 29A and B depict a compressor pump 48*za* of the invention having an automatic inlet control mechanism 36*za* that includes a mechanism body 88*za* integrated into the structure of the compressor pump 48*za*.

The mechanism body 88*za* includes a removable portion 304*za* that is threaded to allow for removal and installation of components of the inlet control mechanism 36*za* in the compressor pump 48*za*. An external filter 166 is attached to a valve inlet 98*za* leading to a valve inlet chamber 94*za*. The valve inlet chamber 94*za* is part of a valve cavity 90*za* that extends from the valve inlet 98*za* to a valve outlet hole 104*za* and further includes a valve control chamber 92*za*, vent passageway 308, and atmosphere chamber 310*za*. The atmosphere chamber 310*za* is connected to the environment surrounding the inlet control mechanism 36*za* with an atmosphere inlet 316 that is sufficiently large to maintain atmospheric pressure within the atmosphere chamber 310*za*. The vent passageway 308 provides a route for the flow of air between the valve control chamber 92*za* and valve outlet 102*za* and includes an orifice 122*za* to restrict airflow therein.

Figure 29A:
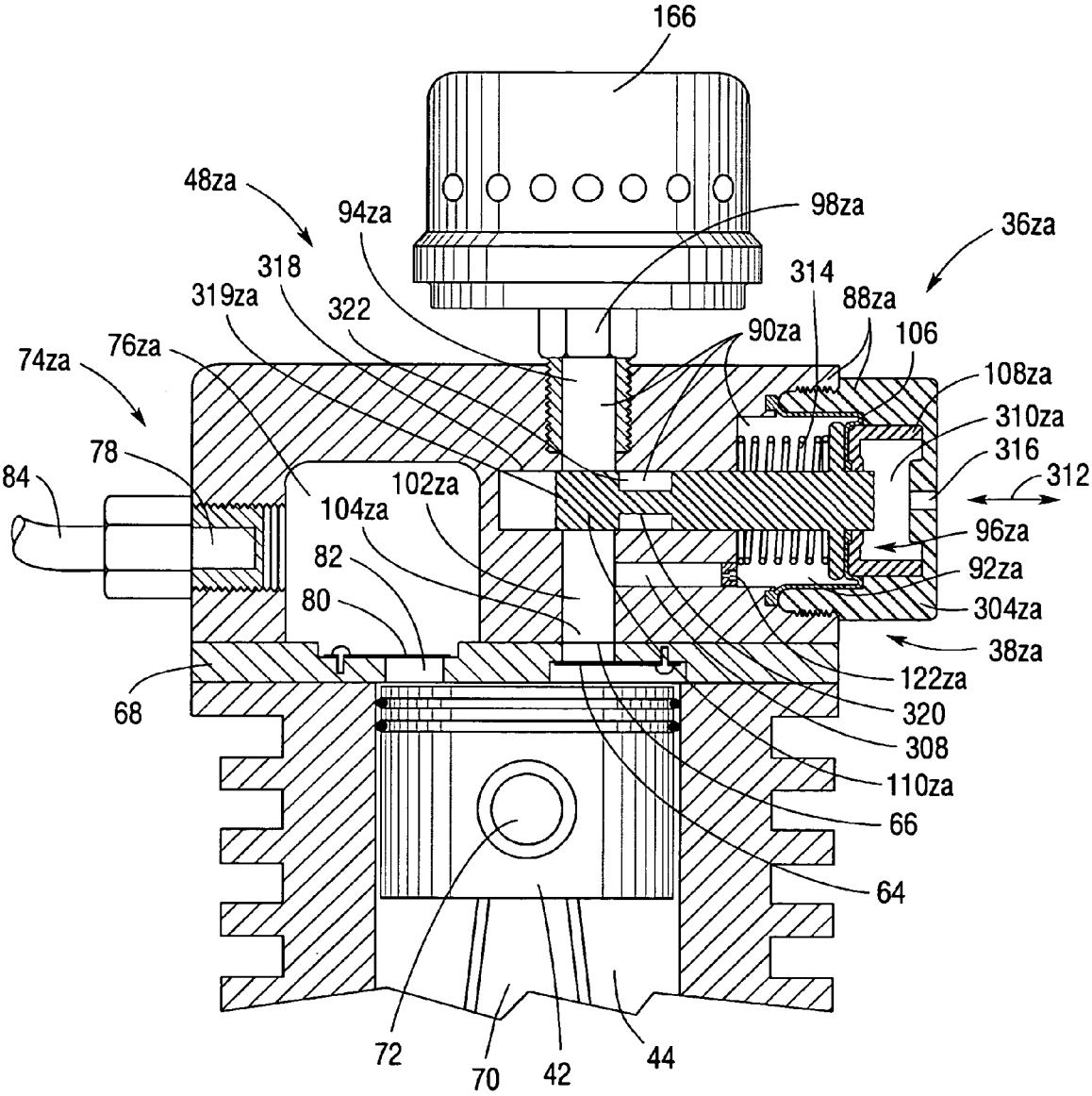
FIG. 29A is a side cross sectional view of a compressor pump having an automatic inlet control mechanism according to one embodiment of the invention in a closed position.

A valve piston assembly 96*za* is positioned to reciprocate along a valve axis 312 and includes a valve piston 108*za*, valve stem 110*za*, and diaphragm 106. The valve stem 110*za* has an elongated cylindrical section 319*za* that is sufficiently long to extend through a reduced diameter portion 318 of the valve cavity 90*za* to a location that is between the valve inlet chamber 94*za* and valve outlet 102*za*. The elongated cylindrical section 319*za* has a cylindrical shaped, reduced dimensional portion 320 that creates an air gap 322 with the adjacent valve cavity 90*za*. The air gap 322 extends 360 degrees around the reduced dimensional portion 320 along a segment of the valve axis 312. The valve piston 108*za* and diaphragm 106 separate the valve control chamber 92*za* from the atmosphere chamber 310*za*, the diaphragm 106 forming a movable seal that prevents air from moving directly between the two chambers. The valve piston 108*za* and valve piston assembly 96*za* are biased with a biasing spring 314 to a closed position that is depicted in FIG. 29A. In this closed position, the valve stem 110*za* extends between the inlet chamber 94*za* and valve outlet 102*za* to block the flow of air therebetween.

Consider the inlet control mechanism 36*za* and compressor pump 48*za* before or at the start of reciprocation of the piston 42. As the piston 42 begins to reciprocate, air is quickly removed from the valve outlet 102*za* and the cylindrical extension 319*za* of the valve stem 110*za* restricts air from the environment from entering the valve outlet 102*za* from the valve inlet chamber 94*za*. Air is drawn from the valve control chamber 92*za* through the vent passageway 122*za* and becomes the primary source of air to the compression cylinder 44, though the amount of air that can be drawn is substantially restricted by the orifice 122*za*, substantially reducing compression loading of piston 42.

Figure 29B:
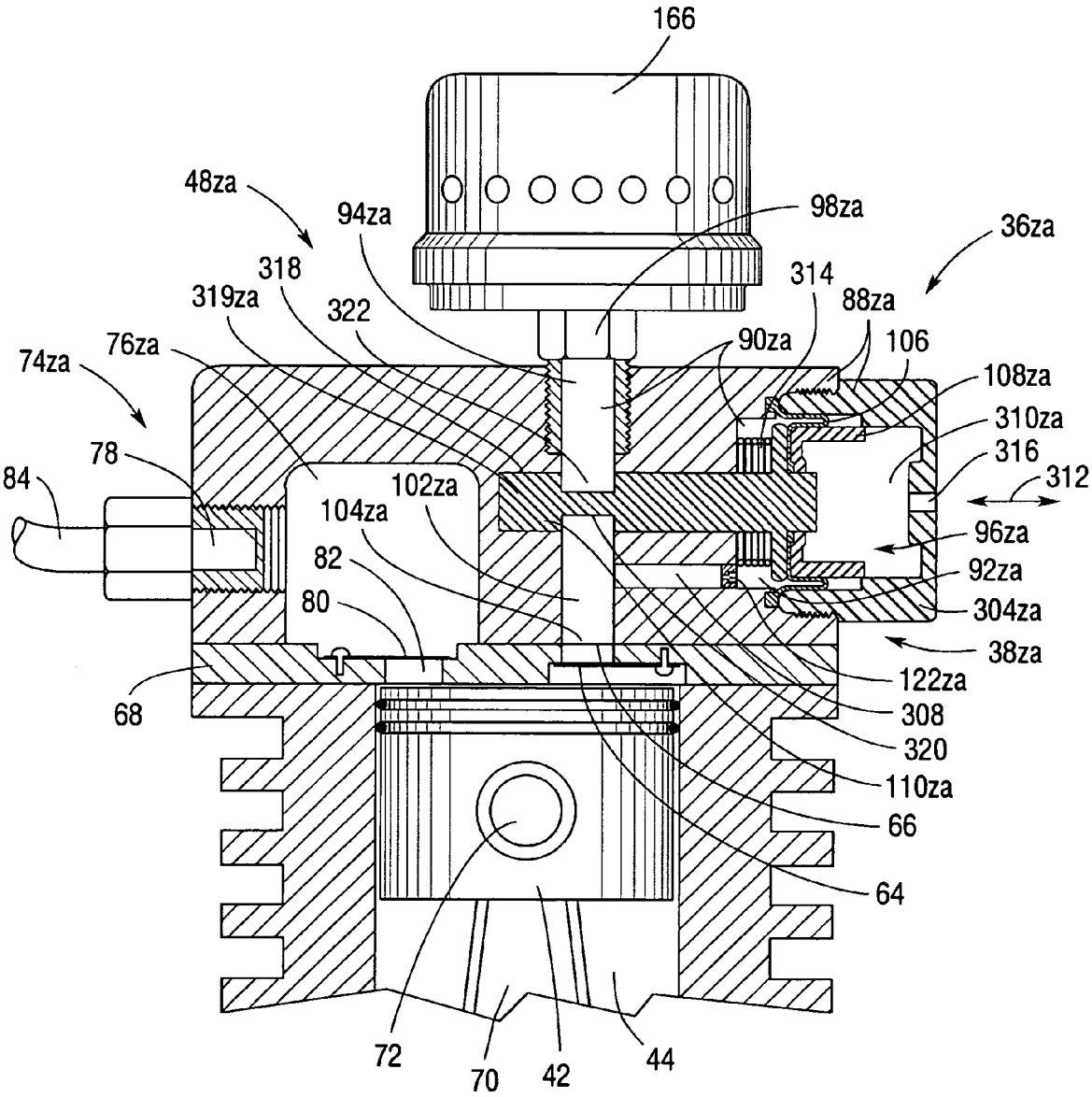
FIG. 29B is a side cross sectional view of the compressor pump of FIG. 29A in an open position.

As air is drawn from the valve control chamber 92*za* a pressure differential between the valve control chamber 92*za* and atmosphere chamber 310*za* forces the piston assembly 96*za* away from the atmosphere chamber 310*za* toward the open position depicted in FIG. 29B. However, the valve stem 110*za* continues to restrict atmospheric pressure from the valve outlet 102*za* from entering the valve inlet chamber 94*za* until the reduced radius portion 320 of the valve stem 110*za* moves to a position that opens the air gap 322 to both the valve inlet chamber 94*za* and valve outlet 102*za*.

Once the valve stem 110*za* moves to an open position, such as the position depicted in FIG. 29B, air is permitted to flow 360 degrees around the reduced radius portion 320 of valve stem 110*za*, through the air gap 322, to the valve outlet 102*za*, restoring compression loading to the piston 42. The biasing spring 314 returns the valve piston assembly 96*zb* to the position depicted in FIG. 29A once the piston 42 ceases reciprocating within the compression cylinder 44.

Figure 30A:
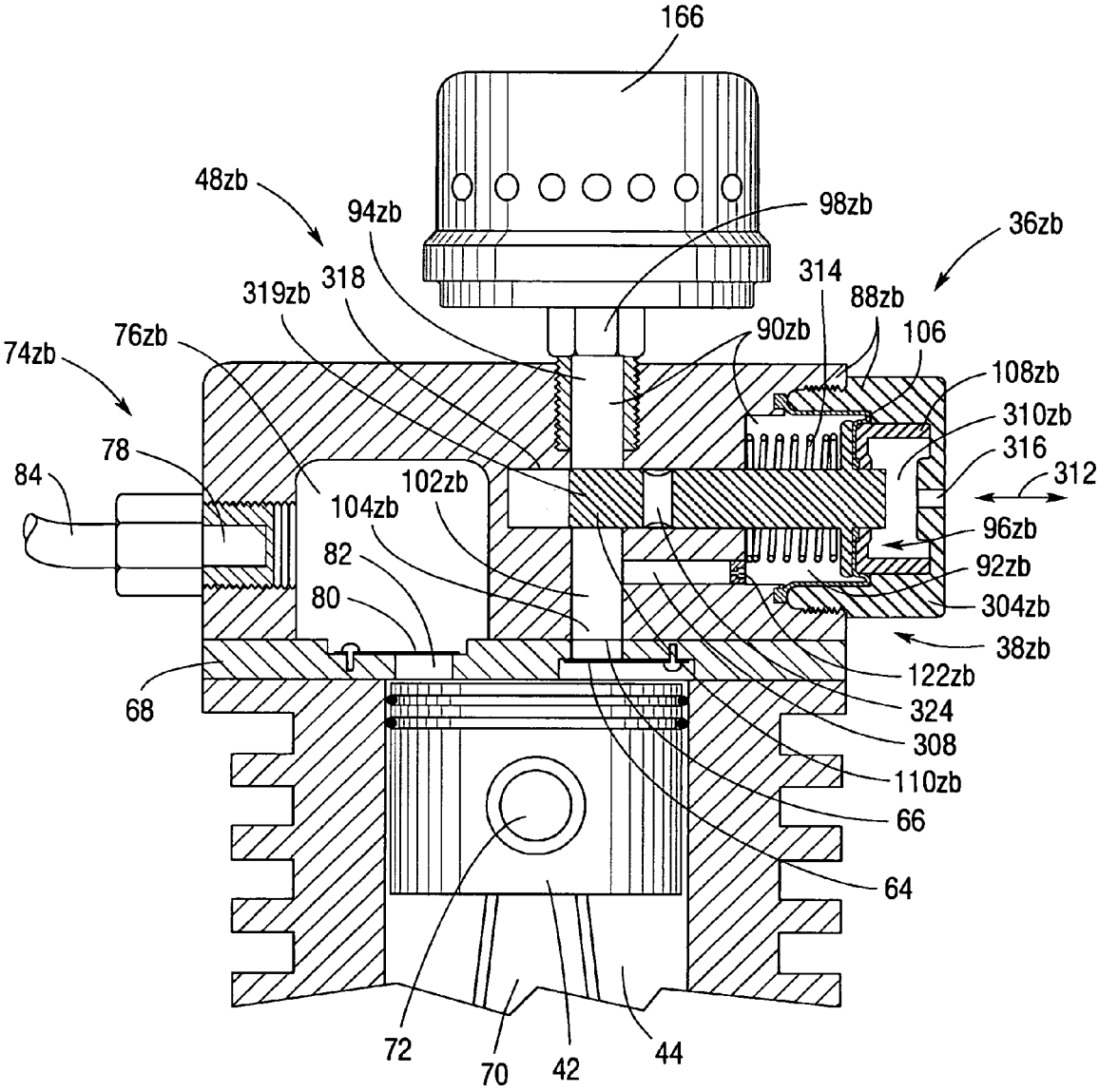
FIG. 30A is a side cross sectional view of a compressor pump having an automatic inlet control mechanism according to one embodiment of the invention in a closed position.
Figure 30B:
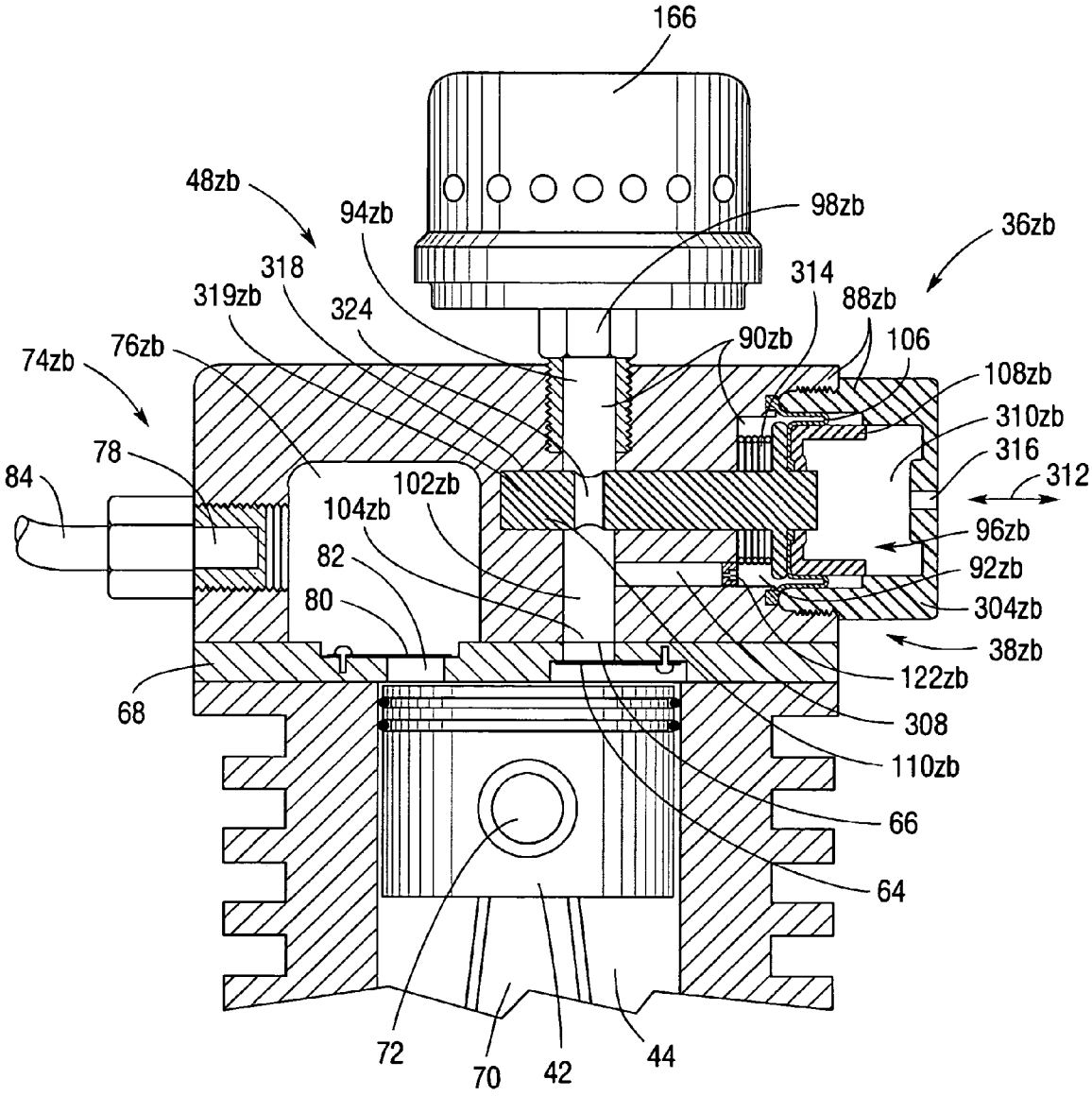
FIG. 30B is a side cross sectional view of the compressor pump of FIG. 30A in an open position.

FIGS. 30A and B depict a compressor pump 48*zb* of the invention having an automatic inlet control mechanism 36*zb* that includes a valve stem 110*zb* having an air bore 324 extending through the elongated cylindrical extension 319*zb* that allows air to pass through the valve stem 110*zb* only when the inlet control mechanism 36*zb* is in an open position. Before or at the time the piston 42 begins to reciprocate, the valve stem 110*zb* is biased with the biasing spring 314 to the closed position depicted in FIG. 30A. In this position, the air bore 324 is not open to either the valve inlet chamber 94*zb* or the valve outlet 102*zb*, the cylindrical extension 319*zb* of the valve stem 110*zb* blocking the flow of air from the environment to the compression cylinder inlet 38*zb*However, as the piston 42 begins to reciprocate and draws air from the vent control chamber 92*zb* through the vent passageway 308 and orifice 122*zb*, the piston assembly 96*zb* moves toward an open position, such as that depicted in FIG. 30B. In an open position, the air bore 324 moves to a location that is adjacent and open to both the valve inlet chamber 94*zb* and the valve outlet 102*zb*, allowing air to pass through the air bore 324 from the environment to the compression cylinder inlet 38*zb* for compression. Once reciprocation of the piston 42 ceases, the biasing spring 314 moves the valve stem 319*zb* back to the closed position depicted in FIG. 30A.

Those skilled in the art will recognize that the various features of this invention described above can be used in various combinations with other elements without departing from the scope of the invention. Thus, the appended claims are intended to be interpreted to cover such equivalent air compressor units as do not depart from the spirit and scope of the invention.

The invention claim is:

1. An automatic inlet control mechanism for connection to a compression cylinder inlet of a reciprocating air compressor unit which produces compressed air at a predetermined rate of production through the use of a piston that reciprocates within a compression cylinder, said inlet control mechanism comprising:

a mechanism body having a valve cavity, said valve cavity having a valve control chamber and a valve inlet chamber, a valve piston assembly positioned between said valve control chamber and said valve inlet chamber and constructed to prevent air flow between said valve control chamber and said valve inlet chamber;

a valve inlet positioned to allow air to flow from the atmosphere surrounding the compressor unit and into said valve inlet chamber;

a valve outlet having a valve outlet hole positioned to allow air to flow from said valve inlet chamber to the compression cylinder inlet, said valve outlet hole having a size sufficient to enable the compressor unit to produce compressed air at its predetermined rate of production;

said valve piston assembly including a valve piston, said valve piston assembly being positioned to reciprocate within said valve cavity, a biasing member having a force which moves said valve piston assembly to a position within said inlet control mechanism which prevents air from flowing from said valve inlet chamber through said valve outlet when the compressor unit is not drawing air through said valve outlet;

a vent passageway allowing air to flow between said valve control chamber and the compression cylinder inlet;

said vent passageway comprising at least one source of air to the compression cylinder inlet for a period of time after the compressor unit begins to draw air through the compression cylinder inlet, following the movement of said valve piston assembly to a position which prevents air from flowing from said valve inlet chamber through said valve outlet;

said vent passageway including a vent orifice which restricts the flow of air from said valve control chamber to said compression cylinder inlet; and said vent orifice having an orifice size which allows air to be drawn, by the compressor unit, from said valve control chamber to the compression cylinder at a preselected rate which causes the compressor unit to produce compressed air at less than its predetermined rate of production, said valve control chamber having a volume which enables air to be drawn through said orifice from said valve control chamber by the compressor unit over a preselected time period until air within said valve control chamber is at a reduced pressure level which enables atmospheric pressure on said valve piston assembly from within said valve inlet chamber to overcome the force of said biasing member sufficiently to move said valve piston assembly away from the position at which said valve piston assembly prevents air from flowing from said valve inlet chamber and through said valve outlet to enable the compressor unit to produce compressed air at its predetermined rate of production.

2. The automatic inlet control mechanism of claim 1 wherein said valve piston assembly includes a diaphragm positioned between said valve control chamber and said valve inlet chamber, said diaphragm being constructed to prevent air flow between said valve control chamber and said valve inlet chamber, said diaphragm being positioned to move toward said valve control chamber when air pressure within said valve inlet chamber is greater than air pressure within said valve control chamber, said diaphragm being positioned to move toward said valve inlet chamber when air pressure within said valve control chamber is greater than the air pressure within said valve inlet chamber.

3. The automatic inlet control mechanism of claim 1 wherein said vent passageway is included within said valve piston assembly, said vent orifice being located at a position in said valve piston assembly to enable said vent orifice to restrict the flow of air from said valve control chamber to the compression cylinder inlet as said valve piston assembly reciprocates within said inlet control mechanism.

4. The automatic inlet control mechanism of claim 1 wherein said valve piston assembly includes a valve stem, said vent passageway being included within said valve piston assembly and extending through said valve stem, said vent orifice being located at a position in said valve piston assembly to enable said vent orifice to restrict the flow of air from said valve control chamber to the compression cylinder inlet as said valve piston assembly reciprocates within said inlet control mechanism.

5. The automatic inlet control mechanism of claim 1 wherein said valve outlet includes a valve outlet hole having a tapered portion, said tapered portion having at least a first inner diameter and a second inner diameter, said first inner diameter of said tapered portion being larger than said second inner diameter and being located at a position that is closer to said valve inlet chamber than said second inner diameter when said mechanism is installed, said second inner diameter being sufficiently small to form an air restriction against said valve piston assembly when said valve piston assembly is at a position within said inlet control mechanism which prevents air from flowing from said valve inlet chamber through said valve outlet, said first inner diameter of said tapered portion being sufficiently large to allow air to pass between said tapered portion of said valve outlet and said valve piston assembly when said valve piston assembly is at a position within said inlet control mechanism which allows air to flow from said valve inlet chamber through said valve outlet.

6. The automatic inlet control mechanism of claim 1 wherein said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to the compression cylinder inlet causing said sliding seal to move away from said valve outlet to allow air to flow to the compression cylinder inlet.

7. The automatic inlet control mechanism of claim 1 wherein said valve inlet includes a filter to remove impurities from air that passes through said valve inlet and enters said valve inlet chamber.

8. The automatic inlet control mechanism of claim 1 wherein said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to the compression cylinder inlet causing said sliding seal to move away from said valve outlet to allow air to flow to the compression cylinder inlet, said valve inlet including a filter to remove impurities from air that passes through said valve inlet and enters said valve inlet chamber.

9. The automatic inlet control mechanism of claim 1 wherein the compression cylinder inlet includes a cylinder inlet chamber for receiving air from the compression cylinder inlet before the air enters the compression cylinder, said vent passageway being positioned to allow for air to flow, outside said valve piston assembly, directly between said valve control chamber and the cylinder inlet chamber.

10. The automatic inlet control mechanism of claim 1 wherein:

the compression cylinder inlet includes a cylinder inlet chamber for receiving air from the compression cylinder inlet before the air enters the compression cylinder, said vent passageway being positioned to allow for air to flow, outside said valve piston assembly, directly between said valve control chamber and the cylinder inlet chamber; and said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to the compression cylinder inlet causing said sliding seal to move away from said valve outlet to allow air to flow to the compression cylinder inlet.

11. The automatic inlet control mechanism of claim 1 wherein the compression cylinder inlet includes a cylinder inlet chamber for receiving air before the air from the compression cylinder inlet enters the compression cylinder, said automatic inlet control mechanism being located at least partially within the cylinder inlet chamber.

12. The automatic inlet control mechanism of claim 1 wherein: the compression cylinder inlet includes a cylinder inlet chamber for receiving air before the air from the compression cylinder inlet enters the compression cylinder, said automatic inlet control mechanism being located at least partially within the cylinder inlet chamber; and said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to the compression cylinder inlet causing said sliding seal to move away from said valve outlet to allow air to flow to the compression cylinder inlet.

13. An automatic inlet control mechanism for connection to a compression cylinder inlet of a reciprocating air compressor unit which produces compressed air at a predetermined rate of production through the use of a piston that reciprocates within a compression cylinder, said inlet control mechanism comprising:

a mechanism body having a valve cavity, said valve cavity having a valve control chamber and a valve inlet chamber, a valve piston assembly positioned between said valve control chamber and said valve inlet chamber and constmcted to prevent air flow between said valve control chamber and said valve inlet chamber;

a valve inlet positioned to allow air to flow from the atmosphere surrounding the compressor unit and into said valve inlet chamber;

a valve outlet having a valve outlet hole positioned to allow air to flow from said valve inlet chamber to the compression cylinder inlet, said valve outlet hole having a size sufficient to enable the compressor unit to produce compressed air at its predetermined rate of production;

said valve piston assembly including a valve piston, said valve piston assembly being positioned to reciprocate within said valve cavity, a biasing member having a force which moves said valve piston assembly to a position within said inlet control mechanism which prevents air from flowing from said valve inlet chamber through said valve outlet when the compressor unit is not drawing air through said valve outlet;

a vent passageway allowing air to flow between said valve control chamber and the compression cylinder inlet;

said vent passageway comprising the primary source of air to the compression cylinder inlet for the period of time after the compressor unit begins to draw air through the compression cylinder inlet following the movement of said valve piston assembly to the position which prevents air from flowing from said valve inlet chamber through said valve outlet; said vent passageway including a vent orifice which restricts the flow of air from said valve control chamber to said compression cylinder inlet; and said vent orifice having an orifice size which allows air to be drawn, by the compressor unit, from said valve control chamber to the compression cylinder at a preselected rate which causes the compressor unit to produce compressed air at less than its predetermined rate of production, said valve control chamber having a volume which enables air to be drawn through said orifice from said valve control chamber by the compressor unit over a preselected time period until air within said valve control chamber is at a reduced pressure level which enables atmospheric pressure on said valve piston assembly from within said valve inlet chamber to overcome the force of said biasing member sufficiently to move said valve piston assembly away from the position at which said valve piston assembly prevents air from flowing from said valve inlet chamber and through said valve outlet to said compressor chamber inlet to enable the compressor unit to produce compressed air at its predetermined rate of production.

14. The automatic inlet control mechanism of claim 13 wherein said valve piston assembly includes a diaphragm positioned between said valve control chamber and said valve inlet chamber, said diaphragm being constructed to prevent air flow between said valve control chamber and said valve inlet chamber, said diaphragm being positioned to move toward said valve control chamber when air pressure within said valve inlet chamber is greater than air pressure within said valve control chamber, said diaphragm being positioned to move toward said valve inlet chamber when air pressure within said valve control chamber is greater than the air pressure within said valve inlet chamber.

15. The automatic inlet control mechanism of claim 13 wherein said vent passageway is included within said valve piston assembly, said vent orifice being located at a position in said valve piston assembly to enable said vent orifice to restrict the flow of air from said valve control chamber to the compression cylinder inlet as said valve piston assembly reciprocates within said inlet control mechanism.

16. The automatic inlet control mechanism of claim 13 wherein said valve piston assembly includes a valve stem, said vent passageway being included within said valve piston assembly and extending though said valve stem, said vent orifice being located at a position in said valve piston assembly to enable said vent orifice to restrict the flow of air from said valve control chamber to the compression cylinder inlet as said valve piston assembly reciprocates within said inlet control mechanism.

17. The automatic inlet control mechanism of claim 13 wherein said valve outlet includes a valve outlet hole having a tapered portion, said tapered portion having at least a first inner diameter and a second inner diameter, said first inner diameter of said tapered portion being larger than said second inner diameter and being located at a position that is closer to said valve inlet chamber than said second inner diameter when said mechanism is installed, said second inner diameter being sufficiently small to form an air restriction against said valve piston assembly when said valve piston assembly is at a position within said inlet control mechanism which prevents air from flowing from said valve inlet chamber though said valve outlet, said first inner diameter of said tapered portion being sufficiently large to allow air to pass between said tapered portion of said valve outlet and said valve piston assembly when said valve piston assembly is at a position within said inlet control mechanism which allows air to flow from said valve inlet chamber through said valve outlet.

18. The automatic inlet control mechanism of claim 13 wherein said valve piston assembly includes a valve stem and a sliding seal mounted to reciprocate along at least a portion of said valve stem to contact said valve outlet to cause said valve piston assembly to prevent air from flowing from said valve inlet chamber though said valve outlet when the compressor unit is not drawing air through said valve outlet, the movement of said valve piston assembly away from the position at which said valve piston assembly prevents air from flowing from said valve inlet chamber and through said valve outlet to the compression cylinder inlet causing said sliding seal to move away from said valve outlet to allow air to flow to the compression cylinder inlet.

19. The automatic inlet control mechanism of claim 13 wherein said valve inlet includes a filter to remove impurities from air that passes through said valve inlet and enters said valve inlet chamber.

20. The automatic inlet control mechanism of claim 13 wherein said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to the compression cylinder inlet causing said sliding seal to move away from said valve outlet to allow air to flow to the compression cylinder inlet, said valve inlet including a filter to remove impurities from air that passes through said valve inlet and enters said valve inlet chamber.

21. The automatic inlet control mechanism of claim 13 wherein the compression cylinder inlet includes a cylinder inlet chamber for receiving air before the air from the compression cylinder inlet enters the compression cylinder, said automatic inlet control mechanism being located at least partially within the cylinder inlet chamber.

22. The automatic inlet control mechanism of claim 13 wherein:

the compression cylinder inlet includes a cylinder inlet chamber for receiving air before the air from the compression cylinder inlet enters the compression cylinder, said automatic inlet control mechanism being located at least partially within the cylinder inlet chamber; and said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to the compression cylinder inlet causing said sliding seal to move away from said valve outlet to allow air to flow to the compression cylinder inlet.

23. An automatic inlet control mechanism for connection to a compression cylinder inlet of a reciprocating air compressor unit which produces compressed air at a predetermined rate of production through the use of a piston that reciprocates within a compression cylinder, said inlet control mechanism comprising:

a mechanism body having a valve cavity, said valve cavity having a valve control chamber and a valve inlet chamber, a valve piston assembly positioned between said valve control chamber and said valve inlet chamber and constructed to prevent air flow between said valve control chamber and said valve inlet chamber, said valve piston assembly including a diaphragm positioned between said valve control chamber and said valve inlet chamber, said diaphragm being constructed to prevent air flow between said valve control chamber and said valve inlet chamber, said diaphragm being positioned to move toward said valve control chamber when air pressure within said valve inlet chamber is greater than air pressure within said valve control chamber, said diaphragm being positioned to move toward said valve inlet chamber when air pressure within said valve control chamber is greater than the air pressure within said valve inlet chamber;

a valve inlet positioned to allow air to flow from the atmosphere surrounding the compressor unit and into said valve inlet chamber;

a valve outlet having a valve outlet hole positioned to allow air to flow from said valve inlet chamber to the compression cylinder inlet, said valve outlet hole having a size sufficient to enable the compressor unit to produce compressed air at its predetermined rate of production;

a valve piston and a valve stem included in said valve piston assembly, said valve piston assembly being positioned to reciprocate within said valve cavity, a biasing member having a force which moves said valve piston assembly to a position within said inlet control mechanism which prevents air from flowing from said valve inlet chamber through said valve outlet when the compressor unit is not drawing air through said valve outlet;

a vent passageway included in said valve piston assembly, said vent passageway allowing air to flow between said valve control chamber and the compression cylinder inlet;

said vent passageway comprising at least one source of air to the compression cylinder inlet for a period of time after the compressor unit begins to draw air through the compression cylinder inlet, following the movement of said valve piston assembly to a position which prevents air from flowing from said valve inlet chamber through said valve outlet to the compression cylinder inlet;

a valve outlet hole having a tapered portion included in said valve outlet, said tapered portion having a first inner diameter and a second inner diameter, said first inner diameter of said tapered portion being larger than said second inner diameter and being located at a position that is closer to said valve inlet chamber than said second inner diameter when said inlet control mechanism is installed, said second inner diameter being sufficiently small to form an air restriction against said valve piston assembly when said valve piston assembly is at a position within said inlet control mechanism which prevents air from flowing from said valve inlet chamber through said valve outlet, said first inner diameter of said tapered portion being sufficiently large to allow air to pass between said tapered portion of said valve outlet hole and said valve piston assembly when said valve piston assembly is at a position within said inlet control mechanism which allows air to flow from said valve inlet chamber through said valve outlet;

said vent passageway including a vent orifice which restricts the flow of air from said valve control chamber to said compression cylinder inlet; and said vent orifice having an orifice size which allows air to be drawn by the compressor unit from said valve control chamber to the compression cylinder at a preselected rate which causes the compressor unit to produce compressed air at less than its predetennined rate of production, said valve control chamber having a volume which enables air to be drawn through said orifice from said valve control chamber by the compressor unit over a preselected time period until air within said valve control chamber is at a reduced pressure level which enables atmospheric pressure on the valve piston assembly from within the valve inlet chamber to overcome the force of said biasing member sufficiently to move said valve piston assembly away from the position at which said valve piston assembly prevents air from flowing from said valve inlet chamber through said valve outlet to enable the compressor unit to produce compressed air at its predetermined rate of production.

24. The automatic inlet control mechanism of claim 23 wherein said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to the compression cylinder inlet causing said sliding seal to move away from said valve outlet to allow air to flow to the compression cylinder inlet.

25. The automatic inlet control mechanism of claim 23 wherein said valve inlet includes a filter to remove impurities from air that passes through said valve inlet and enters said valve inlet chamber.

26. The automatic inlet control mechanism of claim 23 wherein said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to the compression cylinder inlet causing said sliding seal to move away from said valve outlet to allow air to flow to the compression cylinder inlet, said valve inlet including a filter to remove impurities from air that passes through said valve inlet and enters said valve inlet chamber.

27. An automatic inlet control mechanism for connection to a compression cylinder inlet of a reciprocating air compressor unit which produces compressed air at a predetermined rate of production through the use of a piston that reciprocates within a compression cylinder, said inlet control mechanism comprising:

a mechanism body having a valve cavity, said valve cavity having a valve control chamber and a valve inlet chamber, a valve piston assembly positioned between said valve control chamber and said valve inlet chamber and constructed to prevent air flow between said valve control chamber and said valve inlet chamber, said valve piston assembly including a diaphragm positioned between said valve control chamber and said valve inlet chamber, said diaphragm being constructed to prevent air flow between said valve control chamber and said valve inlet chamber, said diaphragm being positioned to move toward said valve control chamber when air pressure within said valve inlet chamber is greater than air pressure within said valve control chamber, said diaphragm being positioned to move toward said valve inlet chamber when air pressure within said valve control chamber is greater than the air pressure within said valve inlet chamber;

a valve inlet positioned to allow air to flow from the atmosphere surrounding the compressor unit and into said valve inlet chamber;

a valve outlet having a valve outlet hole positioned to allow air to flow from said valve inlet chamber to the compression cylinder inlet, said valve outlet hole having a size sufficient to enable the compressor unit to produce compressed air at its predetermined rate of production;

a valve piston and a valve stem included in said valve piston assembly, said valve piston assembly being positioned to reciprocate within said valve cavity, a biasing member having a force which moves said valve piston assembly to a position within said inlet control mechanism which prevents air from flowing from said valve inlet chamber through said valve outlet when the compressor unit is not drawing air through said valve outlet;

a vent passageway included in said valve piston assembly, said vent passageway allowing air to flow between said valve control chamber and the compression cylinder inlet;

said vent passageway comprising the primary source of air to the compression cylinder inlet for a period of time after the compressor unit begins to draw air through the compression cylinder inlet, following the movement of said valve piston assembly to a position which prevents air from flowing from said valve inlet chamber through said valve outlet to the compression cylinder inlet;

a valve outlet hole having a tapered portion included in said valve outlet, said tapered portion having a first inner diameter and a second inner diameter, said first inner diameter of said tapered portion being larger than said second inner diameter and being located at a position that is closer to said valve inlet chamber than said second inner diameter when said inlet control mechanism is installed, said second inner diameter being sufficiently small to form an air restriction against said valve piston assembly when said valve piston assembly is at a position within said inlet control mechanism which prevents air from flowing from said valve inlet chamber through said valve outlet, said first inner diameter of said tapered portion being sufficiently large to allow air to pass between said tapered portion of said valve outlet hole and said valve piston assembly when said valve piston assembly is at a position within said inlet control mechanism which allows air to flow from said valve inlet chamber through said valve outlet;

said vent passageway including a vent orifice which restricts the flow of air from said valve control chamber to said compression cylinder inlet; and said vent orifice having an orifice size which allows air to be drawn by the compressor unit from said valve control chamber to the compression cylinder at a preselected rate which causes the compressor unit to produce compressed air at less than its predetermined rate of production, said valve control chamber having a volume which enables air to be drawn through said orifice from said valve control chamber by the compressor unit over a preselected time period until air within said valve control chamber is at a reduced pressure level which enables atmospheric pressure on the valve piston assembly from within the valve inlet chamber to overcome the force of said biasing member sufficiently to move said valve piston assembly away from the position at which said valve piston assembly prevents air from flowing from said valve inlet chamber through said valve outlet to enable the compressor unit to produce compressed air at its predetermined rate of production.

28. The automatic inlet control mechanism of claim 27 wherein said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to the compression cylinder inlet causing said sliding seal to move away from said valve outlet to allow air to flow to the compression cylinder inlet.

29. The automatic inlet control mechanism of claim 27 wherein said valve inlet includes a filter to remove impurities from air that passes through said valve inlet and enters said valve inlet chamber.

30. The automatic inlet control mechanism of claim 27 wherein said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to the compression cylinder inlet causing said sliding seal to move away from said valve outlet to allow air to flow to the compression cylinder inlet, said valve inlet including a filter to remove impurities from air that passes through said valve inlet and enters said valve inlet chamber.

31. A reciprocating air compressor unit which produces compressed air at a predetermined rate of production through the use of a piston that reciprocates within a compression cylinder, said air compressor unit comprising:

an automatic inlet control mechanism for connection to said compression cylinder inlet, said automatic inlet control having a mechanism body having a valve cavity, said valve cavity having a valve control chamber and a valve inlet chamber, a valve piston assembly positioned between said valve control chamber and said valve inlet chamber and constructed to prevent air flow between said valve control chamber and said valve inlet chamber;

a valve inlet positioned to allow air to flow from the atmosphere surrounding said compressor unit and into said valve inlet chamber;

a valve outlet having a valve outlet hole positioned to allow air to flow from said valve inlet chamber to said compression cylinder inlet, said valve outlet hole having a size sufficient to enable said compressor unit to produce compressed air at its predetermined rate of production;

said valve piston assembly including a valve piston and a valve stem, said valve piston assembly being positioned to reciprocate within said valve cavity, a biasing member having a force which moves said valve piston assembly to a position within said inlet control mechanism which prevents air from flowing from said valve inlet chamber through said valve outlet when said compressor unit is not drawing air through said valve outlet;

a vent passageway allowing air to flow between said valve control chamber and said compression cylinder inlet; said vent passageway comprising at least one source of air to said compression cylinder inlet for a period of time after said compressor unit begins to draw air though said compression cylinder inlet, following the movement of said valve piston assembly to a position which prevents air from flowing from said valve inlet chamber though said valve outlet to the compression cylinder inlet;

said vent passageway including a vent orifice which restricts the flow of air from said valve control chamber to said compression cylinder inlet; and said vent orifice having an orifice size which allows air to be drawn, by the compressor unit, from said valve control chamber to said compression cylinder at a preselected rate which causes said compressor unit to produce compressed air at less than its predetermined rate of production, said valve control chamber having a volume which enables air to be drawn though said orifice from said valve control chamber by said compressor unit over a preselected time period until air within said valve control chamber is at a reduced pressure level which enables atmospheric pressure on said valve piston assembly from within said valve inlet chamber to overcome the force of said biasing member sufficiently to move said valve piston assembly away from said position at which said valve piston assembly prevents air from flowing from said valve inlet chamber and through said valve outlet to said compression cylinder inlet enable said compressor unit to produce compressed air at its predetermined rate of production.

32. The reciprocating air compressor unit of claim 31 wherein said valve piston assembly includes a diaphragm positioned between said valve control chamber and said valve inlet chamber, said diaphagm being constructed to prevent air flow between said valve control chamber and said valve inlet chamber, said diaphragm being positioned to move toward said valve control chamber when air pressure within said valve inlet chamber is greater than air pressure within said valve control chamber, said diaphragm being positioned to move toward said valve inlet chamber when air pressure within said valve control chamber is greater than the air pressure within said valve inlet chamber.

33. The reciprocating air compressor unit of claim 31 wherein said vent passageway is included within said valve piston assembly, said vent orifice being located at a position in said valve piston assembly to enable said vent orifice to restrict the flow of air from said valve control chamber to said compression cylinder inlet as said valve piston assembly reciprocates within said inlet control mechanism.

34. The reciprocating air compressor unit of claim 31 wherein said valve piston assembly includes a valve stem, said vent passageway is included within said valve piston assembly and extends through said valve stem, said vent orifice being located at a position in said piston assembly to enable said vent orifice to restrict the flow of air from said valve control chamber to said compression cylinder inlet as said piston assembly reciprocates within said inlet control mechanism.

35. The reciprocating air compressor unit of claim 31 wherein said valve outlet includes a valve outlet hole having a tapered portion, said tapered portion having at least a first inner diameter and a second inner diameter, said first inner diameter of said tapered portion being larger than said second inner diameter and being located at a position that is closer to said valve inlet chamber than said second inner diameter, said second inner diameter being sufficiently small to form an air restriction against said valve piston assembly when said valve piston assembly is at a position within said inlet control mechanism which prevents air from flowing from said valve inlet chamber through said valve outlet, said first inner diameter of said tapered portion being sufficiently large to allow air to pass between said tapered portion of said valve outlet and said valve piston assembly when said valve piston assembly is at a position within said inlet control mechanism which allows air to flow from said valve inlet chamber through said valve outlet.

36. The reciprocating air compressor unit of claim 31 wherein said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to said compression cylinder inlet causing said sliding seal to move away from said valve outlet to allow air to flow to said compression cylinder inlet.

37. The reciprocating air compressor unit of claim 31 wherein said valve inlet includes a filter to remove impurities from air that passes through said valve inlet and enters said valve inlet chamber.

38. The reciprocating air compressor unit of claim 31 wherein said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to said compression cylinder inlet causing said sliding seal to move away from said valve outlet to allow air to flow to said compression cylinder inlet, said valve inlet including a filter to remove impurities from air that passes through said valve inlet and enters said valve inlet chamber.

39. The reciprocating air compressor unit of claim 31 wherein said compression cylinder inlet includes a cylinder inlet chamber for receiving air before the air from said compression cylinder inlet enters said compression cylinder, said automatic inlet control mechanism being located at least partially within said cylinder inlet chamber.

40. The reciprocating air compressor unit of claim 31 wherein:

said compression cylinder inlet includes a cylinder inlet chamber for receiving air before the air from said compression cylinder inlet enters said compression cylinder, said automatic inlet control mechanism being located at least partially within said cylinder inlet chamber; and said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to the compression cylinder inlet causing said sliding seal to move away from said valve outlet to allow air to flow to said compression cylinder inlet.

41. A reciprocating air compressor unit which produces compressed air at a predetermined rate of production through the use of a piston that reciprocates within a compression cylinder, said air compressor unit comprising:

an automatic inlet control mechanism for connection to said compression cylinder inlet, said automatic inlet control having a mechanism body having a valve cavity, said valve cavity having a valve control chamber and a valve inlet chamber, a valve piston assembly positioned between said valve control chamber and said valve inlet chamber and constructed to prevent air flow between said valve control chamber and said valve inlet chamber;

a valve inlet positioned to allow air to flow from the atmosphere surrounding said compressor unit and into said valve inlet chamber;

a valve outlet having a valve outlet hole positioned to allow air to flow from said valve inlet chamber to said compression cylinder inlet, said valve outlet hole having a size sufficient to enable said compressor unit to produce compressed air at its predetermined rate of production;

said valve piston assembly including a valve piston and a valve stem, said valve piston assembly being positioned to reciprocate within said valve cavity, a biasing member having a force which moves said valve piston assembly to a position within said inlet control mechanism which prevents air from flowing from said valve inlet chamber through said valve outlet when said compressor unit is not drawing air through said valve outlet;

a vent passageway allowing air to flow between said valve control chamber and said compression cylinder inlet; said vent passageway comprising the primary source of air to said compression cylinder inlet for a period of time after said compressor unit begins to draw air through said compression cylinder inlet following the movement of said valve piston assembly to a position which prevents air from flowing from said valve inlet chamber through said valve outlet to the compression cylinder inlet;

said vent passageway including a vent orifice which restricts the flow of air from said valve control chamber to said compression cylinder inlet; and said vent orifice having an orifice size which allows air to be drawn, by the compressor unit, from said valve control chamber to said compression cylinder at a preselected rate which causes said compressor unit to produce compressed air at less than its predetermined rate of production, said valve control chamber having a volume which enables air to be drawn through said orifice from said valve control chamber by said compressor unit over a preselected time period until air within said valve control chamber is at a reduced pressure level which enables atmospheric pressure on said valve piston assembly from within said valve inlet chamber to overcome the force of said biasing member sufficiently to move said valve piston assembly away from said position at which said valve piston assembly prevents air from flowing from said valve inlet chamber and through said valve outlet to said compression cylinder inlet to enable said compressor unit to produce compressed air at its predetermined rate of production.

42. The reciprocating air compressor unit of claim 41 wherein said valve piston assembly includes a diaphragm positioned between said valve control chamber and said valve inlet chamber, said diaphragm being constructed to prevent air flow between said valve control chamber and said valve inlet chamber, said diaphragm being positioned to move toward said valve control chamber when air pressure within said valve inlet chamber is greater than air pressure within said valve control chamber, said diaphragm being positioned to move toward said valve inlet chamber when air pressure within said valve control chamber is greater than the air pressure within said valve inlet chamber.

43. The reciprocating air compressor unit of claim 41 wherein said vent passageway is included within said valve piston assembly, said vent orifice being located at a position in said valve piston assembly to enable said vent orifice to restrict the flow of air from said valve control chamber to said compression cylinder inlet as said valve piston assembly reciprocates within said inlet control mechanism.

44. The reciprocating air compressor unit of claim 41 wherein said valve piston assembly includes a valve stem, said vent passageway is included within said valve piston assembly and extends through said valve stem, said vent orifice being located at a position in said piston assembly to enable said vent orifice to restrict the flow of air from said valve control chamber to said compression cylinder inlet as said piston assembly reciprocates within said inlet control mechanism.

45. The reciprocating air compressor unit of claim 41 wherein said valve outlet includes a valve outlet hole having a tapered portion, said tapered portion having at least a first inner diameter and a second inner diameter, said first inner diameter of said tapered portion being larger than said second inner diameter and being located at a position that is closer to said valve inlet chamber than said second inner diameter, said second inner diameter being sufficiently small to form an air restriction against said valve piston assembly when said valve piston assembly is at a position within said inlet control mechanism which prevents air from flowing from said valve inlet chamber through said valve outlet, said first inner diameter of said tapered portion being sufficiently large to allow air to pass between said tapered portion of said valve outlet and said valve piston assembly when said valve piston assembly is at a position within said inlet control mechanism which allows air to flow from said valve inlet chamber through said valve outlet.

46. The reciprocating air compressor unit of claim 41 wherein said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to said compression cylinder inlet causing said sliding seal to move away from said valve outlet to allow air to flow to said compression cylinder inlet.

47. The reciprocating air compressor unit of claim 41 wherein said valve inlet includes a filter to remove impurities from air that passes through said valve inlet and enters said valve inlet chamber.

48. The reciprocating air compressor unit of claim 41 wherein said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to said compression cylinder inlet causing said sliding seal to move away from said valve outlet to allow air to flow to said compression cylinder inlet, said valve inlet including a filter to remove impurities from air that passes through said valve inlet and enters said valve inlet chamber.

49. The reciprocating air compressor unit of claim 41 wherein said compression cylinder inlet includes a cylinder inlet chamber for receiving air before the air from said compression cylinder inlet enters said compression cylinder, said automatic inlet control mechanism being located at least partially within said cylinder inlet chamber.

50. The reciprocating air compressor unit of claim 41 wherein:

said compression cylinder inlet includes a cylinder inlet chamber for receiving air before the air from said compression cylinder inlet enters said compression cylinder, said automatic inlet control mechanism being located at least partially within said cylinder inlet chamber; and said valve piston assembly includes a valve stem and a sliding seal mounted to reciprocate along at least a portion of said valve stem to contact said valve outlet to cause said valve piston assembly to prevent air from flowing from said valve inlet chamber through said valve outlet when the compressor unit is not drawing air through said valve outlet, the movement of said valve piston assembly away from the position at which said valve piston assembly prevents air from flowing from said valve inlet chamber and through said valve outlet to the compression cylinder inlet causing said sliding seal to move away from said valve outlet to allow air to flow to said compression cylinder inlet.

51. A reciprocating air compressor unit which produces compressed air at a predetermined rate of production, said reciprocating air compressor unit comprising:

an automatic inlet control mechanism including a mechanism body having a valve cavity, said valve cavity having a valve control chamber and a valve inlet chamber, a valve piston assembly positioned between said valve control chamber and said valve inlet chamber and constructed to prevent air flow between said valve control chamber and said valve inlet chamber, said valve piston assembly including a diaphragm positioned between said valve control chamber and said valve inlet chamber, said diaphragm being constructed to prevent air flow between said valve control chamber and said valve inlet chamber, said diaphragm being positioned to move toward said valve control chamber when air pressure within said valve inlet chamber is greater than air pressure within said valve control chamber, said diaphragm being positioned to move toward said valve inlet chamber when air pressure within said valve control chamber is greater than the air pressure within said valve inlet chamber;

a valve inlet positioned to allow air to flow from the atmosphere surrounding said compressor unit and into said valve inlet chamber;

a valve outlet having a valve outlet hole positioned to allow air to flow from said valve inlet chamber to said compression cylinder inlet, said valve outlet hole having a size sufficient to enable said compressor unit to produce compressed air at its predetermined rate of production;

a valve piston and a valve stem included in said valve piston assembly, said valve piston assembly being positioned to reciprocate within said valve cavity, a biasing member having a force which moves said valve piston assembly to a position within said mechanism body which prevents air from flowing from said valve inlet chamber to said valve outlet when the compressor unit is not drawing air through said valve outlet;

a vent passageway included in said valve piston assembly, said vent passageway allowing air to flow between said valve control chamber and said compression cylinder inlet;

said vent passageway comprising the primary source of air to the compression cylinder inlet for a period of time after the compressor unit begins to draw air through said compression cylinder inlet following the movement of said valve piston assembly to a position which prevents air from flowing from said valve inlet chamber through said valve outlet;.

a valve outlet hole having a tapered portion included in said valve outlet, said tapered portion having a first inner diameter and a second inner diameter, said first inner diameter being larger than said second inner diameter, said first inner diameter of said tapered portion being located at a position that is closer to said valve inlet chamber than said second inner diameter of said tapered portion, said second inner diameter of said tapered portion being sufficiently small to form an air restriction against said valve piston assembly when said valve piston assembly is at a position within said mechanism body which prevents air from flowing from said valve inlet chamber through said valve outlet, said first inner diameter of said tapered portion being sufficiently large to allow air to pass between said tapered portion of said valve outlet hole and said valve piston assembly when said valve piston assembly is at a position within said mechanism body which allows air to flow from said valve inlet chamber through said valve outlet;

said vent passageway including a vent orifice which restricts the flow of air from said valve control chamber to said compression cylinder inlet; and said vent orifice having an orifice size which allows air to be drawn by said compressor unit from said valve control chamber to said compression cylinder at a preselected rate which causes the compressor unit to produce compressed air at less than its predetermined rate of production, said valve control chamber having a volume which enables air to be drawn through said orifice from said valve control chamber by said compressor unit over a preselected time period until air within said valve control chamber is at a reduced pressure level which enables atmospheric pressure on the valve piston assembly from within said valve inlet chamber to overcome the force of said biasing member sufficiently to move said valve piston assembly away from the position at which said valve piston assembly prevents air from flowing from said valve inlet chamber through said valve outlet to enable said compressor unit to produce compressed air at its predetermined rate of production.

52. The reciprocating air compressor unit of claim 51 wherein said valve piston assembly includes a sliding seal mounted to reciprocate along at least a portion of said valve stem to contact said valve outlet to cause said valve piston assembly to prevent air from flowing from said valve inlet chamber through said valve outlet when said compressor unit is not drawing air through said valve outlet, the movement of said valve piston assembly away from the position at which said valve piston assembly prevents air from flowing from said valve inlet chamber and through said valve outlet to said compression cylinder inlet causing said sliding seal to move away from said valve outlet to allow air to flow to said compression cylinder inlet.

53. The reciprocating air compressor unit of claim 51 wherein said valve inlet includes a filter to remove impurities from air that passes through said valve inlet and enters said valve inlet chamber.

54. The reciprocating air compressor unit of claim 51 wherein said valve piston assembly includes a sliding seal mounted to reciprocate along at least a portion of said valve stem to contact said valve outlet to cause said valve piston assembly to prevent air from flowing from said valve inlet chamber through said valve outlet when said air compressor unit is not drawing air through said valve outlet, the movement of said valve piston assembly away from the position at which said valve piston assembly prevents air from flowing from said valve inlet chamber and through said valve outlet to said compression cylinder inlet causing said sliding seal to move away from said valve outlet to allow air to flow to said compression cylinder inlet, said valve inlet including a filter to remove impurities from air that passes through said valve inlet and enters said valve inlet chamber.

* * * * *

UNITED STATES PATENT AND TRADEMARK OFFICE

CERTIFICATE OF CORRECTION

PATENT NO. : 7,086,841 B2
APPLICATION NO. : 10/827647
DATED : August 8, 2006
INVENTOR(S) : James P. Cornwell It is certified that error appears in the above-identified patent and that said Letters Patent is hereby corrected as shown below:

| | |
|---|---|
| Column 10, line 54 | delete "10a" and replace with --110a-- |
| Column 18, line 61 | delete "94b" and replace with --94h-- |
| Column 21, line 54 | delete "hOm" and replace with --110m-- |
| Column 29, line 49 | delete "26A" |
| Column 36, line 65 | delete "though" and replace with --through-- |
| Column 37, line 16 | delete "though" and replace with --through-- |
| Column 37, line 28 | delete "though" and replace with --through-- |
| Column 42, line 41 | delete "though" and replace with --through-- |
| Column 42, line 44 | delete "though" and replace with --through-- |
| Column 42, line 55 | delete "though" and replace with --through-- |

Signed and Sealed this

Sixth Day of March, 2007

JON W. DUDAS
*Director of the United States Patent and Trademark Office*

UNITED STATES PATENT AND TRADEMARK OFFICE

CERTIFICATE OF CORRECTION

PATENT NO. : 7,086,841 B2
APPLICATION NO. : 10/827647
DATED : August 8, 2006
INVENTOR(S) : James P. Cornwell It is certified that error appears in the above-identified patent and that said Letters Patent is hereby corrected as shown below:

| | |
|---|---|
| Column 10, line 54 | delete “10a” and replace with --110a-- |
| Column 16, line 55 | delete “though” and replace with --through-- |
| Column 17, line 50 | delete “though” and replace with --through-- |
| Column 18, line 61 | delete “94b” and replace with --94h-- |
| Column 19, line 41 | delete “though” and replace with --through-- |
| Column 21, line 54 | delete “hOm” and replace with --110m-- |
| Column 29, line 49 | delete “26A” |
| Column 36, line 65 | delete “though” and replace with --through-- |
| Column 37, line 16 | delete “though” and replace with --through-- |
| Column 37, line 28 | delete “though” and replace with --through-- |
| Column 42, line 24 | delete “though” and replace with --through-- |
| Column 42, line 41 | delete “though” and replace with --through-- |
| Column 42, line 44 | delete “though” and replace with --through-- |

UNITED STATES PATENT AND TRADEMARK OFFICE

CERTIFICATE OF CORRECTION

PATENT NO. : 7,086,841 B2
APPLICATION NO. : 10/827647
DATED : August 8, 2006
INVENTOR(S) : James P. Cornwell It is certified that error appears in the above-identified patent and that said Letters Patent is hereby corrected as shown below:

Column 42, line 55 delete "though" and replace with --through--

Signed and Sealed this

Seventeenth Day of April, 2007

JON W. DUDAS
*Director of the United States Patent and Trademark Office*